US007240382B2

(12) United States Patent
Berrocal et al.

(10) Patent No.: US 7,240,382 B2
(45) Date of Patent: Jul. 10, 2007

(54) METHOD AND TOOL FOR SECURING TOGETHER TWO OR MORE LAYERS OF A MATTRESS USING A PLASTIC FASTENER

(75) Inventors: William G. Berrocal, Worcester, MA (US); John Godfrey, Lincolnton, NC (US)

(73) Assignee: Avery Dennison Corporation, Pasadena, CA (US)

( * ) Notice: Subject to any disclaimer, the term of this patent is extended or adjusted under 35 U.S.C. 154(b) by 101 days.

(21) Appl. No.: 10/865,684

(22) Filed: Jun. 10, 2004

(65) Prior Publication Data

US 2005/0076447 A1 Apr. 14, 2005

Related U.S. Application Data

(60) Provisional application No. 60/502,869, filed on Sep. 15, 2003.

(51) Int. Cl.
*A47C 31/02* (2006.01)
*A44B 1/18* (2006.01)
*D05B 11/00* (2006.01)

(52) U.S. Cl. ..... 5/408; 5/696; 112/2.2; 24/114.3; 24/102 T

(58) Field of Classification Search ..... 5/408–410, 5/696; 24/72.7, 114.3, 102 R, 102 T; 112/2.2
See application file for complete search history.

(56) References Cited

U.S. PATENT DOCUMENTS 3,608,157 A * 9/1971 Molt ..... 24/102 T
3,701,174 A * 10/1972 Randolph ..... 24/114.3
3,837,020 A * 9/1974 Bosch ..... 5/411
4,044,412 A * 8/1977 Barron ..... 24/114.3
4,111,347 A * 9/1978 Bone ..... 227/68
5,309,612 A * 5/1994 Briere et al. ..... 24/114.3
6,718,894 B2 * 4/2004 Whaley ..... 112/470.27

* cited by examiner

*Primary Examiner*—Michael Trettel
(74) *Attorney, Agent, or Firm*—Kriegsman & Kriegsman

(57) ABSTRACT

A method for coupling together at least two layers of a mattress includes the steps of aligning each layer in its proper position in relation to the other layers of the mattress and, after the alignment step, inserting a plastic fastener through the layers. A fastener dispensing tool is provided for inserting plastic fasteners through the layers of the mattress. In one embodiment, the fastener dispensing tool includes a housing, a hollow sharpened needle fixedly coupled to the housing, an ejection mechanism for advancing a cross-bar of the plastic fastener through the hollow needle and a needle stop slidably coupled to the housing for limiting the degree of penetration of the hollow needle through the layers of the mattress. The needle stop is adapted to be releasably fixed in place by a locking member which is internally spring biased. The tool additionally includes a fastener guide assembly for guiding a clip of plastic fasteners into the tool and a runner bar guide for receiving the used runner bar of the fastener clip, the free ends of the fastener guide assembly and the runner bar guide being directed away from the hollow needle.

6 Claims, 58 Drawing Sheets

METHOD AND TOOL FOR SECURING TOGETHER TWO OR MORE LAYERS OF A MATTRESS USING A PLASTIC FASTENER

CROSS-REFERENCE TO RELATED APPLICATIONS

The present application claims the benefit under 35 U.S.C. 119(e) of U.S. provisional Patent Application Ser. No. 60/502,869, filed Sep. 15, 2003, the disclosure of which is incorporated herein by reference.

BACKGROUND OF THE INVENTION

The present invention relates generally to the manufacture of mattresses.

Mattresses are well-known in the art and are commonly used alone or in combination with additional components to form a bed on which a person may rest and/or sleep. Many types of conventional mattresses comprise a spring unit to provide its user with a satisfactory level of support and comfort.

A mattress spring unit typically includes an upper frame and a lower frame which are spaced slightly apart and which are arranged in a substantially parallel configuration. Each frame (also commonly referred to as a wire box) includes a rigid and durable wire, or rod, which is formed into a substantially rectangular design, said wire defining the outer periphery of its associated frame. In addition, a mattress spring unit typically comprises a plurality of uniformly spaced apart metal springs, or coils, which extend between the upper and lower frames. Each spring includes a longitudinal axis which extends substantially at a right angle relative to the upper and lower frames. As can be appreciated, the plurality of springs enables the upper frame to move, or give, towards the lower frame when a downward force is applied onto the upper frame. As a result, when an individual rests on the upper frame of the spring unit, the body weight of said individual is uniformly absorbed by the plurality of springs, which is highly desirable.

A layer of cushioning material, in the form of a pad, is typically secured onto each frame of a mattress spring unit. The layer of cushioning material is commonly in the form of a non-woven fabric having an approximate thickness of ¾ of an inch. One type of cushioning material which is commonly secured onto the upper and lower frames of a mattress spring unit is a Flexatron® cushioning pad which is manufactured by Kingsdown, Inc.

The layer of cushioning material is typically secured onto each frame of the mattress spring unit in the following manner. Specifically, the layer of cushioning material is disposed against the outer surface of each frame. The outer periphery of each layer of material is pulled tightly past the wire of its associated frame. A short length of said layer is then wrapped around the wire and is disposed against the underside of a portion of said layer, thereby creating a double thickness portion of said layer of material with said wire trapped therebetween. With said layer of cushioning material double-backed in the manner described above, a conventional, pneumatically-driven staple gun is used to secure together the double-backed portion of said layer of material, thereby trapping the wire therewithin.

Typically, metallic C-shaped staples, or rings, are used to secure together the double-backed portion of said layer of material at approximately 2 inch intervals. Specifically, the staple gun dispenses each C-shaped staple through the double-backed portion of said layer of material and bends the sharpened free ends of each C-shaped staple into direct alignment and contact with one another.

With a layer of cushioning material secured onto each wire box of a mattress spring unit, many high-end mattresses often dispose 2, 3 or 4 layers of varying density foam rubber on top of the spring unit. As can be appreciated, these layers of foam rubber serve to significantly increase the level of comfort of the mattress, which is highly desirable. Having disposed multiple layers of foam rubber onto the mattress spring unit, an outer layer of fabric (e.g., a quilted cotton material) is sewn over the spring unit and the layers of foam to form the finished mattress.

It should be noted that conventional high-end mattress manufacturing techniques secure together particular layers of the mattress (and, in particular, the multiple layers of foam rubber) using an adhesive prior to sewing the outer layer of quilted cotton material around the remainder of the mattress. Specifically, one or both of the contact surfaces of adjacent layers are sprayed with an adhesive. With the adhesive sprayed onto one or both of the contact surfaces of adjacent layers, the layers are first aligned and then drawn into contact with one another.

It should be noted that the aforementioned method of using adhesives to secure together multiple layers of a mattress suffers from a few notable drawbacks.

As a first drawback, the use of adhesives to secure together multiple layers of a mattress results in a significant level of waste. Specifically, if the layers of material are secured together in misalignment, there is no means to separate the layers and attempt to re-secure the layers. As a result, layers of material which are secured together in misalignment are often discarded as waste, thereby increasing manufacturing costs, which is highly undesirable.

As a second drawback, the use of adhesives to secure together multiple layers of a mattress creates an unhealthy amount of fumes where the mattress is manufactured, thereby creating a potentially hazardous working environment, which is highly undesirable.

As a third drawback, the use of adhesives to secure together multiple layers of a mattress often creates audible crackling sounds as the adhesives age, which is highly undesirable.

SUMMARY OF THE INVENTION

It is an object of the present invention to provide a new and improved method and tool for securing together two or more layers of a mattress.

It is another object of the present invention to provide a method and tool for securing together two or more layers of a mattress without the use of an adhesive.

Therefore, according to one feature of the present invention, there is provided a mattress comprising a first layer, a second layer, and a plastic fastener for coupling together said first and second layers.

According to another feature of the present invention, there is provided a method for coupling together first and second layers of a mattress, said method comprising the steps of positioning said first layer relative to said second layer; and dispensing a plastic fastener through said first and second layers.

According to another feature of the present invention, there is provided tool for dispensing a plastic fastener, the plastic fastener comprising a cross-bar formed onto one end of a thin filament, said tool comprising a housing, a needle fixedly coupled to the housing, the needle being shaped to define a longitudinal bore, and a pneumatically-driven ejection mechanism for advancing the cross-bar of the plastic fastener through the longitudinal bore of the needle, said ejection mechanism having a forward stroke which is manually adjustable in length.

According to another feature of the present invention, there is provided a tool for dispensing a plastic fastener through at least one layer, the plastic fastener comprising a cross-bar formed onto one end of a thin filament, said tool comprising a housing, a hollow needle fixedly coupled to the housing, the needle being shaped at one end to penetrate through the at least one layer, an ejection mechanism for advancing the cross-bar of the plastic fastener through the hollow needle, and a needle stop slidably coupled to the housing, the needle stop limiting the degree of penetration of the hollow needle through the at least one layer, the needle stop being adapted to be releasably fixed in place in either of two or more set positions.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 4(*b*) is a front, top perspective view of the tool shown in FIG. 4(*a*), the tool being shown with a clip of two fasteners loaded therein;

FIG. 4(*c*) is a top plan view of the tool shown in FIG. 4(*a*), the tool being shown with a clip of two fasteners loaded therein;

FIG. 4(*d*) is a front plan view of the tool shown in FIG. 4(*a*), the tool being shown with a clip of two fasteners loaded therein;

FIG. 4(*e*) is a bottom plan view of the tool shown in FIG. 4(*a*), the tool being shown with a clip of two fasteners loaded therein;

FIG. 5(*b*) is a rear, top perspective view of the right side casing shown in FIG. 5(*a*);

FIG. 5(*c*) is an enlarged, fragmentary, front, bottom perspective view of the right side casing shown in FIG. 4(*a*);

FIG. 6(*b*) is a rear, top perspective view of the left side casing shown in FIG. 6(*a*);

FIG. 6(*c*) is an enlarged, fragmentary, rear, top perspective view of the left side casing shown in FIG. 6(*a*);

FIG. 7(*b*) is a rear, top, right end perspective view of the nose shown in FIG. 7(a);

FIG. 33(*b*) is an enlarged, front perspective view of the feed pawl shown in FIG. 28;

FIG. 37(*b*) is an enlarged, bottom, right end perspective view of the feed slide shown in FIG. 28;

FIG. 38(*b*) is a front, top perspective view of the tool shown in FIG. 38(*a*);

FIG. 38(*c*) is a partially exploded, rear, top perspective view of the tool shown in FIG. 38(*a*);

FIG. 38(*d*) is a top plan view of the tool shown in FIG. 38(*a*);

FIG. 38(*e*) is a rear plan view of the tool shown in FIG. 38(*a*);

FIG. 45(*b*) is an enlarged, fragmentary, rear, top perspective view of the tool shown in FIG. 38(*a*);

FIG. 70(*b*) is an enlarged, fragmentary, front perspective view of the leading end of the right side casing shown in FIG. 50(*a*);

DETAILED DESCRIPTION OF THE PREFERRED EMBODIMENT

Figure 1:
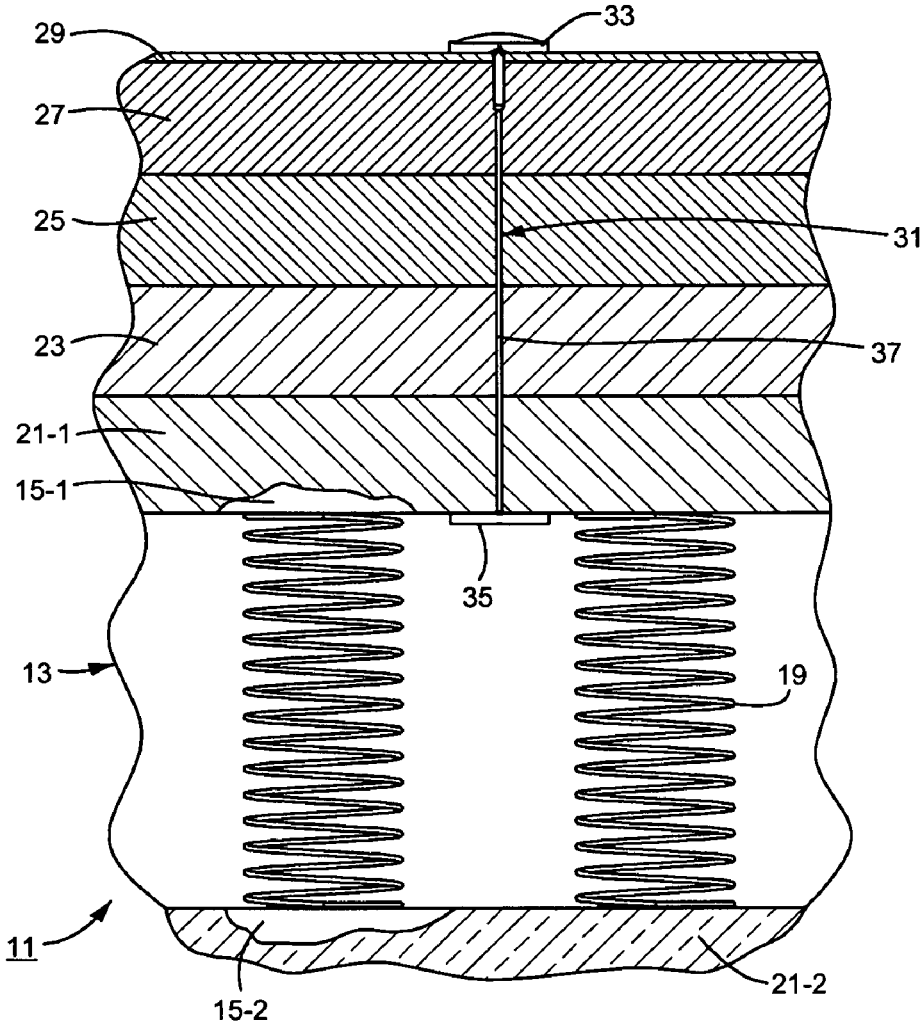
FIG. 1 is a fragmentary, front plan section view, broken away in part, of a first embodiment of a mattress constructed according to the teachings of the present invention, the fastener not being shown in section for purposes of clarity.

Referring now to FIG. 1, there is shown a fragmentary, front plan, section view, broken away in part, of a mattress constructed according to the teachings of the present invention, said mattress being identified generally by reference numeral 11.

Mattress 11 comprises a conventional mattress spring unit 13. Mattress spring unit 13 includes identical upper and lower frames 15-1 and 15-2 which are spaced slightly apart and which are arranged in a substantially parallel configuration. Each frame 15 (also referred to herein as a wire box) includes a rigid and durable wire, or rod, (not shown) which is formed into a substantially rectangular design, the wire defining the outer periphery of its associated frame 15.

Mattress spring unit 13 additionally includes a plurality of uniformly spaced apart metal springs, or coils, 19 which extend between upper and lower frames 15-1 and 15-2. Each spring 19 includes a longitudinal axis which extends substantially at a right angle relative to the upper and lower frames 15-1 and 15-2. As can be appreciated, springs 19 enable upper frame 15-1 to move, or give, towards lower frame 15-2 when a downward force is applied onto upper frame 15-1. As a result, when an individual rests on upper frame 15-1, the body weight of said individual is uniformly absorbed by the plurality of springs 19, which is highly desirable.

A layer of cushioning material 21-1 is preferably secured onto frame 15-1 of mattress spring unit 13. Similarly, a layer of cushioning material 21-2 is preferably secured onto frame 15-2 of mattress spring unit 13. Each layer of cushioning material 21 is preferably in the form of a non-woven fabric pad (e.g., a Flexatron® cushioning pad) having an approximate thickness of ¾ of an inch.

Layer of cushioning material 21 is secured onto each frame 15 in the following manner. Specifically, layer of cushioning material 21 is disposed against the outer surface of each frame 15. The outer periphery of each layer of cushioning material 21 is pulled tightly past the wire of its associated frame 15. The free end of each layer of cushioning material 21 is then wrapped around its associated wire and is double-backed against the underside of the remainder of layer of cushioning material 21, thereby creating a double thickness portion of layer 21 with the wire trapped therebetween. With layer of cushioning material 21 double-backed in the manner described above, a metallic C-shaped staple or other fastening device (not shown) is disposed through the double-backed portion of layer 21 so as to retain layer of cushioning material 21 onto its associated frame 15.

With layers of material 21 secured onto frames 15 of spring unit 13, multiple layers of varying density foam rubber are mounted onto layer of cushioning material 21-1 in proper alignment therewith. Specifically, a first layer of foam rubber 23 is mounted onto layer 21-1 in proper alignment therewith, a second layer of foam rubber 25 is mounted onto first layer of foam rubber 23 in proper alignment therewith, and a third layer of foam rubber 27 is mounted onto second layer of foam rubber 25 in proper alignment therewith. Furthermore, an outer layer of fabric 29, such as a quilted cotton material, is mounted onto third layer of foam rubber 27 in proper alignment therewith.

With layers of foam rubber 23, 25 and 27 and outer layer of fabric 29 mounted onto spring unit 13 in the manner described above, one or more plastic fasteners 31 are used to retain the various layers of mattress 11 in position, as will be described further in detail below. It should be noted that the use of plastic fasteners 31 in the manufacturing of mattress 11 serves as a principal novel feature of the present invention.

Plastic fastener 31 is preferably in the form of a conventional heavy duty plastic fastener. In particular, plastic fastener 31 is preferably in the form of an H-shaped heavy duty fastener of the type sold by Avery Dennison Corporation as part of the Extra Heavy Duty T-end™ system. Specifically, plastic fastener 31 is preferably in the form of a 3 inch plastic member which includes a first end shaped to define a cross-bar 33 (also commonly referred to as a "T-bar"), a second end similarly shaped to define a cross-bar 35 (also commonly referred to as a "T-bar"), and a thin filament 37 interconnecting cross-bars 33 and 35.

Figure 23:
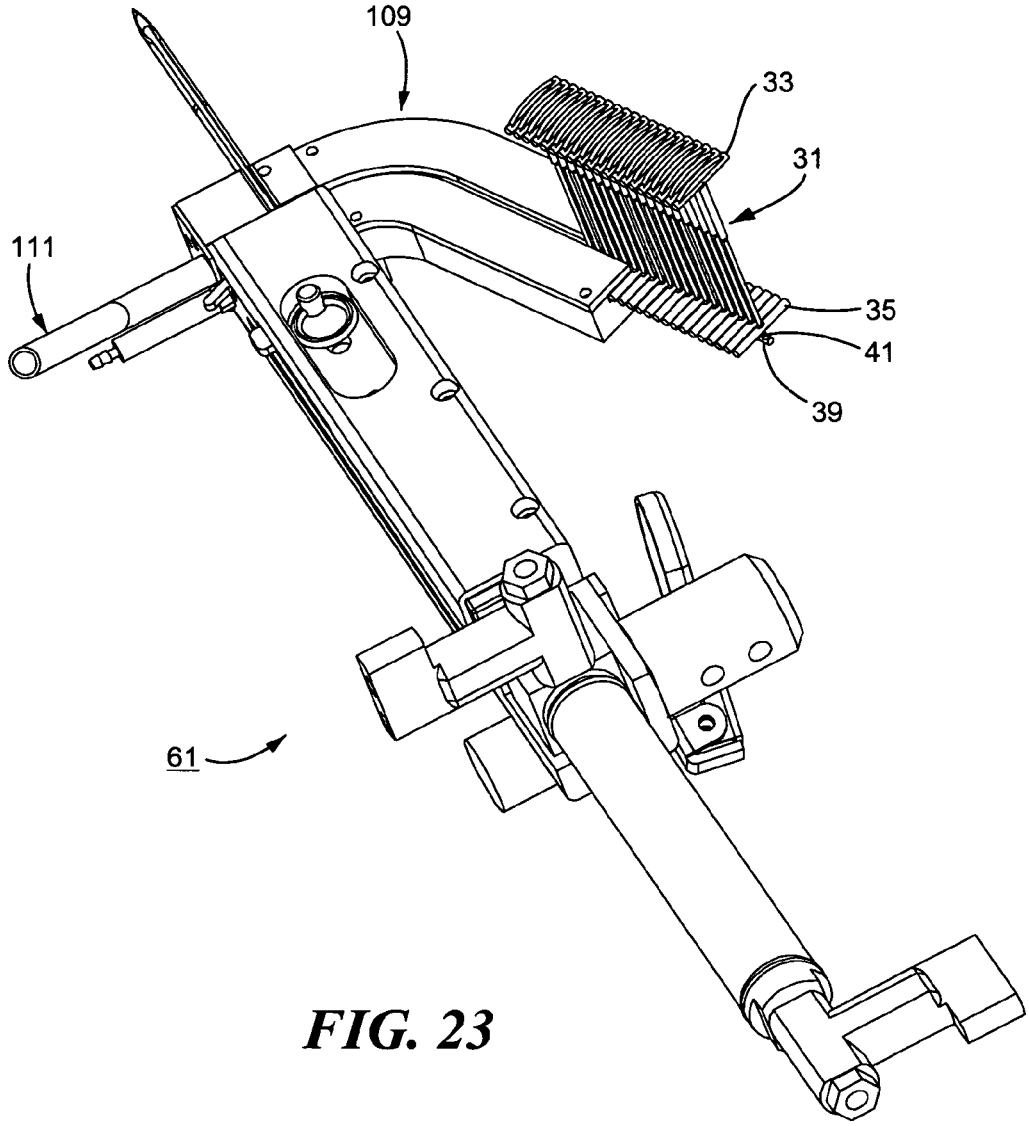
FIG. 23 is a front, bottom, right end perspective view of the tool shown in FIG. 4(*a*), the tool being shown with a clip of fasteners loaded therein.

Plastic fastener 31 is preferably mass-produced in a unitary form known commonly as fastener stock. The fastener stock is constructed in a clip-type assembly in which individual plastic fasteners 31 are arranged in a spaced, side-by-side orientation, with the respective cross-bars 33 and 35 parallel to one another, each of cross-bars 35 being joined to a common, orthogonally-disposed runner bar 39 by a severable connector 41, as seen most clearly in FIG. 23. The aforementioned fastener clip is typically manufactured through the process of injection molding.

Preferably, plastic fasteners 31 are used to secure together cushioning layer 21-1, foam layers 23, 25 and 27, and outer layer 29 at approximately 2 inch intervals. As seen most clearly in FIG. 1, with a fastener 31 dispensed through the aforementioned layers, cross-bar 33 lies flat against the top surface of outer layer 29 and cross-bar 35 lies flat against the bottom surface of cushioning layer 21-1.

Figure 2:
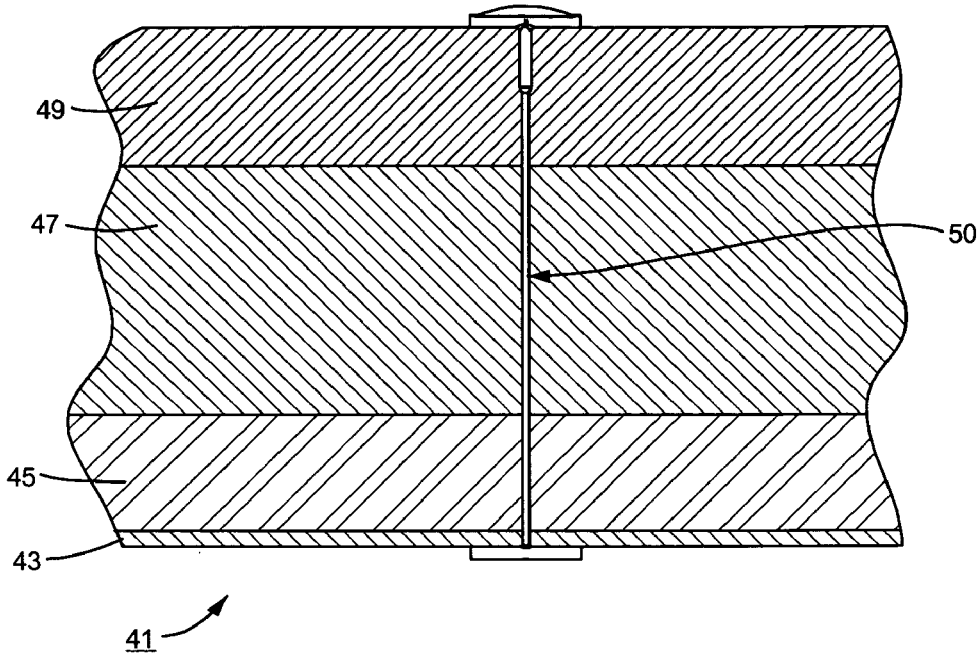
FIG. 2 is a fragmentary, front plan section view of a pillow top which may be inserted into the mattress shown in FIG. 1, the fastener not being shown in section for purposes of clarity.

It should be noted that additional layers may be inserted into mattress 11 without departing from the spirit of the present invention. Specifically, FIG. 2 shows a pillow top 41 which may be inserted into mattress 11 for additional support and comfort. Pillow top 41 comprises a thin fabric layer 43 (e.g., a thin, non-woven sheet of polyethylene) which may be of the type commonly referred to in the art as Versare fabric. Pillow top 41 additionally comprises first, second and third layers of foam 45, 47 and 49 which are stacked in proper alignment on fabric layer 43.

Preferably, pillow top 41 is inserted into mattress 11 between foam layer 27 and outer layer 29. A fastener 50, similar in construction to fastener 31 but potentially having a different overall length, may be used to couple together layers 43, 45, 47, and 49, as seen most clearly in FIG. 2, prior to the insertion of pillow top 41 into mattress 11. Also, a fastener similar in construction to fastener 31 but potentially having a greater overall length may be driven through all of layers 21, 23, 25, 27, 43, 45, 47, 49 and 29.

Figure 3:
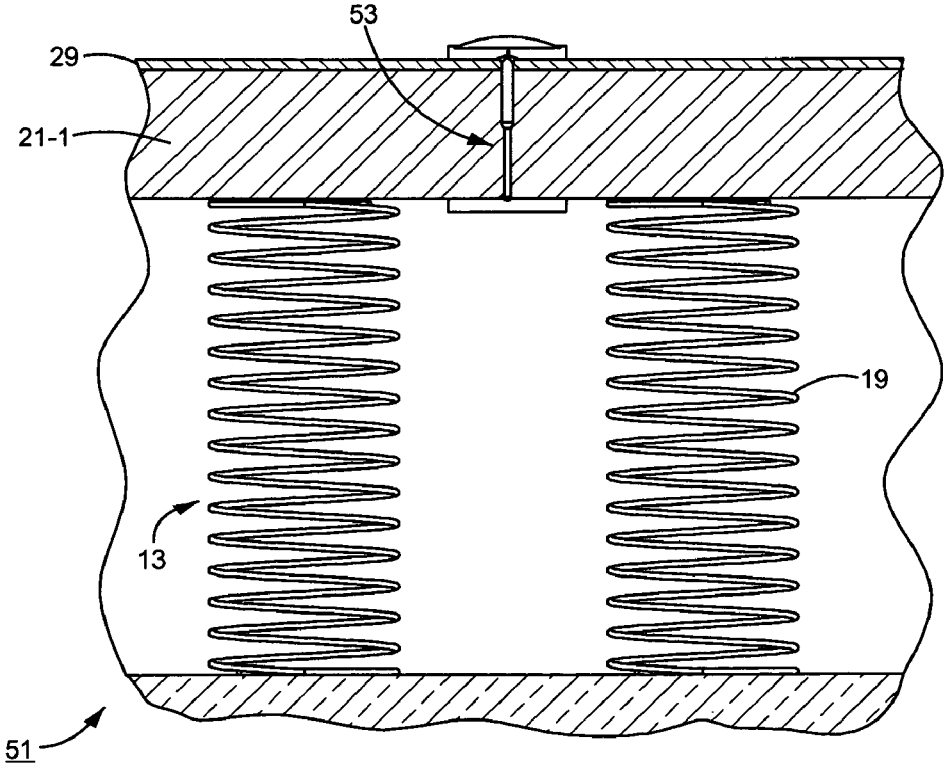
FIG. 3 is a fragmentary, front plan, section view of a second embodiment of a mattress constructed according to the teachings of the present invention, the fastener not being shown in section for purposes of clarity.
Figure 4A:
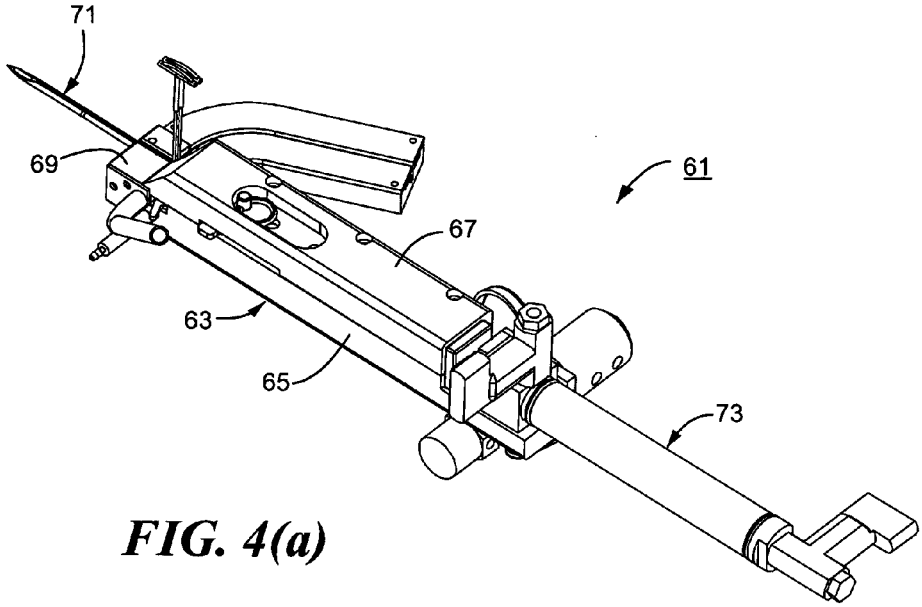
FIG. 4(*a*) is a front, bottom perspective view of a first embodiment of a tool for dispensing a plastic fastener through one or more layers of a mattress, said tool being constructed according to the teachings of the present invention, the tool being shown with a clip of two fasteners loaded therein.
Figure 4B:
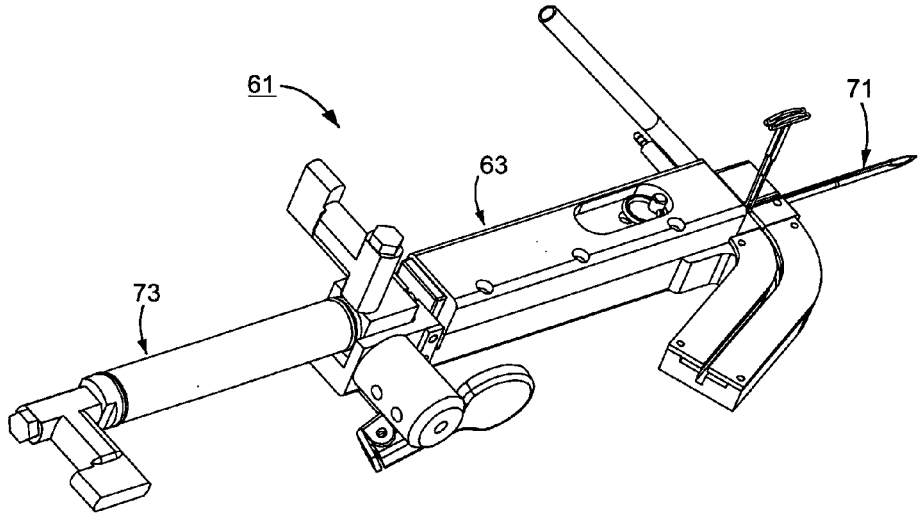
Figure 4C:
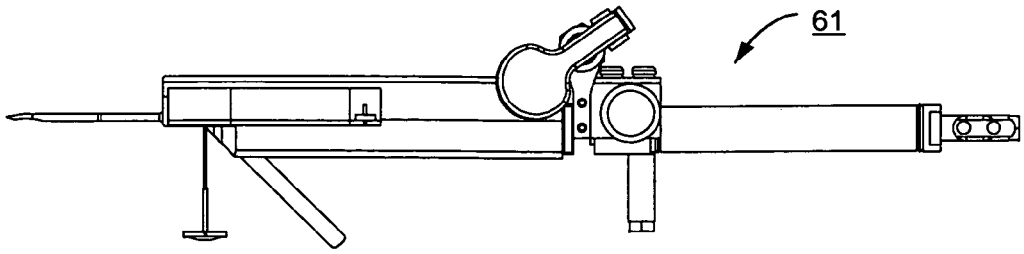
Figure 4D:
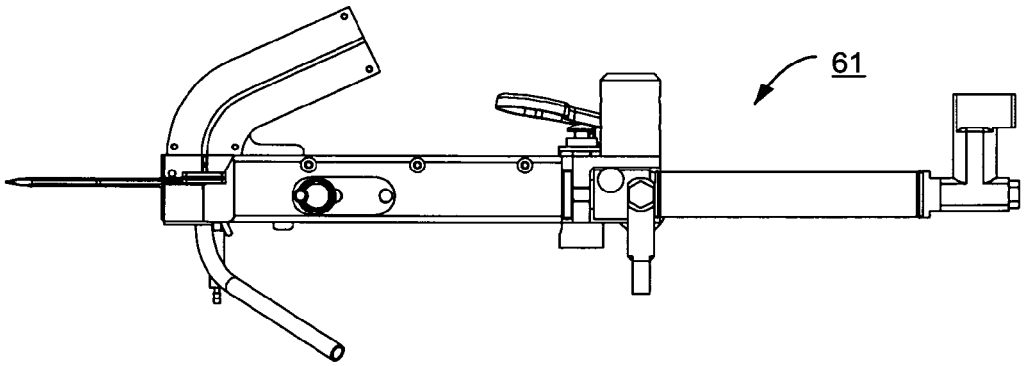
Figure 4E:
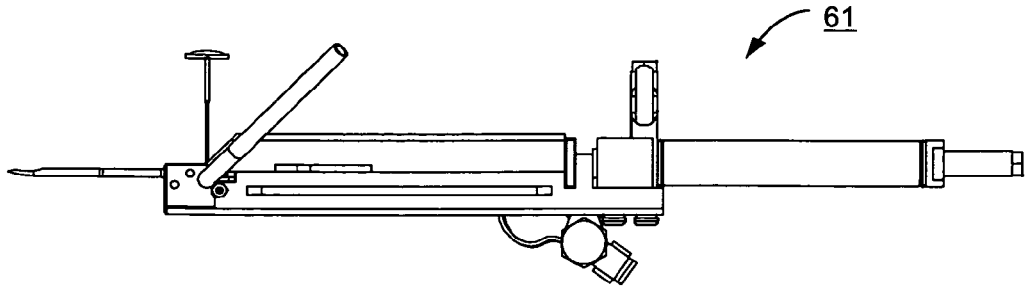

It should also be noted that layers may be removed from mattress 11 without departing from the spirit of the present invention. Specifically, FIG. 3 shows a mattress 51 which differs in construction from mattress 11 in that mattress 51 does not include foam layers 23, 25 and 27. Because mattress 51 is substantially thinner than mattress 11, mattress 51 preferably includes a fastener 53 which has a shorter overall length than fastener 31.

Referring now to FIGS. 4(*a*)–(*e*), there are shown various views of a first embodiment of a tool for use in dispensing one or more plastic fasteners, said tool being constructed according to the teachings of the present invention and identified generally by reference numeral 61. As will be described further below, tool 61 is designed principally for use in installing heavy-duty plastic fasteners, such as fastener 31, through multiple layers of a mattress, such as mattress 11.

Tool 61 is an air compression powered fastener dispensing tool. Preferably, tool 61 is derived from an $SPU_4M$ model, extra heavy duty T-end fastener dispensing tool of the type manufactured and sold by Avery Dennison Corporation of Pasadena, Calif. which has been modified in a number of ways, as will be described in detail herein.

Figure 5A:
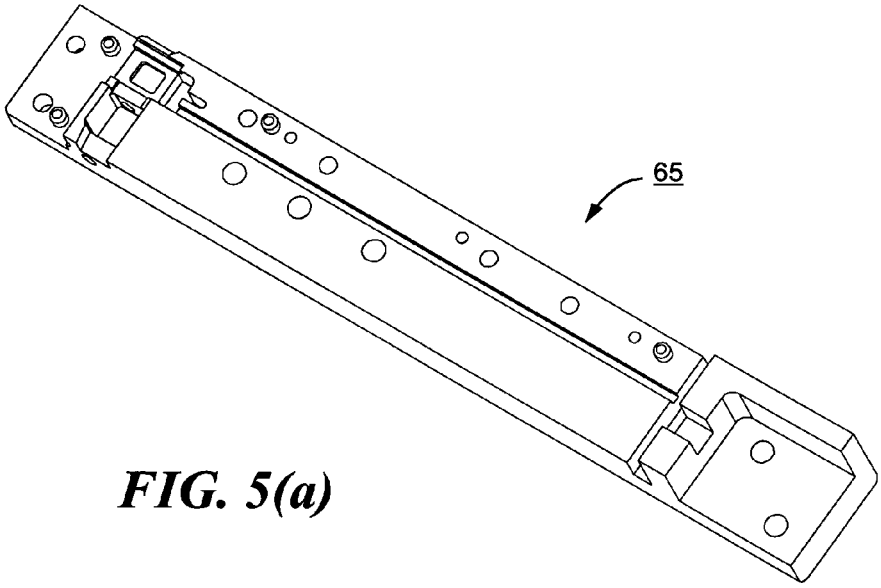
FIG. 5(*a*) is a front, bottom perspective view of the right side casing of the tool shown in FIG. 4(*a*)
Figure 5B:
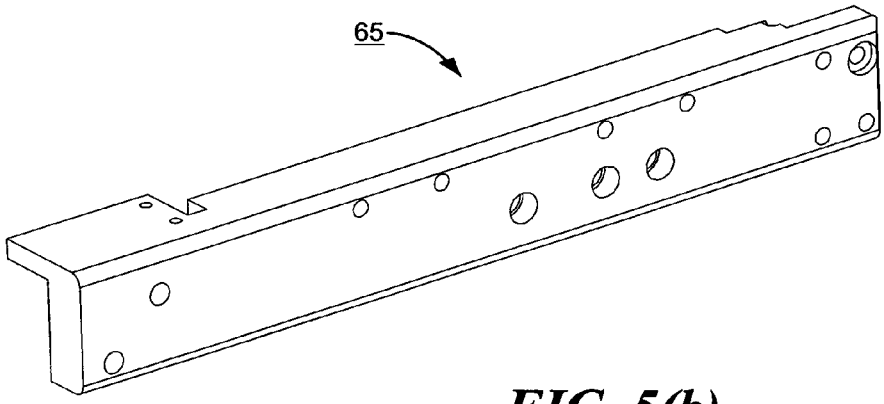
Figure 5C:
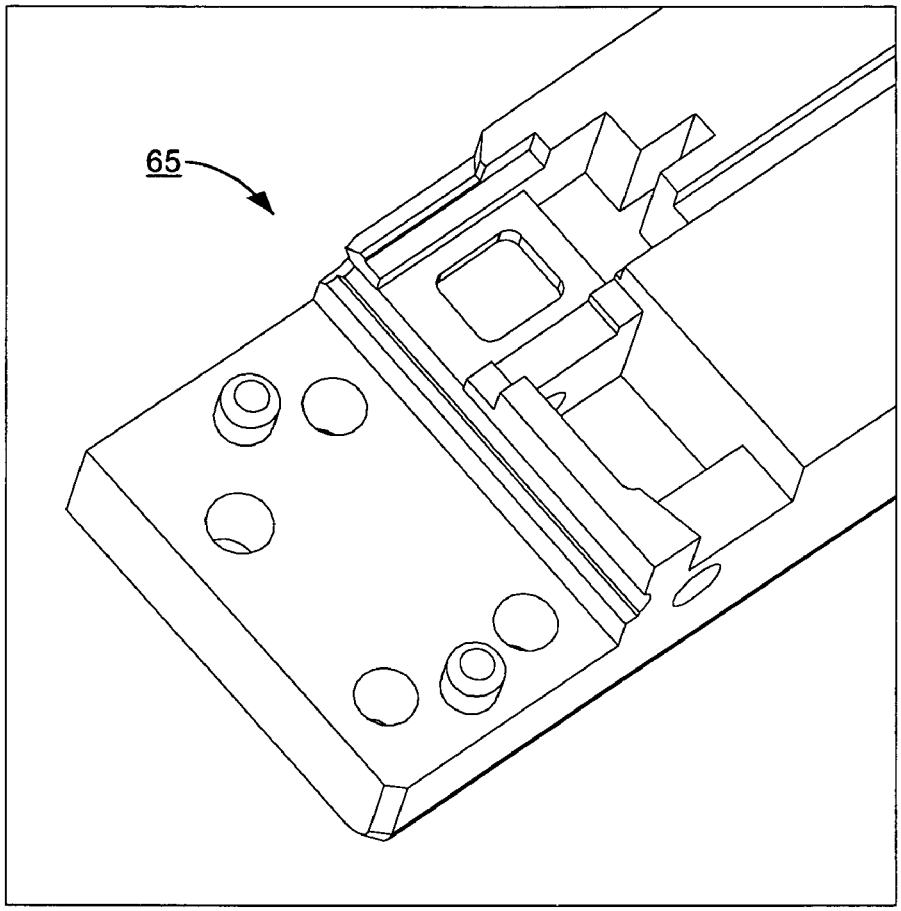
Figure 6A:
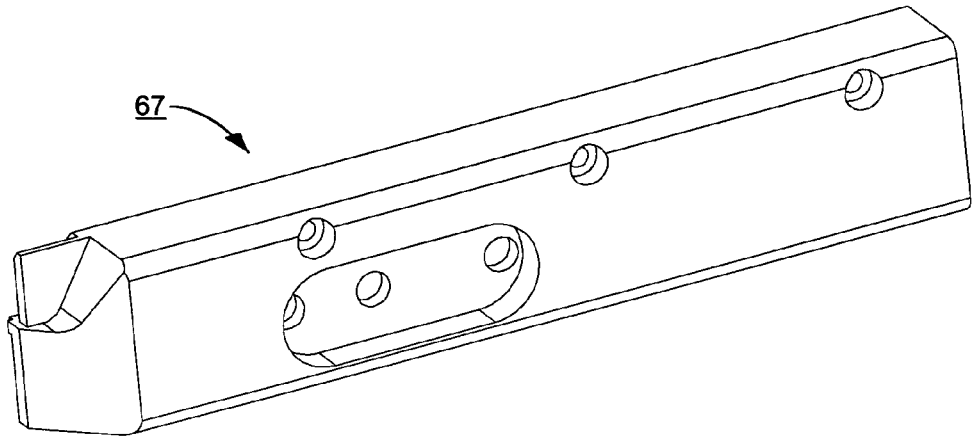
FIG. 6(*a*) is a front, top perspective view of the left side casing of the tool shown in FIG. 4(*a*)
Figure 6B:
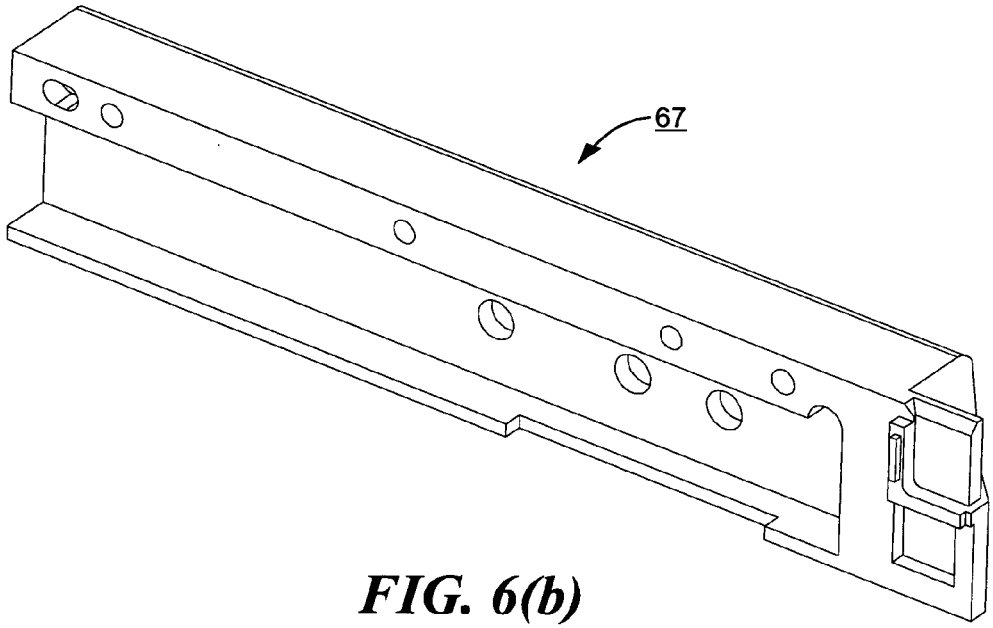
Figure 6C:
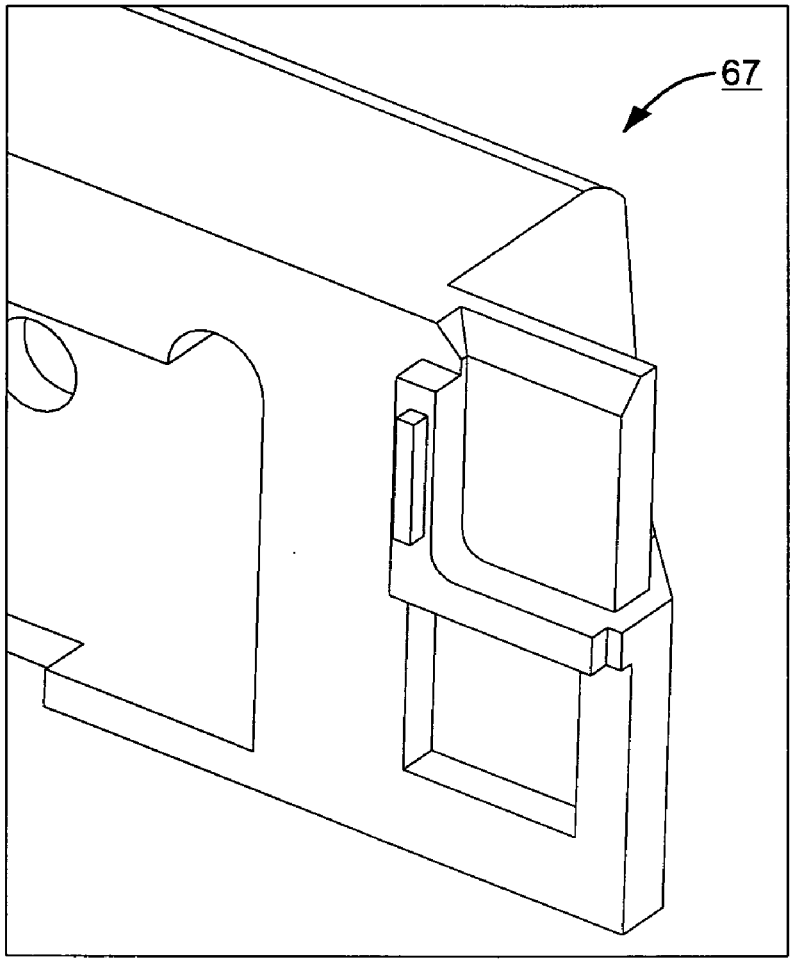
Figures 7A, 7B:
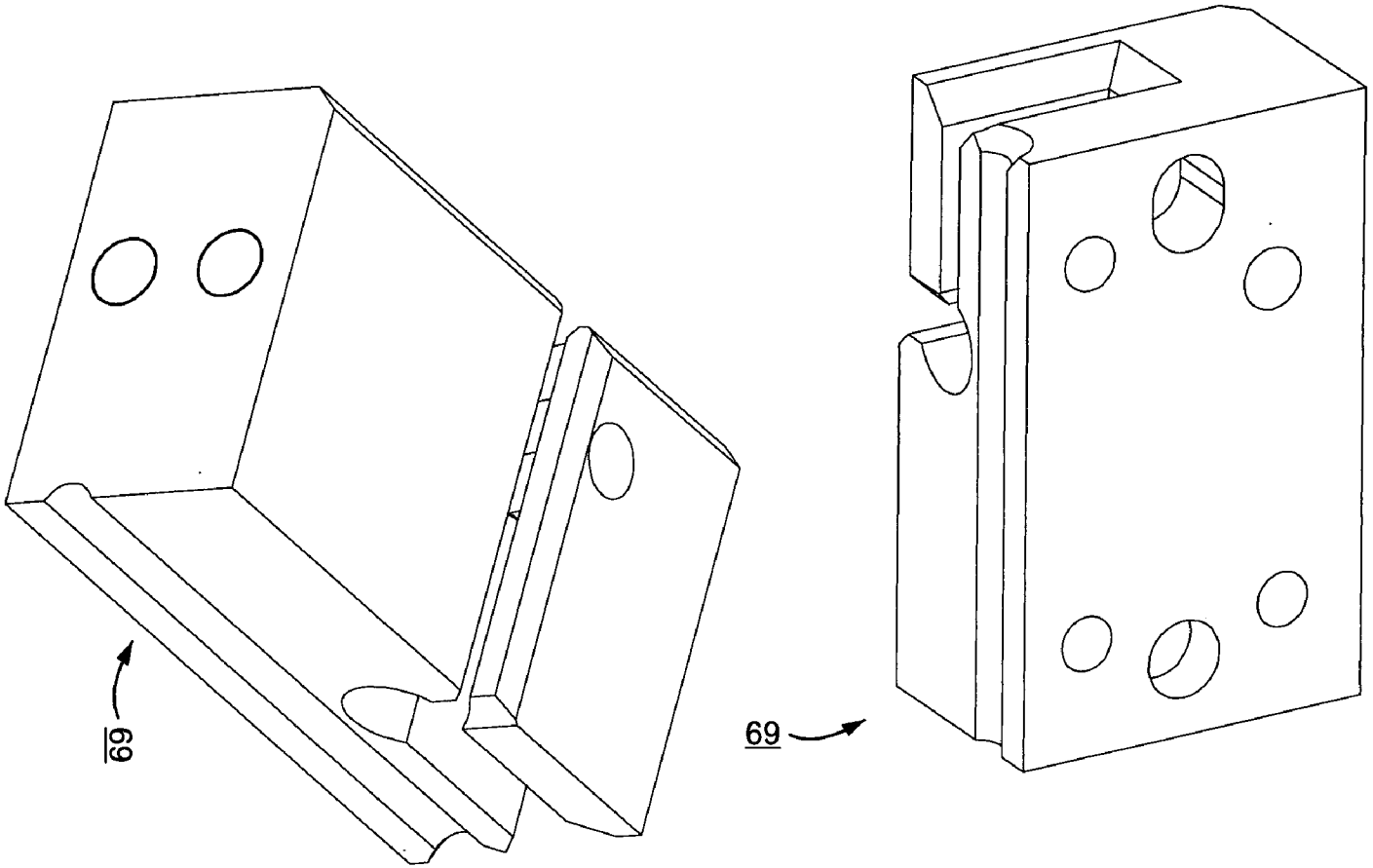
FIG. 7(*a*) is an enlarged, front, bottom, right end perspective view of the nose of the tool shown in FIG. 4(*a*)
Figure 8:
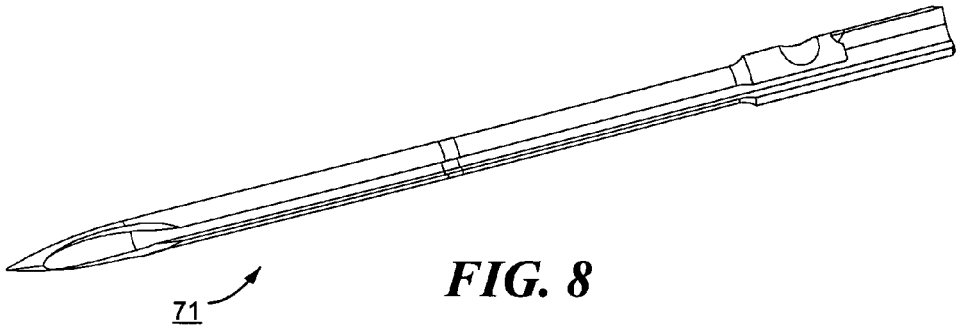
FIG. 8 is an enlarged, front, top perspective view of the needle shown in FIG. 4(*a*)

Tool 61 comprises a protective housing 63 which is constructed of a rigid and durable material. Housing 63 comprises a right side casing 65 (shown in isolation in FIGS. 5(*a*)–(*c*)) and a left side casing 67 (shown in isolation in FIGS. 6(*a*)–(*c*)) which are secured together by screws. Housing 63 additionally includes a nose 69 (shown in isolation in FIGS. 7(*a*)–(*b*)) which is secured onto the leading end of casings 65 and 67 by screws. Nose 69 is adapted to receive an elongated, extra heavy-duty T-end, hollow, slotted needle 71 (shown in isolation in FIG. 8).

As one novel feature of tool 61, it should be noted that needle 71 is manufactured to have a length which is considerably longer than other types of conventional extra heavy-duty T-end, hollow, slotted needles. Specifically, needle 71 is preferably approximately 3 inches in length, thereby enabling it to penetrate through all of layers 21-1, 23, 25, 27 and 29 of mattress 11. However, it is to be understood that tool 61 is not limited to having a needle of one length. Rather, tool is adapted to receive needles of varying length without departing from the spirit of the present invention.

Figure 9:
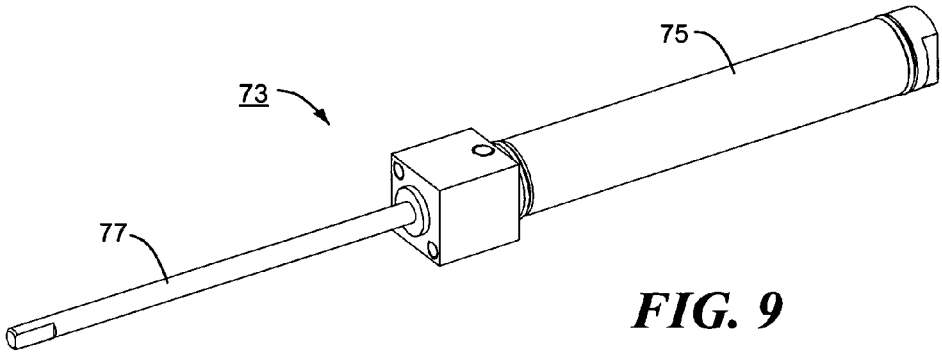
FIG. 9 is an enlarged, front, top perspective view of the drive cylinder shown in FIG. 4(*a*)
Figure 10:
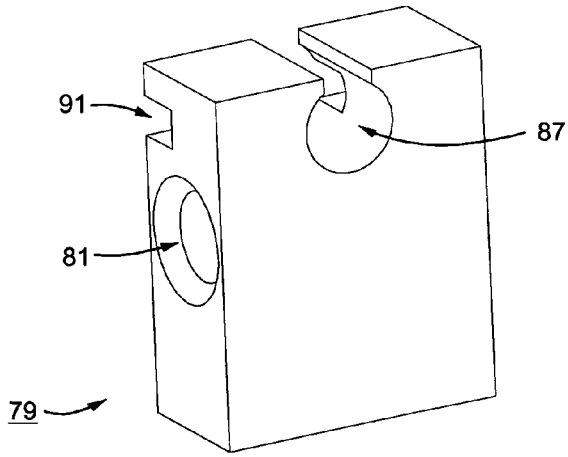
FIG. 10 is a an enlarged, front, top, left end perspective view of the slide for the tool shown in FIG. 4(*a*)

Tool 61 additionally comprises a pneumatically-driven ejection mechanism. Specifically, tool 61 comprises a drive cylinder 73 (shown in isolation in FIG. 9) which is pneumatically driven, drive cylinder 73 comprising an air chamber 75 and a push rod 77 which is telescopingly mounted within air chamber 75 and is adapted for axial displacement relative thereto. A slide 79 (shown in isolation in FIG. 10) is fixedly mounted onto the free end of push rod 77. Specifically, slide 79 is shaped to include a bore 81 which is sized and shaped to fittingly receive the free end of push rod 77. In this manner, the activation and deactivation of drive cylinder 73 serves to longitudinally displace push rod 77 and, in turn, slide 79.

Figure 11:
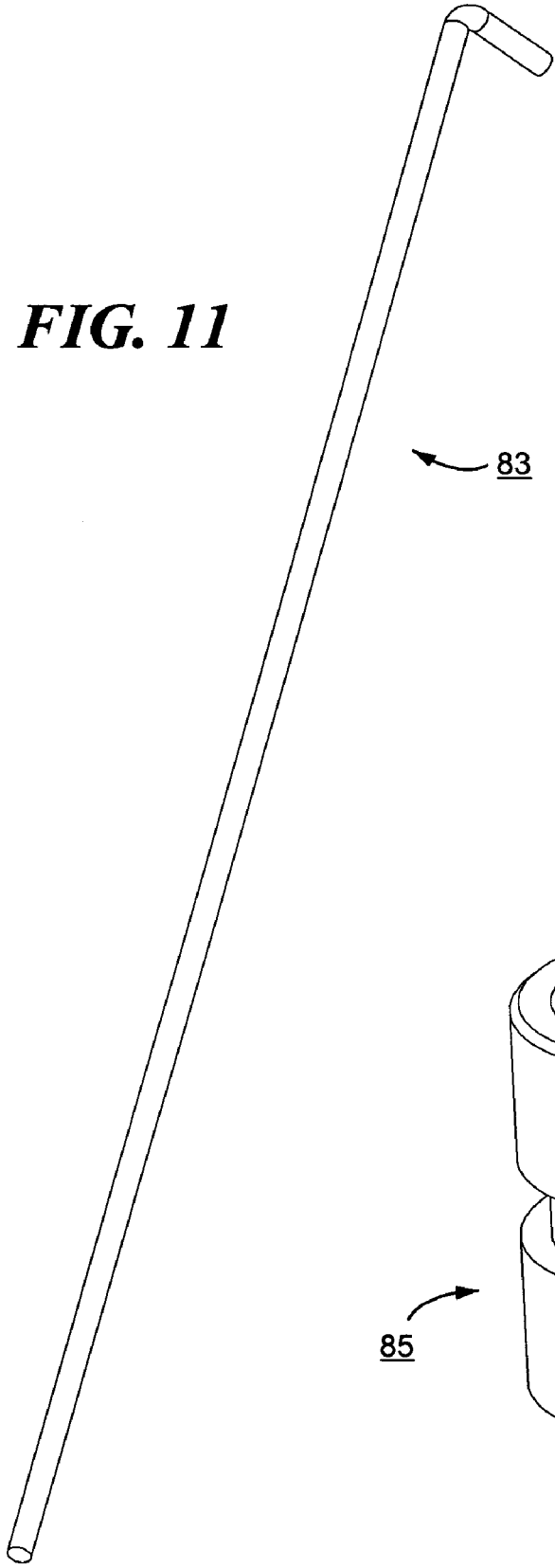
FIG. 11 is an enlarged, front, top perspective view of the ejector rod for the tool shown in FIG. 4(*a*)
Figure 12:
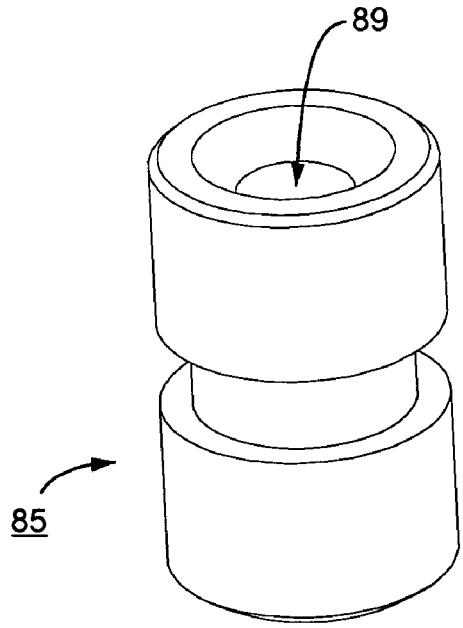
FIG. 12 is an enlarged, front, top perspective view of the pin for the tool shown in FIG. 4(*a*)

An L-shaped ejector rod 83 (shown in isolation in FIG. 11) is fixedly mounted onto slide 79 by means of a pin 85 (shown in isolation in FIG. 12). Specifically, pin 85 is fittingly disposed into a bore 87 formed in slide 79. In turn, ejector rod 83 is fittingly mounted into a longitudinal bore 89 formed in pin 85, a portion of the length of ejector rod 83 extending through an elongated rectangular notch 91 formed in slide 79.

As can be appreciated, the activation and deactivation of drive cylinder 73 serves to longitudinally displace slide 79 which, in turn, advances ejector rod 83 through tool 61. In particular, ejector rod 83 is aligned to selectively protrude axially through needle 71 so as to expel the cross-bar 35 of a fastener 31 out through the open tip of needle 71.

Figure 13:
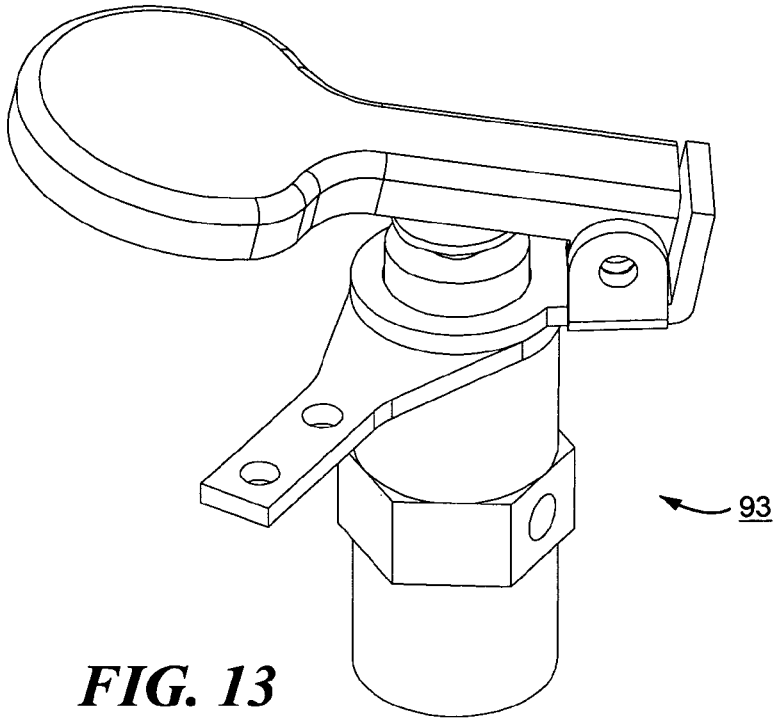
FIG. 13 is an enlarged, front, top perspective view of the finger switch assembly shown in FIG. 4(*a*)

It should be noted that the activation and deactivation of drive cylinder 73 is controlled through a finger switch assembly 93 (shown in isolation in FIG. 13). As can be appreciated, finger switch assembly 93 allows for tool 61 to be operated by hand, which is highly desirable.

Figure 14:
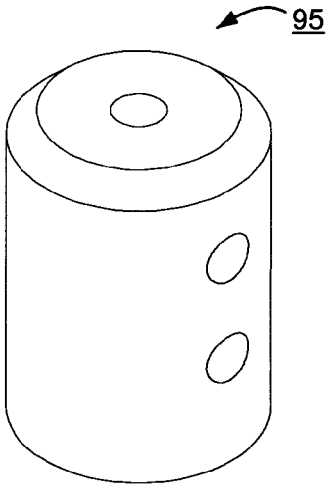
FIG. 14 is an enlarged, front, top, right end perspective view of the 2-position, three-way valve of the finger switch assembly shown in FIG. 13.
Figure 15:
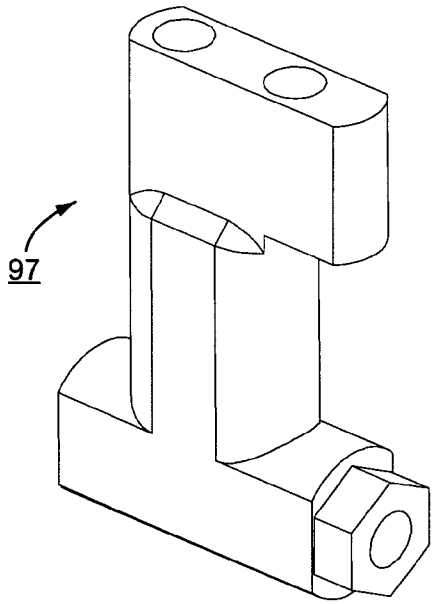
FIG. 15 is an enlarged, front, top, right end perspective view of the pneumatic sensor fitting shown in FIG. 4(*a*)

Finger switch assembly 93 comprises a two-position, three-way valve 95 (shown in isolation in FIG. 14). In addition, a pneumatic sensor fitting 97 is mounted onto drive cylinder 73 in communication with air chamber 75. The various tubing connections for pneumatic tool 11 are shown in a schematic representation identified as FIG. 16. Simply stated, valve 95 is coupled to an air supply source. In turn, the supply of air delivered to valve 95 is selectively routed into and/or out from air chamber 75 depending on the activation of finger switch assembly 93. In addition, air is delivered to an indexing mechanism for tool 61, as will be described further in detail below.

As noted above, the supply of air into air chamber 75 is used to drive slider 79 and, in turn, eject a fastener 31 out through needle 71 using ejector rod 83. However, it is to be noted that tool 61 is constructed with an externally adjustable forward stroke length to enable the consumer to eject a fastener out through needles of different lengths. Specifically, as seen most clearly in FIGS. 17(*a*)–17(*d*), tool 61 is adapted to receive needles of varying lengths. In this capacity, tool 61 can be used to dispose a plastic fastener through mattresses having varying thicknesses. In order to adjust to the varying lengths of needles which it can receive, tool 61 is provided with a variable forward stroke length.

Figure 19:
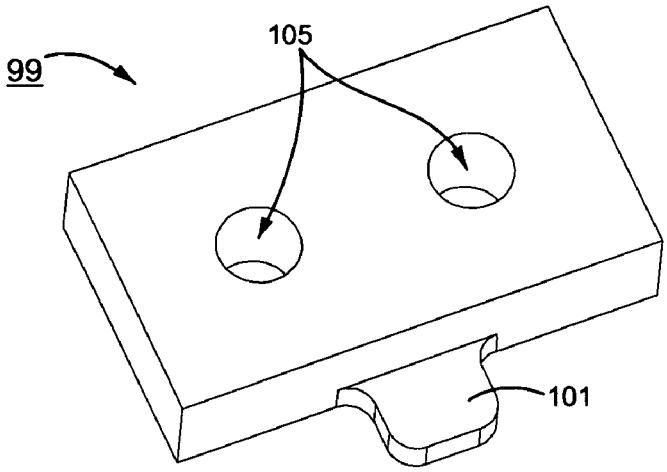
FIG. 19 is an enlarged front perspective view of the stop shown in FIG. 18(*a*)

As seen most clearly in FIGS. 18(*a*)–(*d*), tool 61 is provided with a movable, polyurethane stop 99 (shown in isolation in FIG. 19). As can be appreciated, stop 99 is mounted within tool 61. During the forward stroke, slider 79 is pneumatically driven forward until it contacts stop 99. In this manner, stop 99 serves to limit the forward advancement of slider 79, thereby regulating the length of its forward stroke.

Figure 20:
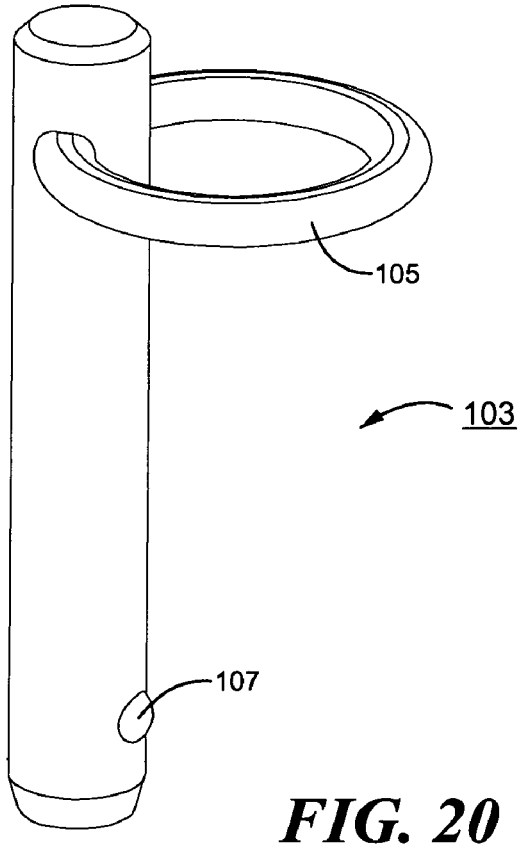
FIG. 20 is an enlarged front perspective view of the quick release pin shown in FIG. 18(*a*)
Figure 21:
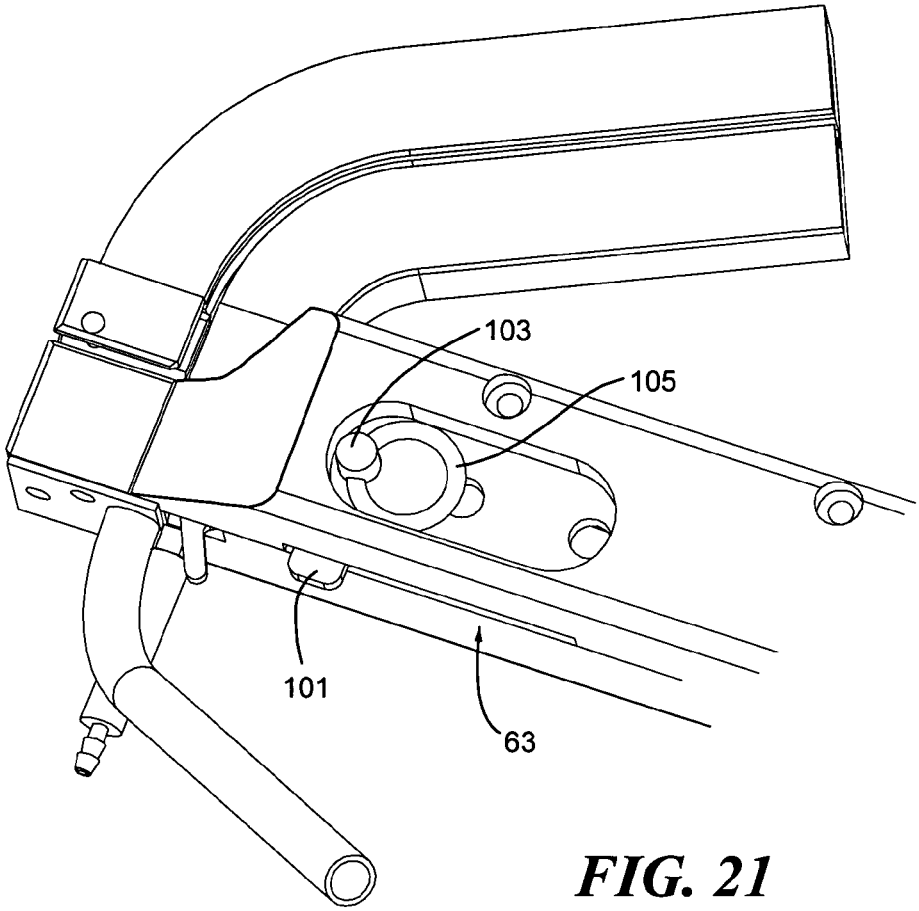
FIG. 21 is an enlarged, fragmentary, front perspective view of the tool shown in FIG. 17(*d*), the tool being shown with the needle removed therefrom.
Figure 22:
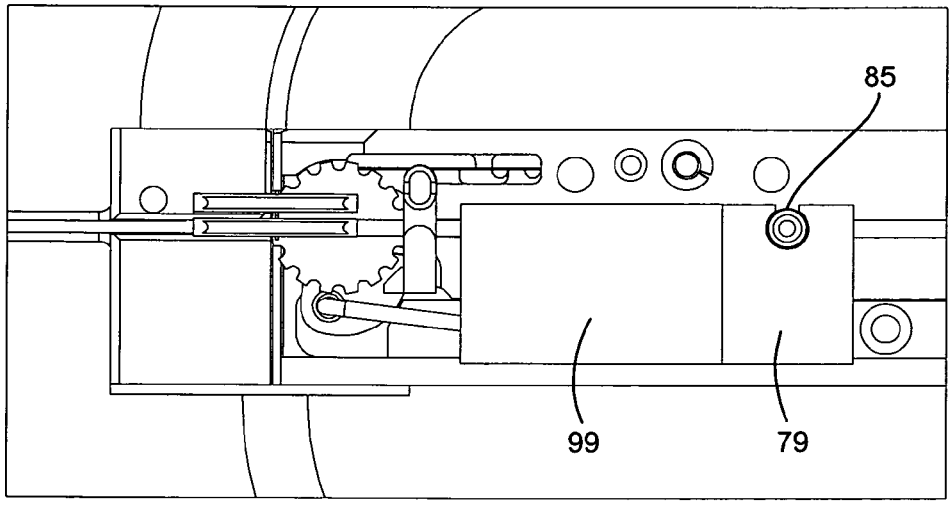
FIG. 22 is a an enlarged, front plan view of the tool shown in FIG. 17(*d*)

Stop 99 is in the form of a rectangular block which is slidably mounted within tool 61. As seen most clearly in FIG. 21, stop 99 includes a tab 101 which protrudes out through a slot in housing 63, thereby enabling stop 99 to be externally adjusted by the consumer to regulate the stroke length. A quick release pin 103 (shown in isolation in FIG. 20) is adapted to be removably disposed through one of a plurality of openings 105 formed in stop 99. With pin 103 disposed through an opening 105 in stop 99, pin 103 engages housing 63 to lock stop 99 in place. Pin 103 is provided with a ring 105 for handling purposes and a detent ball 107 which is outwardly biased by an internal spring to lock pin 103 in place within an opening 105 in stop 99.

The length of the forward stroke of tool 61 can be adjusted in the following manner. Specifically, pin 103 is withdrawn from stop 99, the withdrawal force being greater than the retention force provided by the internal spring which outwardly urges detent ball 107. With pin 103 withdrawn from stop 99, the consumer is able to slide stop 99 to a desired position using tab 101. With stop 99 positioned in its desired location, pin 103 is disposed through an opening 105 to lock stop 99 in place. It should be noted that the ability to regulate the length of the forward stroke of tool 61 is regarded as a novel feature of the present invention.

It should be noted that tool 61 is also provided with means for guiding a fastener clip into and through said tool in such a manner so that the fastener clip is continuously directed away from the mattress to be fastened, which is highly desirable. Specifically, as seen most clearly in FIG. 23, tool 61 is provided with a fastener guide assembly 109 for guiding a clip of fasteners 31 into tool 61 and a runner bar guide 111 for guiding the used runner bar 39 out from tool 61.

Figure 24:
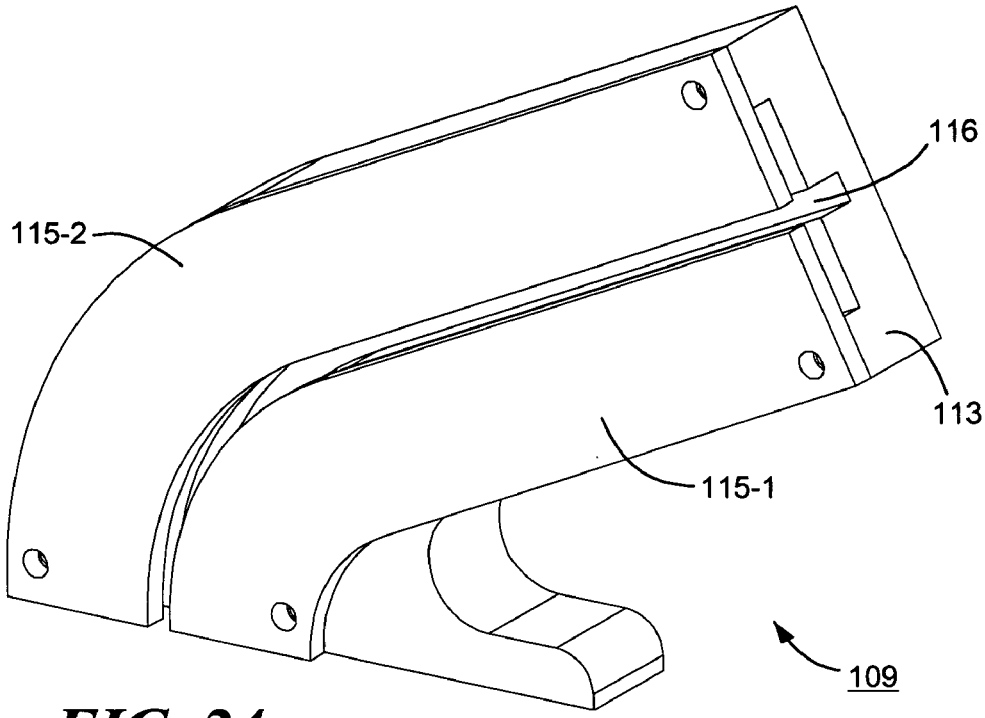
FIG. 24 is an enlarged, front perspective view of the fastener guide assembly shown in FIG. 23.
Figure 25:
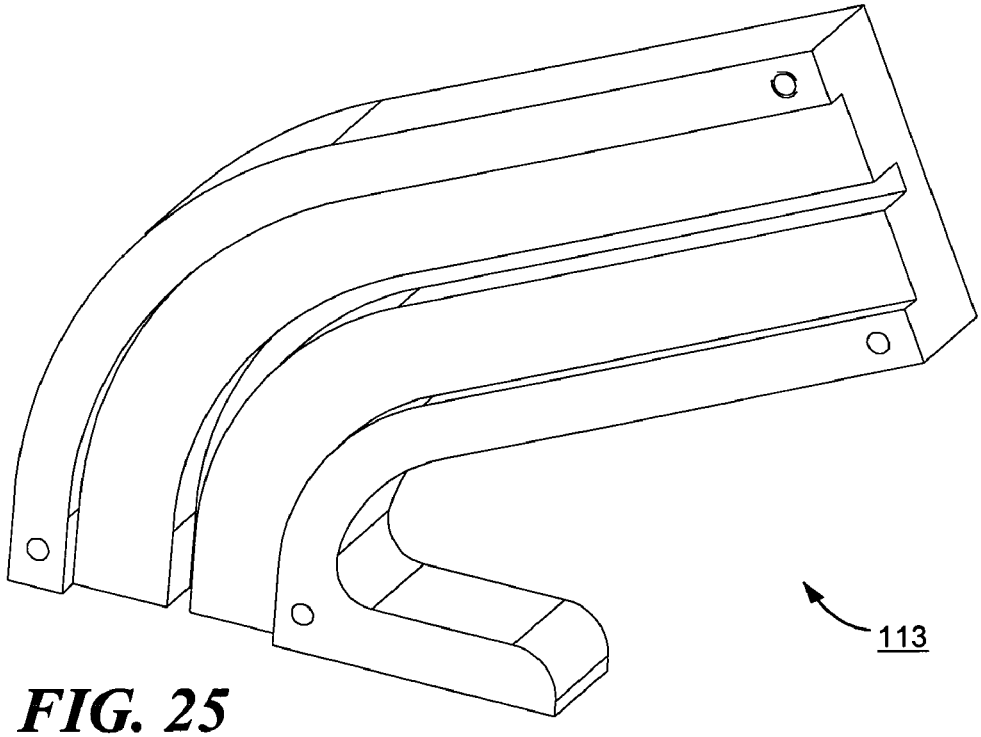
FIG. 25 is a front perspective view of the fastener guide shown in FIG. 24.
Figure 26:
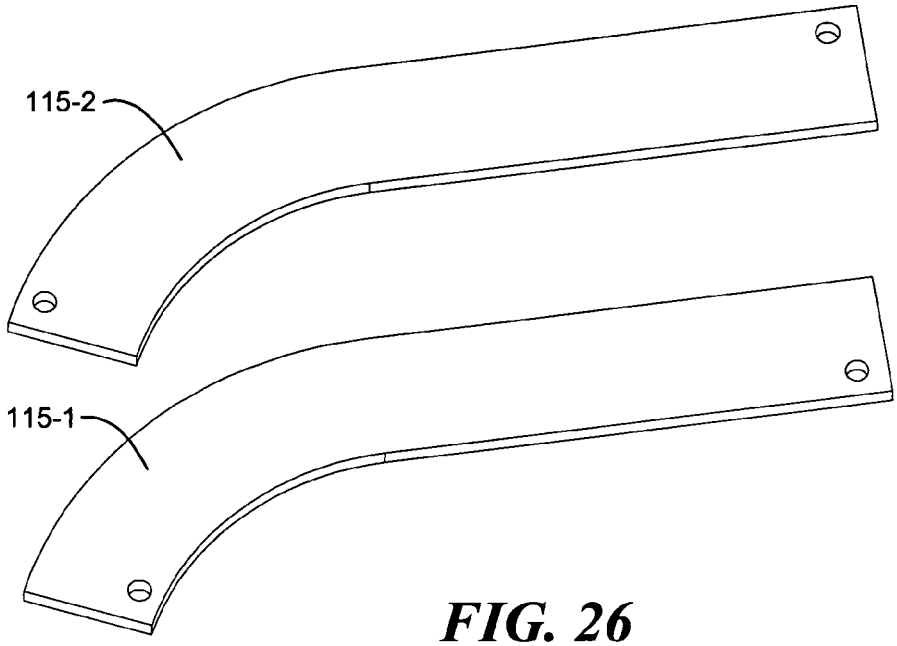
FIG. 26 is a front perspective view of the guide covers shown in FIG. 24.

Fastener guide assembly 109 (shown in isolation in FIG. 24) comprises a fastener guide 113 (shown in isolation in FIG. 25) and a pair of guide covers 115-1 and 115-2 (shown in isolation in FIG. 26) which together define a partially enclosed channel 116 for receiving runner bar 39, necks 41 and cross-members 35 of the fastener clip. It should be noted that fastener guide assembly 109 is provided with a curved construction in order to maintain the clip of fasteners 31 away from the item to be fastened (i.e., the mattress), which is highly desirable.

Figure 27:
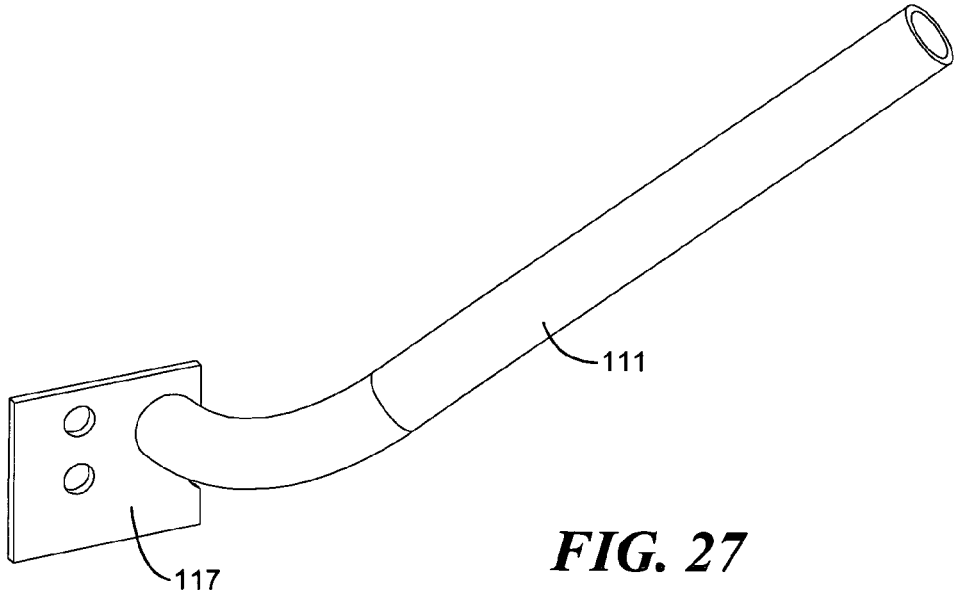
FIG. 27 is an enlarged, bottom, left end perspective view of the runner bar guide shown in FIG. 24.

Runner bar guide 111 (shown in isolation in FIG. 27) is in the form of an elongated, curved, tube which is fixedly secured onto nose 69 by a bracket 117. Runner bar guide 111 is sized and shaped to receive runner bar 39 after fastener 31 has been dispensed from the fastener clip. In this manner, the curved construction of guide 111 serves to direct a used runner bar 39 away from the item to be fastened (i.e., the mattress), which is highly desirable.

It should be noted that tool 61 is provided with a novel mechanism for indexing each individual fastener 31 in the clip in place behind needle 71 prior to the ejection process. In particular, it should be noted that the indexing mechanism for tool 61 is pneumatically driven independently of how tool 61 pneumatically drives its ejection mechanism.

Figure 16:
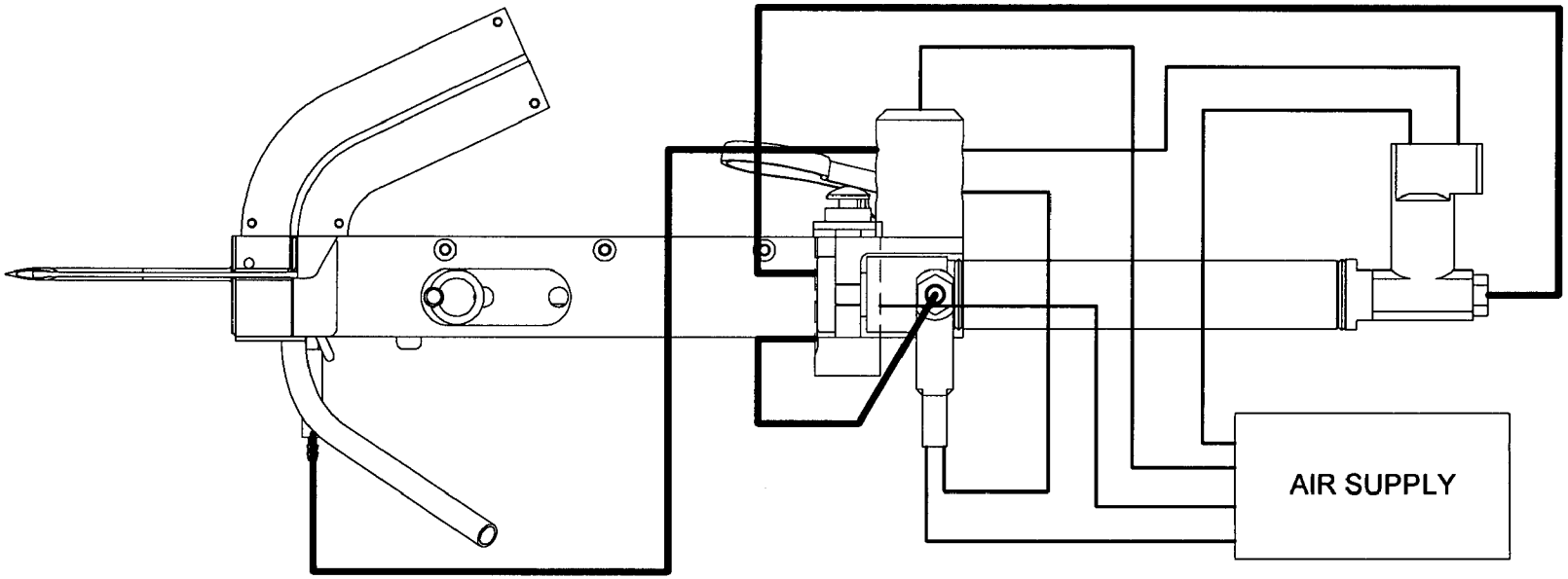
FIG. 16 is a schematic representation of the pneumatic connections for the tool shown in FIG. 4(*a*)
Figure 17A:
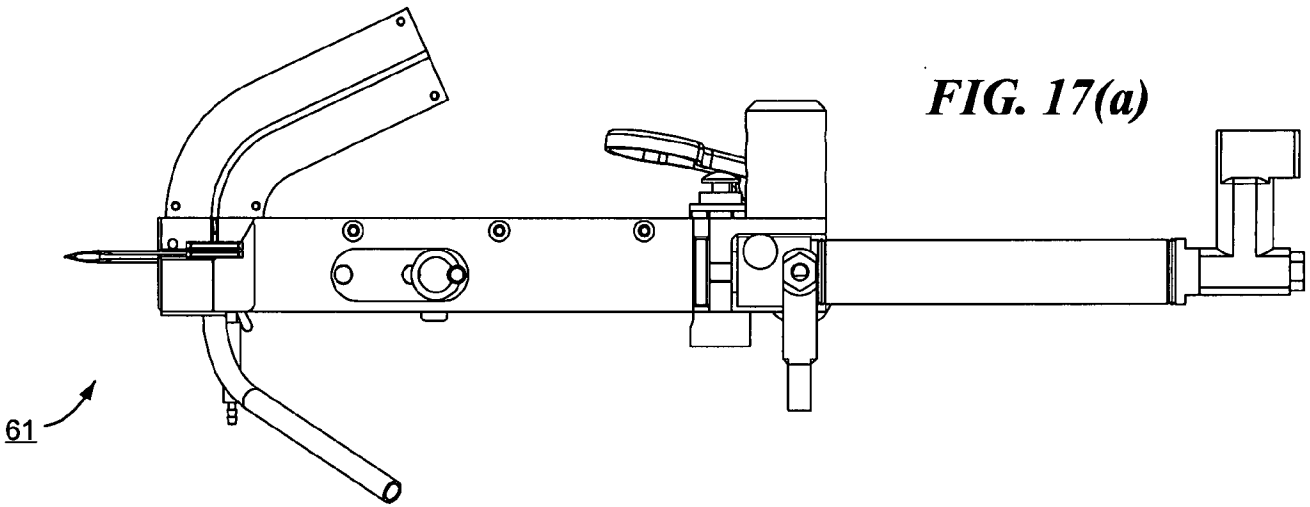
FIGS. 17(*a*)–(*d*) are front plan views of the tool shown in FIG. 4(*a*), the tool being shown with needles of varying lengths and with the stop disposed in varying positions.
Figure 17B:
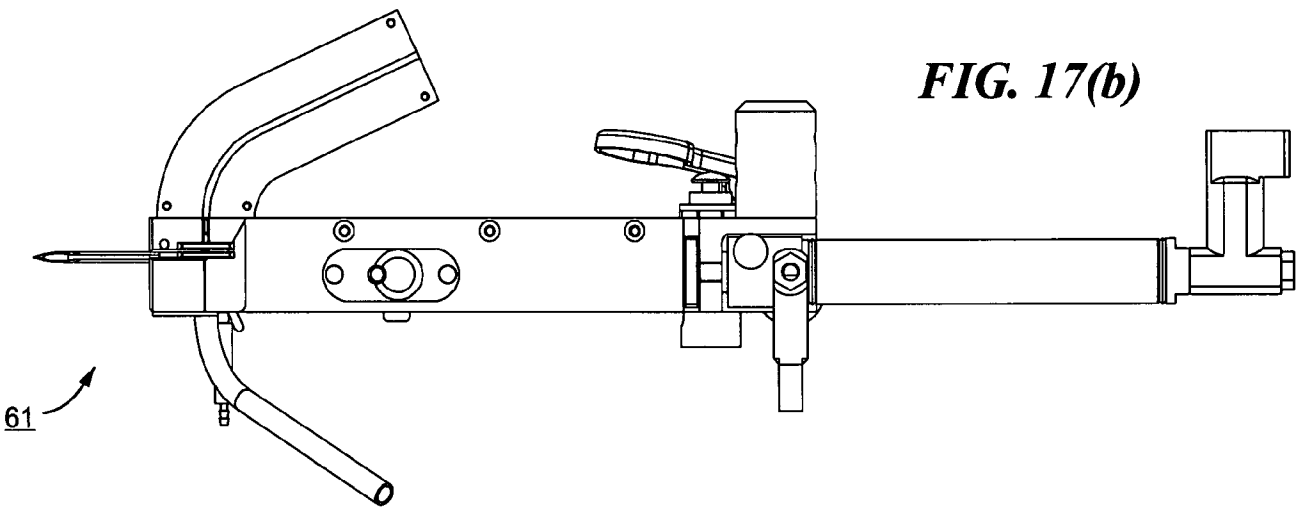
Figure 17C:
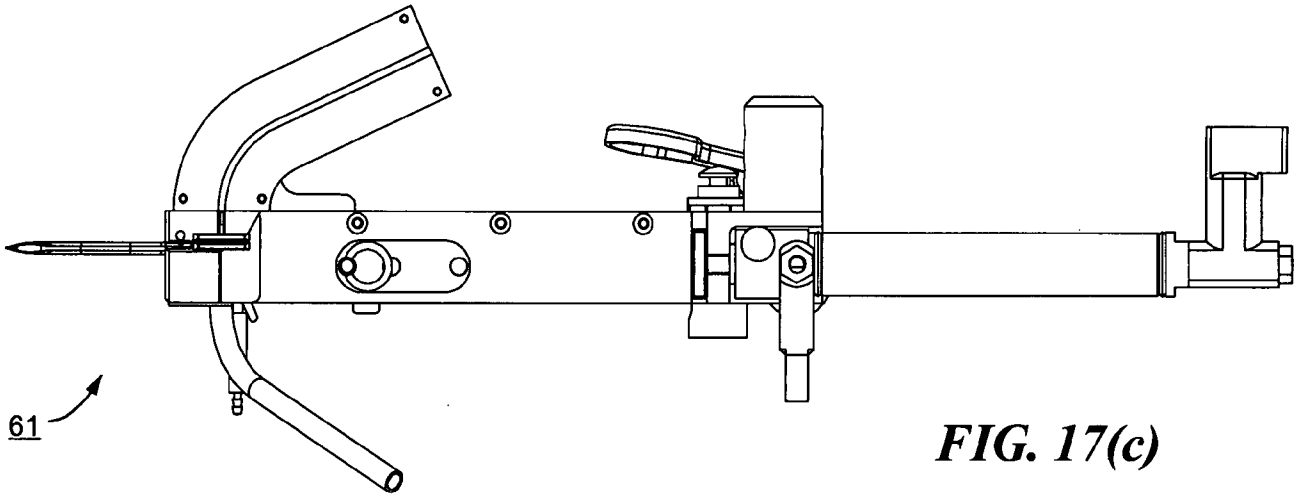
Figure 17D:
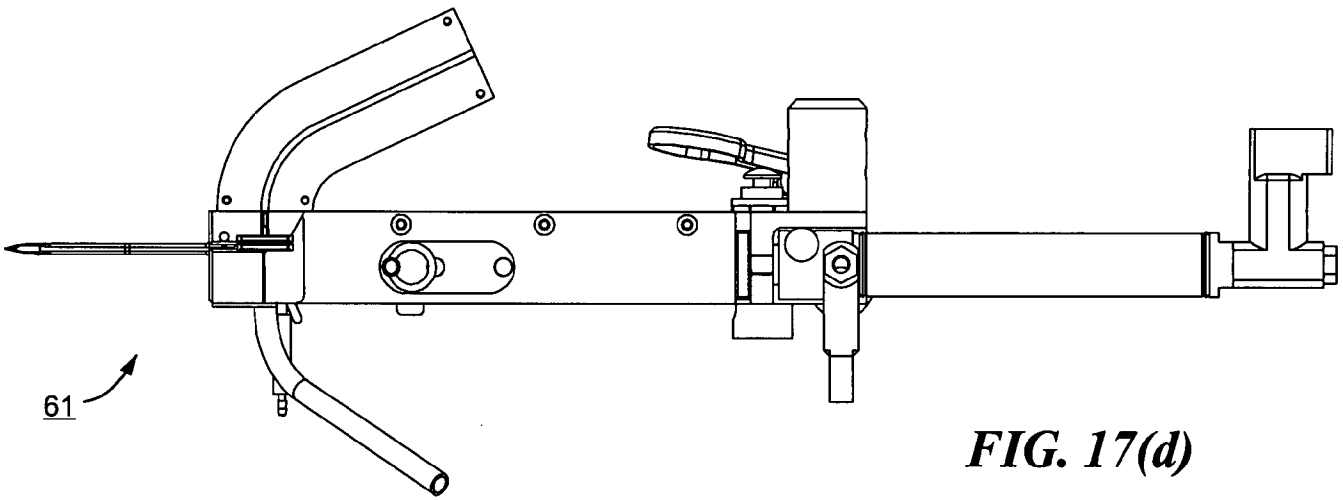
Figure 18A:
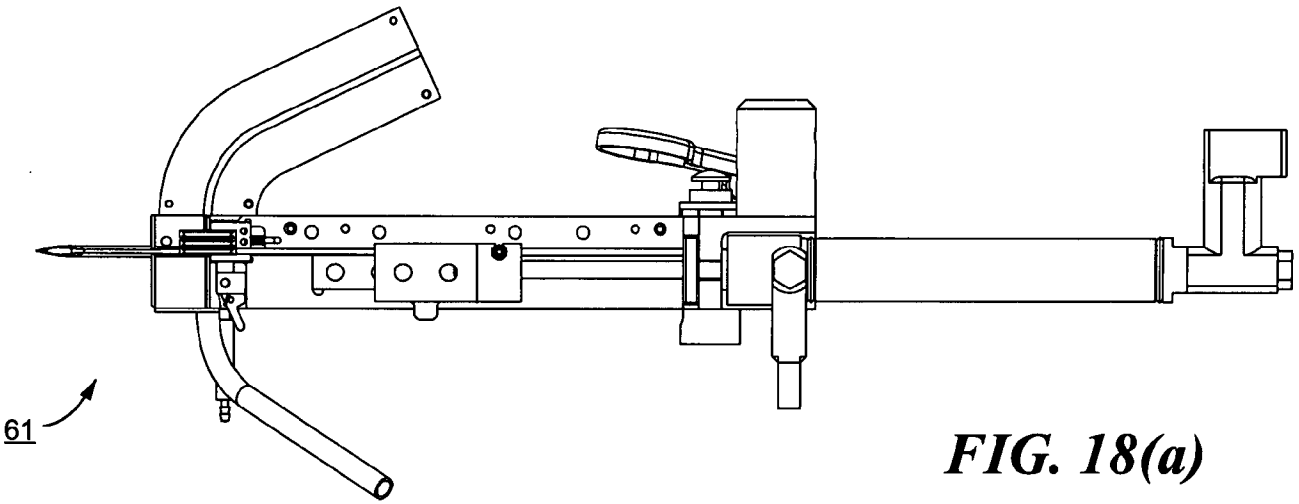
FIGS. 18(*a*)–(*d*) are front plan views of the tool shown in FIG. 4(*a*), the tool being with the left side casing removed, the tool being shown with needles of varying lengths and with the stop disposed in varying positions.
Figure 18B:
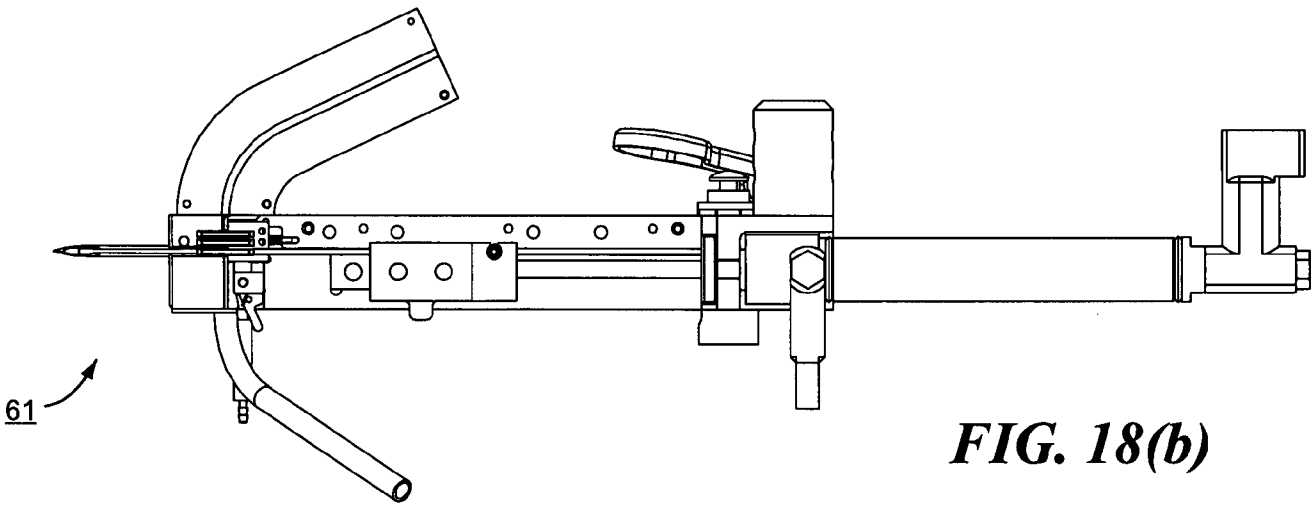
Figure 18C:
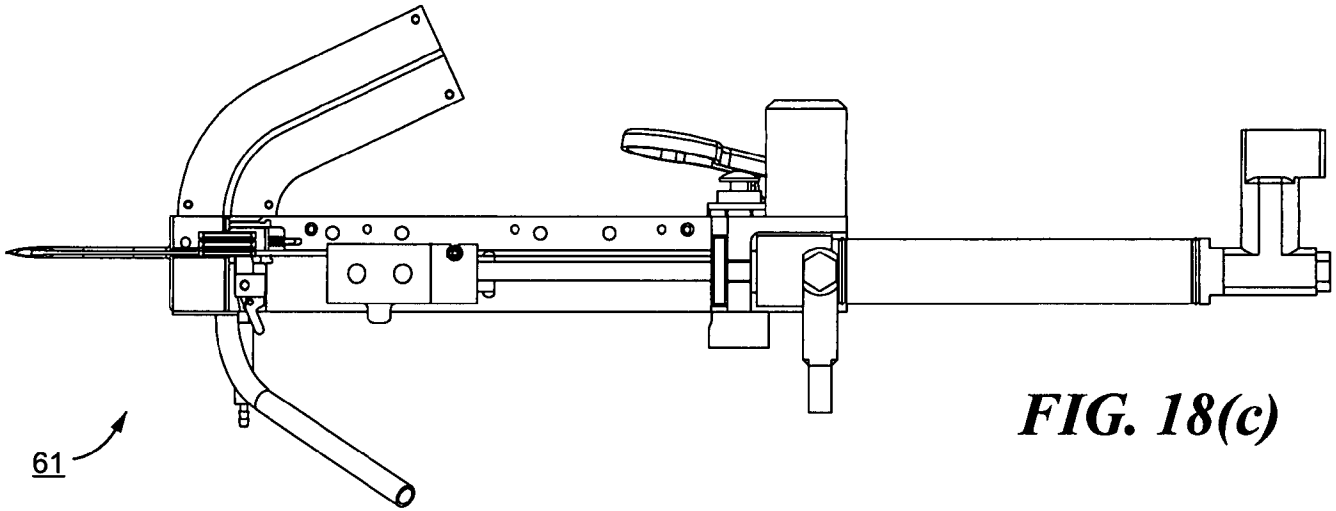
Figure 18D:
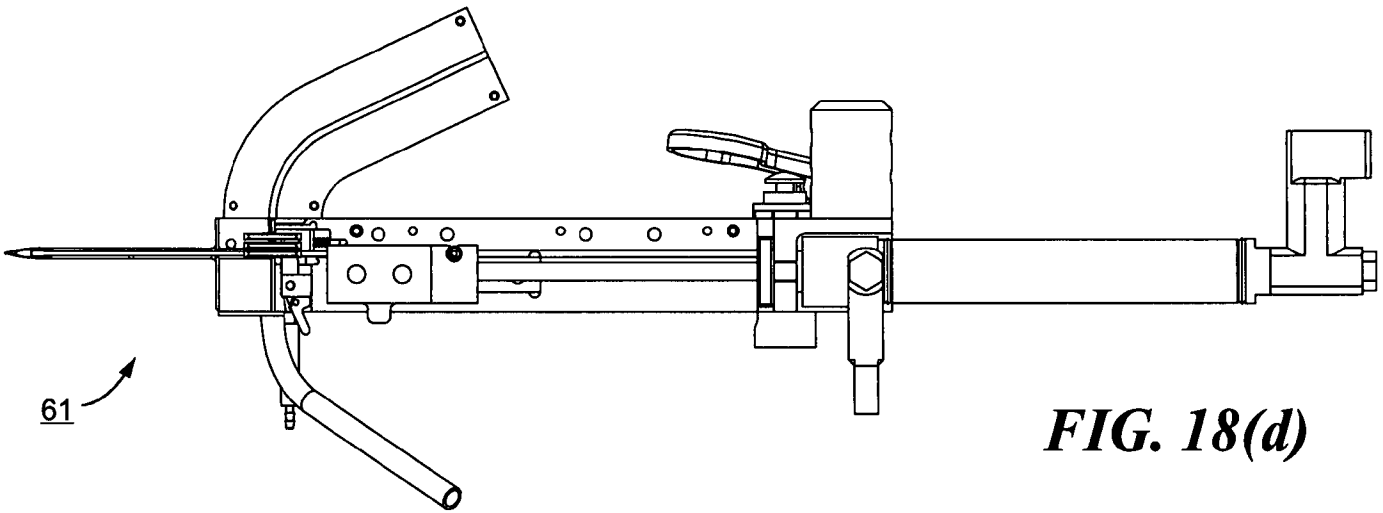
Figure 28:
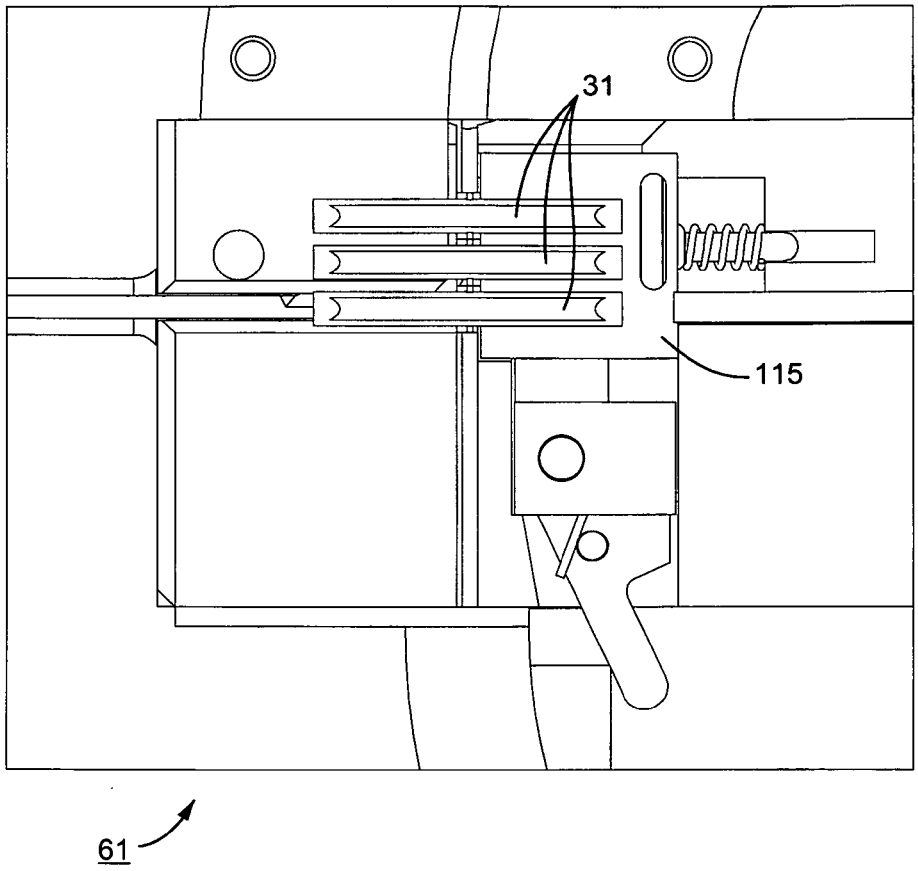
FIG. 28 is an enlarged, front plan view of the tool shown in FIG. 4(*a*), said tool being shown with a clip of fasteners inserted therein, said tool being shown with its left side casing removed therefrom.
Figure 29:
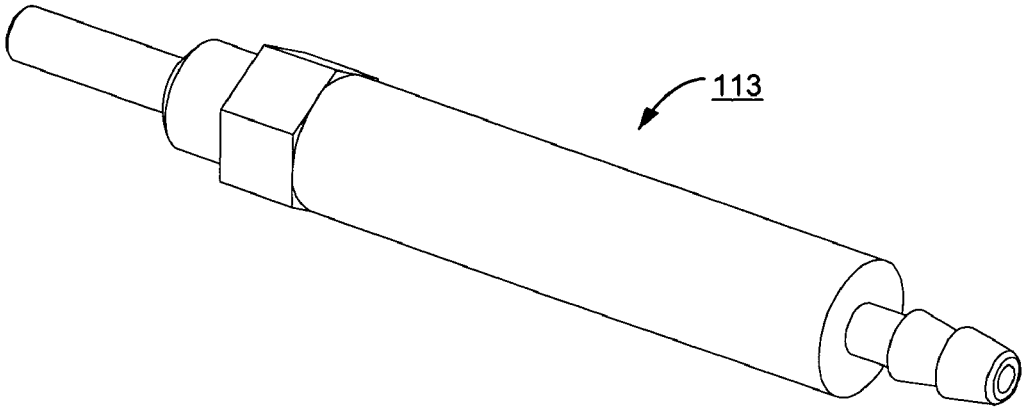
FIG. 29 is an enlarged, front, left end perspective view of the pneumatic feed cylinder shown in FIG. 4(*a*)

Specifically, referring now to FIG. 28, there is shown an enlarged front plan view of tool 61, tool 61 being shown with a clip of fasteners 31 feed thereinto and with left side casing 67 removed therefrom. A pneumatic feed cylinder 113 (shown in isolation in FIG. 29) drives the operation of the indexing mechanism. It should be noted that feed cylinder 113 is independently coupled to valve 95 by tubing (as shown in FIG. 16). Because indexing mechanism is powered independently of the ejection mechanism, tool 61 operates in a more reliable and durable manner, which is highly desirable.

Figure 30:
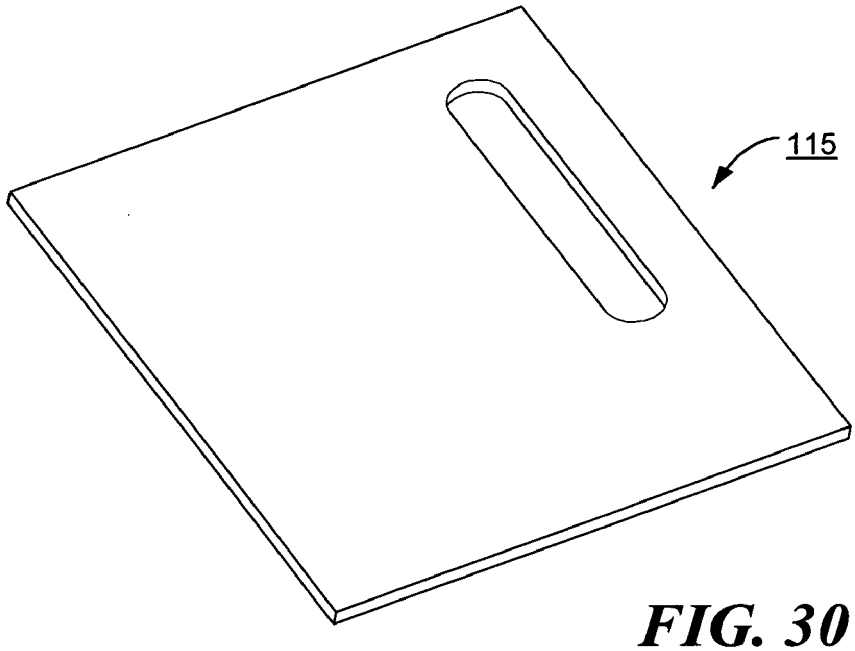
FIG. 30 is an enlarged, front perspective view of the feed cover plate shown in FIG. 28.
Figure 31A:
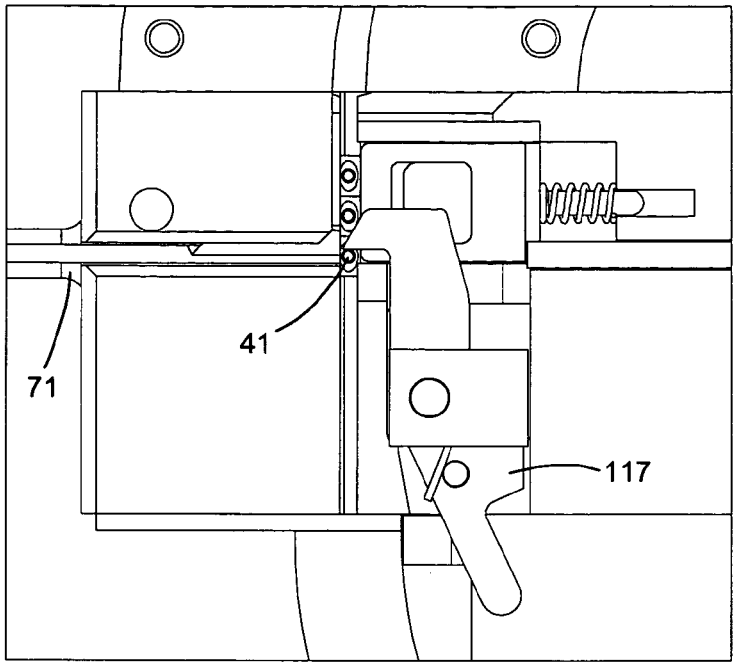
FIGS. 31(*a*)–(*e*) are enlarged, front plan views of the tool shown in FIG. 28 at various stages during the process of indexing a fastener into position for ejection, said tool being shown with its left side casing and feed cover plate removed therefrom.
Figure 31B:
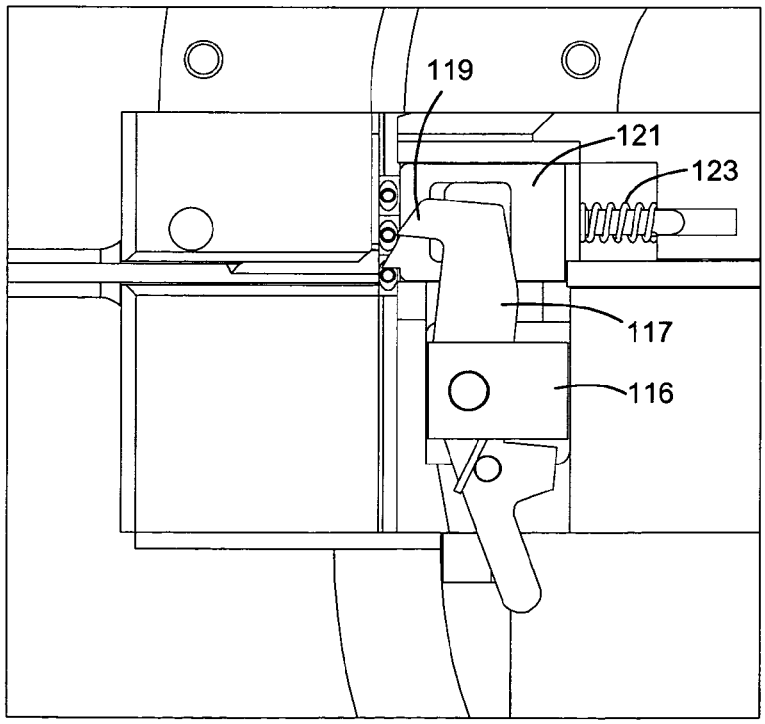
Figure 31C:
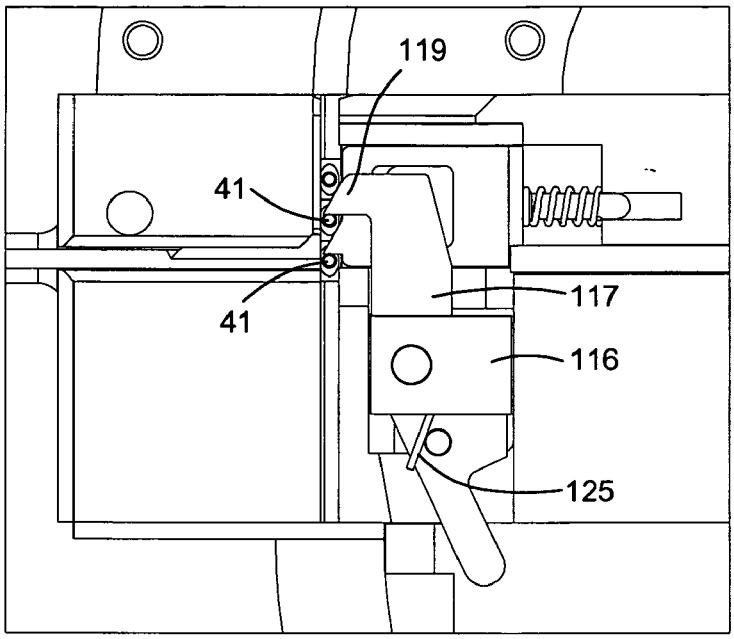
Figure 31D:
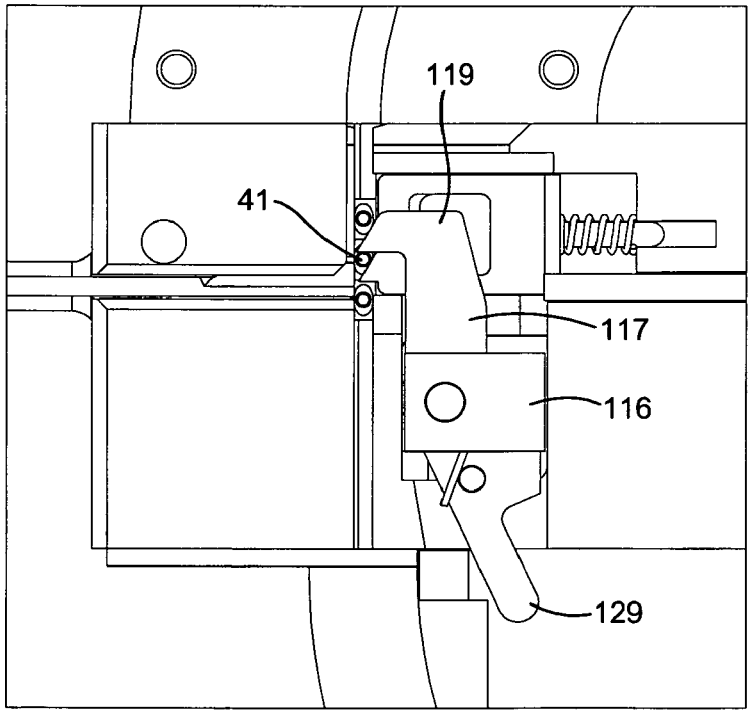
Figure 31E:
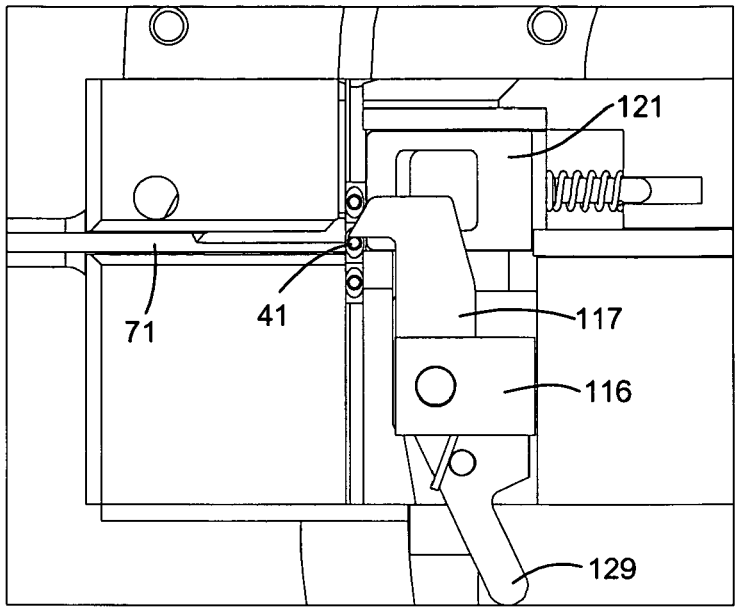
Figure 33B:
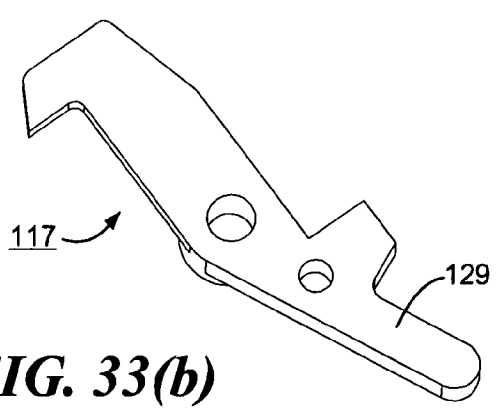
FIG. 33(*a*) is an enlarged, rear perspective view of the feed pawl shown in FIG. 28.
Figure 35:
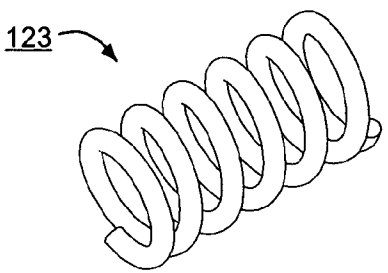
FIG. 35 is an enlarged, front perspective view of the spring shown in FIG. 28.
Figure 33A:
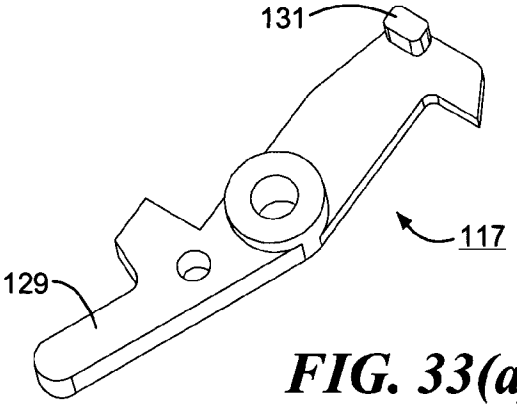
Figure 34:
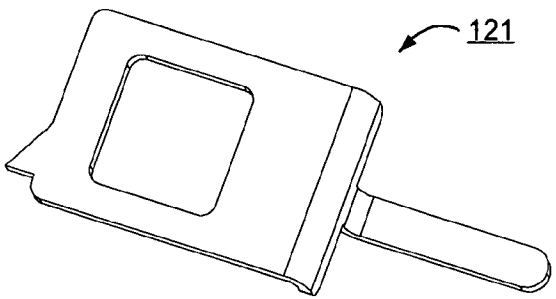
FIG. 34 is an enlarged, front perspective view of the detent shown in FIG. 28.
Figure 37A:
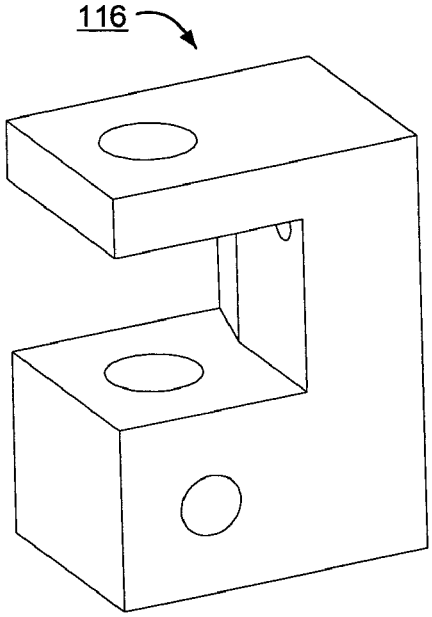
FIG. 37(*a*) is an enlarged, bottom, left end perspective view of the feed slide shown in FIG. 28.
Figure 37B:
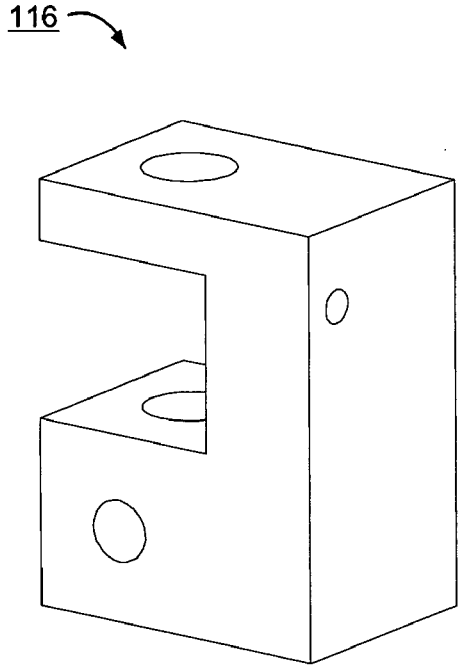
Figure 38A:
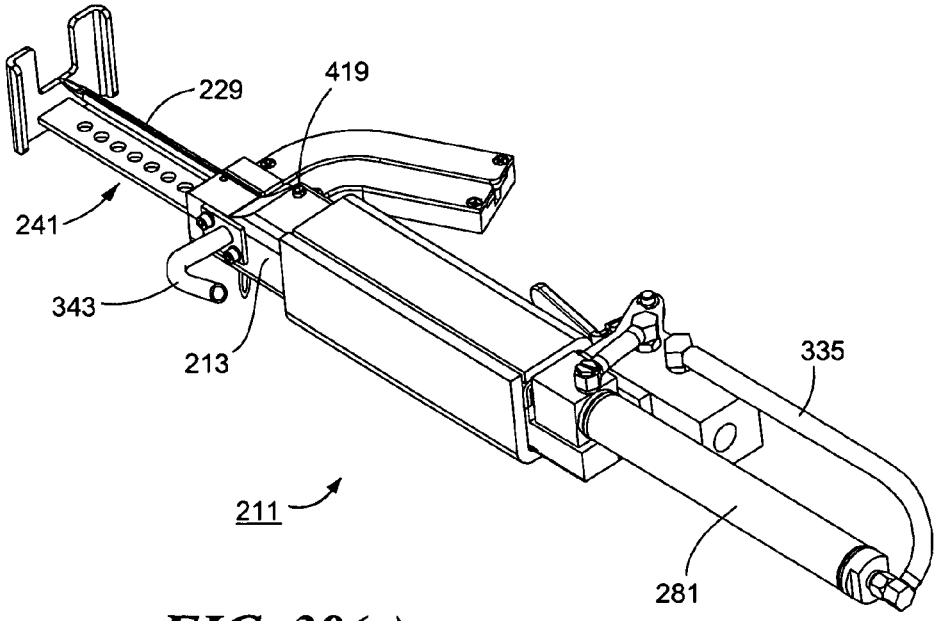
FIGS. 38(*a*)–(*e*) is a front, bottom perspective view of a second embodiment of a tool for dispensing a plastic fastener through one or more layers of a mattress, said tool being constructed according to the teachings of the present invention.
Figure 38B:
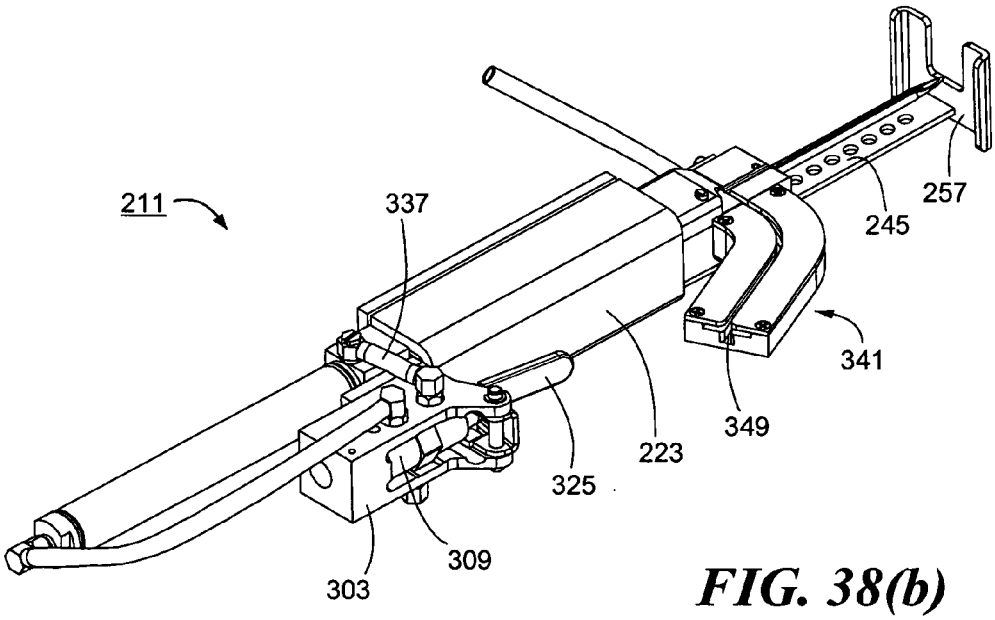
Figure 38C:
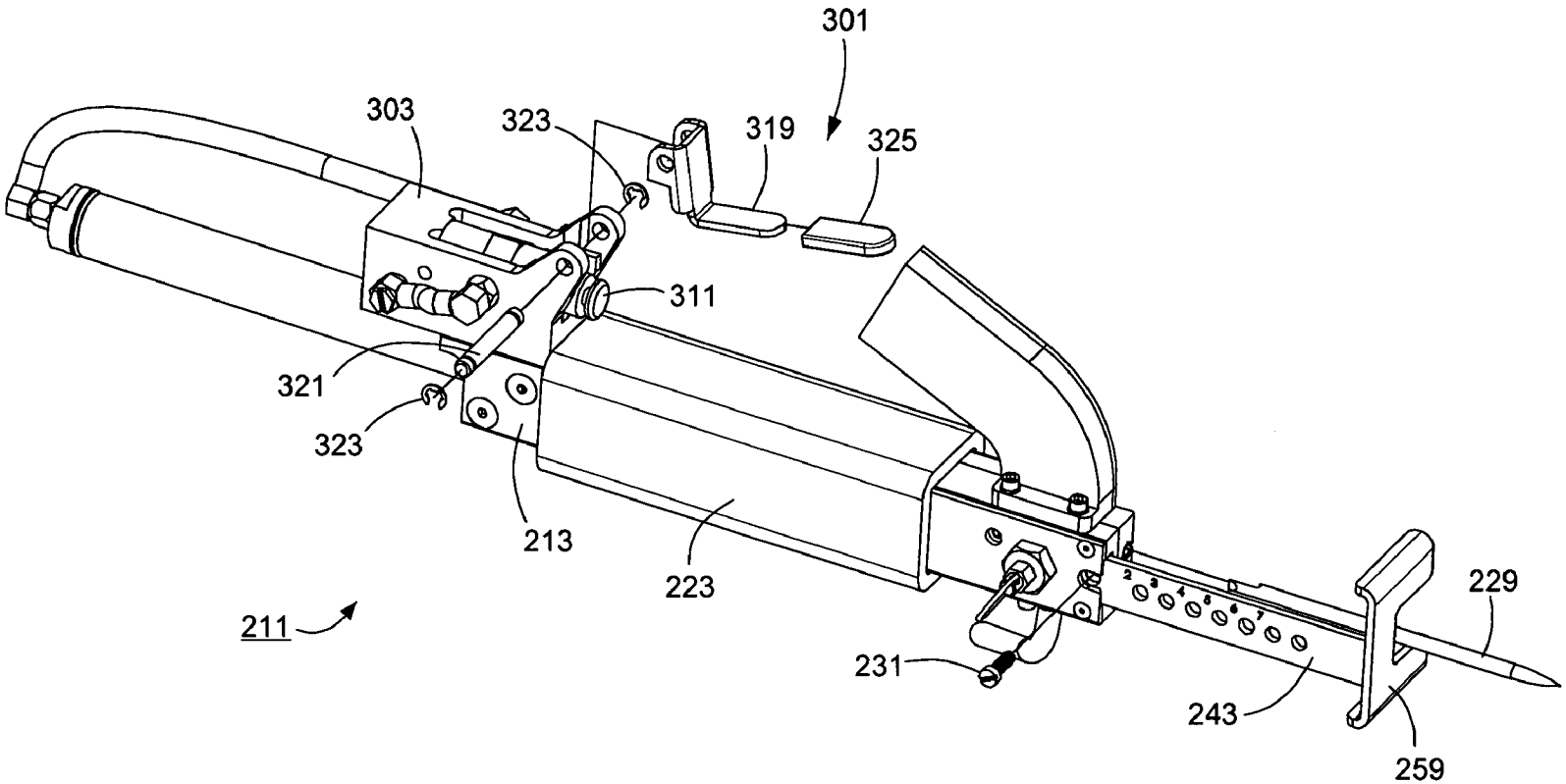
Figure 38D:
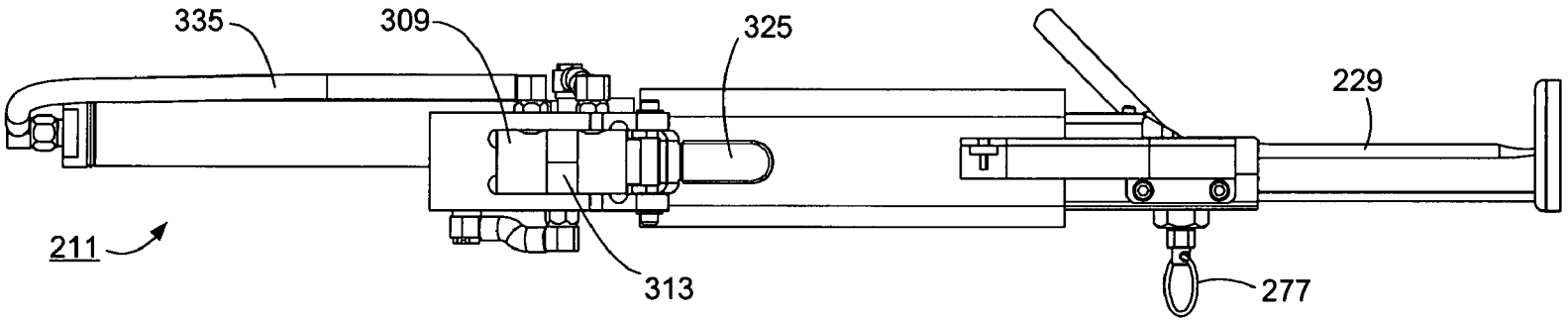
Figure 38E:
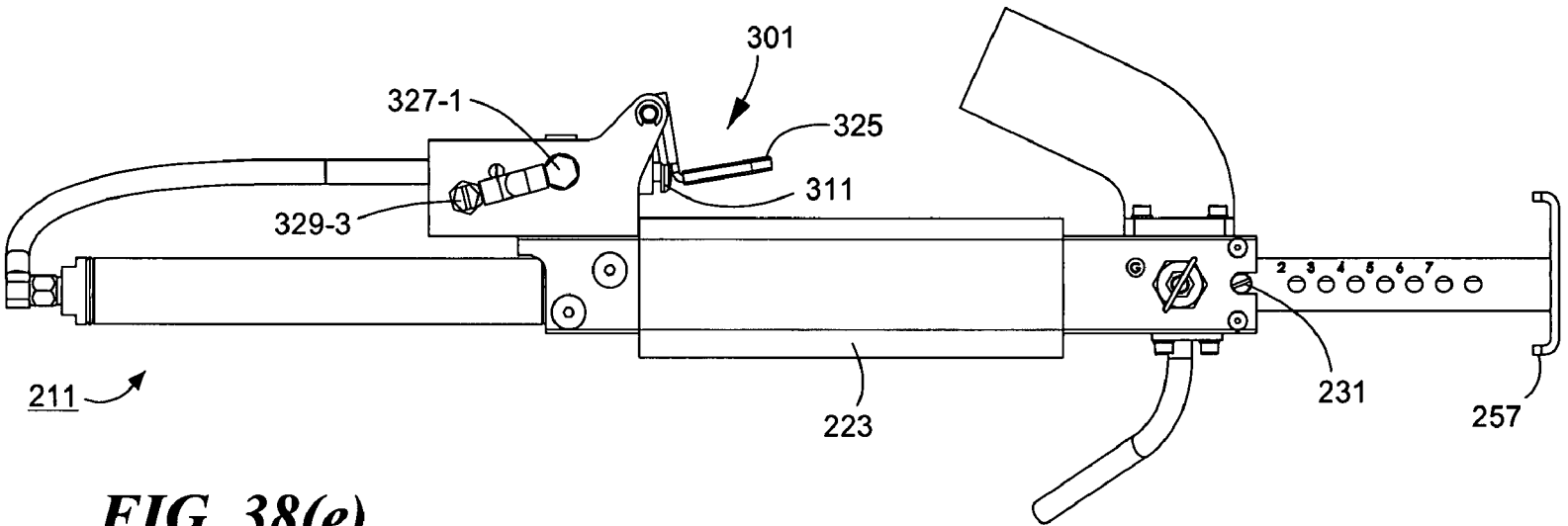

Components of indexing mechanism are protected by a feed cover plate 115 (shown in isolation in FIG. 30). With feed cover plate 115 removed (as in FIGS. 31(*a*)–(*e*)), operation of the indexing mechanism for tool 61 is more apparent. Initially, the indexing mechanism orientates cross-bar 35 of the lowermost fastener 31 in the fastener clip into direct axial alignment with the longitudinal bore of needle 71, as seen most clearly in FIG. 31(*a*). Once the lowermost fastener 31 is dispensed, indexing mechanism feeds the next fastener 31 in the fastener clip into position behind needle 71. As seen most clearly in FIG. 31(*b*), the depression of finger switch assembly 93 pneumatically drives a feed slide 116 (shown in isolation in FIGS. 37(*a*) and (*b*)) in the upward direction, feed slide 116 being slidably mounted within nose 69 of tool 61. A feed pawl 117 (shown in isolation in FIGS. 33(*a*) and (*b*)) is pivotally coupled to feed slide 116 by a pin. Accordingly, as feed slide 116 is pneumatically driven upward, in turn, feed pawl 117 slides upward. It should be noted that, because feed pawl 117 is pivotally mounted, a ratchet-shaped finger 119 formed onto one end of feed pawl 117 slides slightly in the clockwise direction and along the severable neck 41 of the next successive fastener 31. With feed pawl 117 advancing upward, a detent 121 (shown in isolation in FIG. 34), which is naturally biased in the forward direction by a detent spring 123 (shown in isolation in FIG. 35), remains in engagement with the neck 41 of the recently dispensed fastener 31. In this manner, detent 121 acts to retain the fastener clip in the same position as feed pawl 117 is driven upward.

Figure 36:
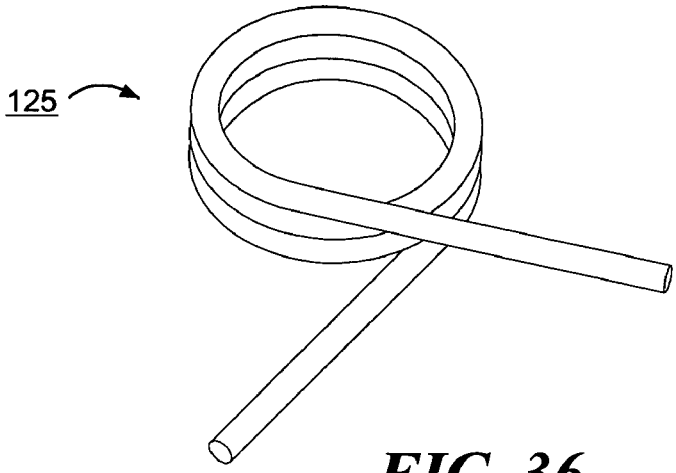
FIG. 36 is an enlarged, front perspective view of the torsion spring shown in FIG. 28.

As seen in FIG. 31(*c*), once finger 119 of feed pawl 117 is disposed above the next successive neck 41 in the fastener clip, a torsion spring 125 (shown in isolation in FIG. 36), which is coupled at one end to feed slide 116 and which is coupled at the other end to feed pawl 117, is responsible for pivoting finger 119 of feed pawl 117 counterclockwise until finger 119 engages the next successive neck 41. As seen in FIG. 31(*d*), the release of finger switch assembly 93 releases air supplied into feed slide 116. As a result of the release of air pressure, feed slide 116 slides in the downward direction which, in turn, causes feed pawl 117 to pull the entire clip of fastener stock downward. In fact, feed pawl 117 pulls the entire clip of fastener stock downward until cross-bar 35 of the next successive fastener 31 in the fastener clip is axially aligned behind needle 71, as shown in FIG. 31(*e*), with detent 121 sliding above the neck 41 of the second successive fastener 31 in the fastener clip.

Figure 32:
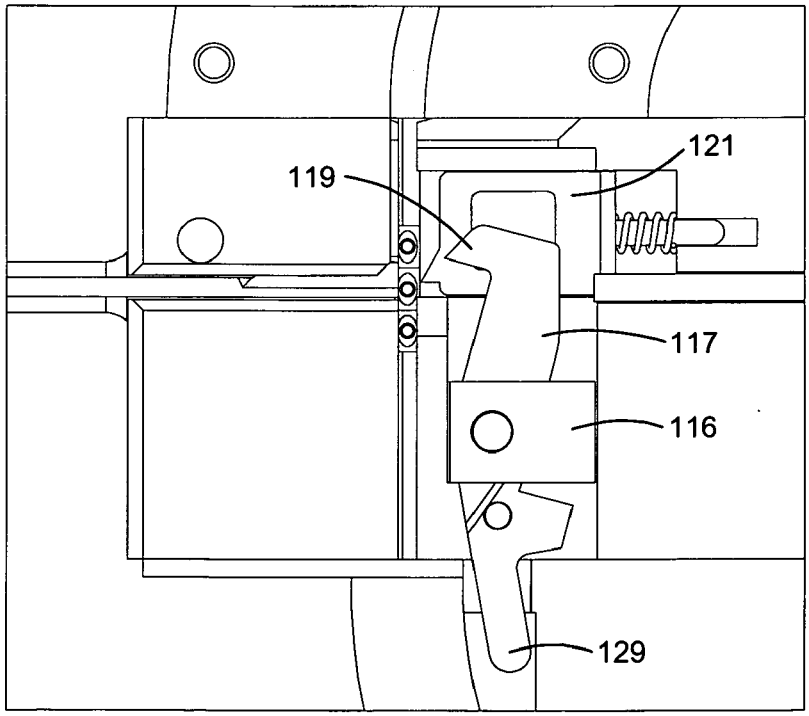
FIG. 32 is an enlarged, front plan view of the tool shown in FIG. 28 during the manual release of said indexing mechanism from the fastener clip, said tool being shown with its left side casing and feed cover plate removed therefrom.

It should be noted that feed pawl 117 is provided with an externally accessible lever 129. As seen most clearly in FIG. 32, the application of a manual force onto lever 129 in the clockwise direction (said force being greater than the counter force of torsion spring 125) causes feed pawl 117 to rotate in the clockwise direction. The rotation of feed pawl 117 in the clockwise direction causes finger 119 to disengage from the fastener clip. Furthermore, the rotation of feed pawl 117 causes a projection 131 (seen most clearly in FIG. 33(*a*)) to urge detent 121 backwards and out of engagement with the clip of fasteners 31. With feed pawl 117 and detent 121 disengaged from the clip, the user is able to manually withdraw the clip of fasteners 31 from tool 61, if desired.

It is to be understood that tool 61 could be modified without departing from the spirit of the present invention. In particular, it is to be understood that tool 61 could be modified so as to render it more simple in its construction and use. Specifically, referring now to FIGS. 38(*a*)–(*e*), there are shown various views of a second embodiment of a tool for use in dispensing one or more plastic fasteners, said tool being constructed according to the teachings of the present invention and identified generally by reference numeral 211. As will be described further below, tool 211 is similar to tool 61 in that tool 211 is designed principally for use in installing heavy-duty plastic fasteners, such as fastener 31, through multiple layers of a mattress, such as mattress 11. However, as will become apparent below, tool 211 is far simpler in its design and operation than tool 61.

Tool 211 is an air compression powered fastener dispensing tool. Preferably, tool 211 is derived from an $SPU_4M$ model, extra heavy duty T-end fastener dispensing tool of the type manufactured and sold by Avery Dennison Corporation of Pasadena, Calif. which has been modified in a number of ways, as will be described in detail herein.

Figure 40A:
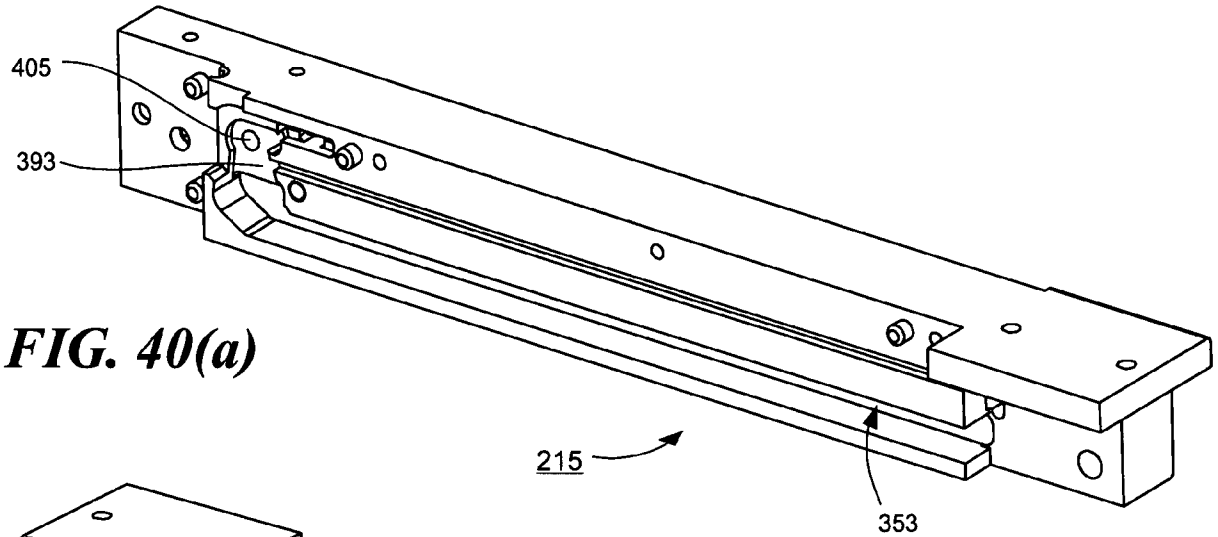
FIGS. 40(*a*)–(*b*) are front, top perspective and rear, top perspective views, respectively, of the right side casing of the tool shown in FIG. 38(*a*)
Figure 40B:
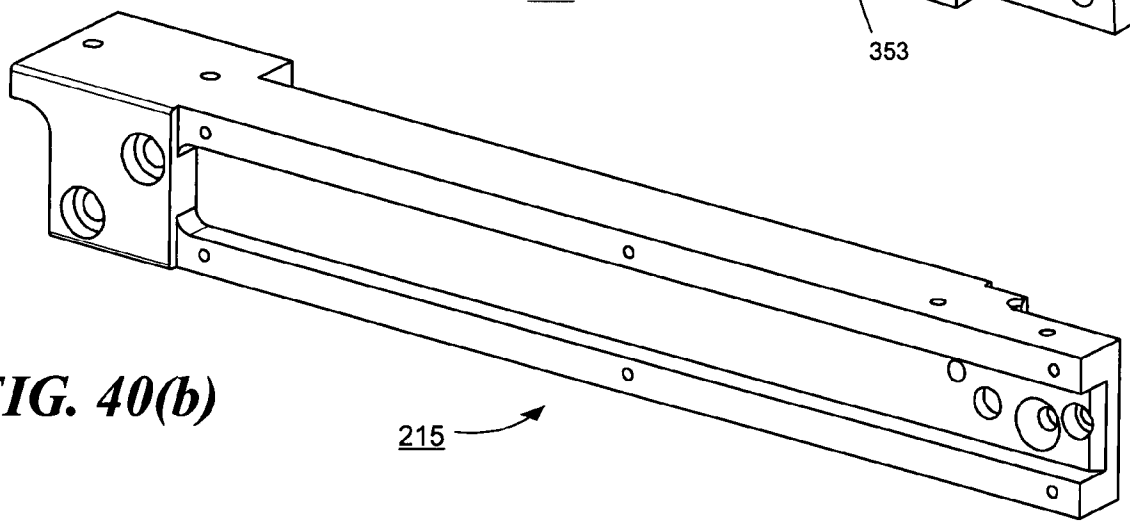
Figure 41A:
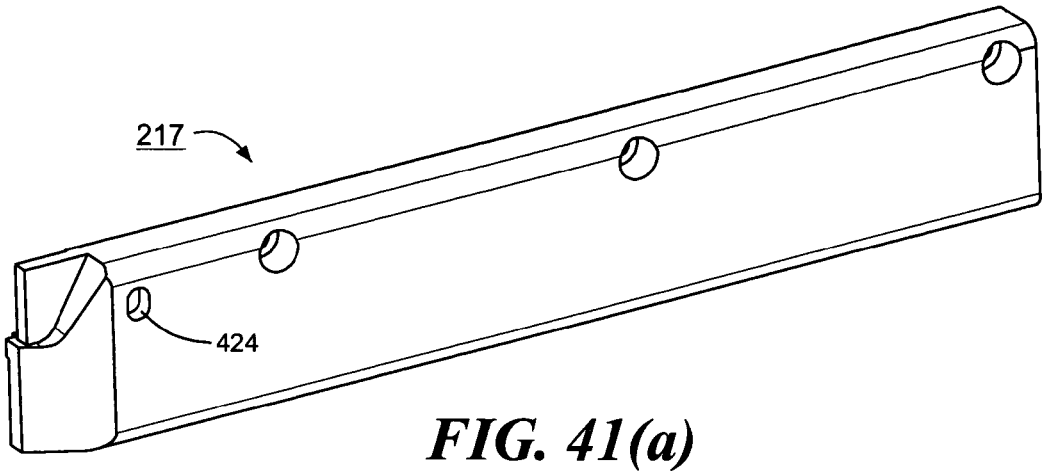
FIGS. 41(*a*)–(*b*) are front, top perspective and rear, top perspective views, respectively, of the left side casing of the tool shown in FIG. 38(*a*)
Figure 41B:
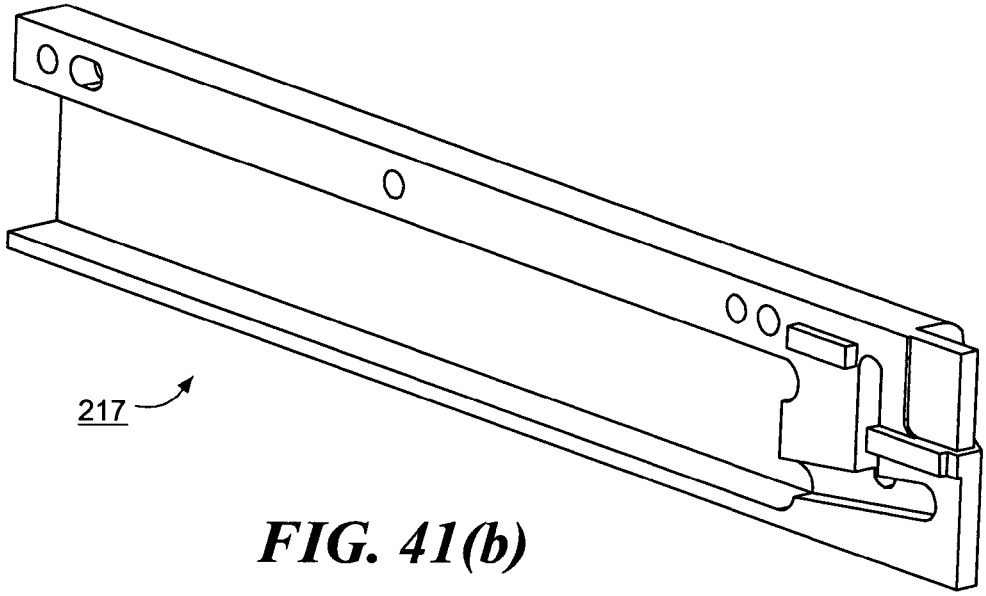
Figure 42:
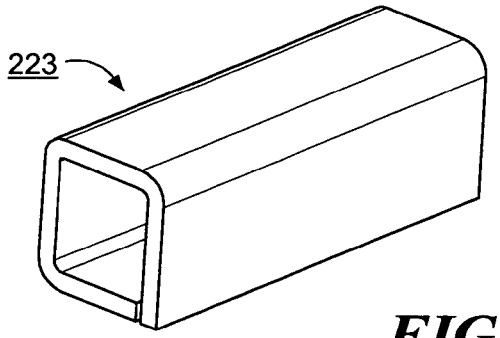
FIG. 42 is an enlarged rear, bottom perspective view of the handle shown in FIG. 38(*a*)
Figure 43A:
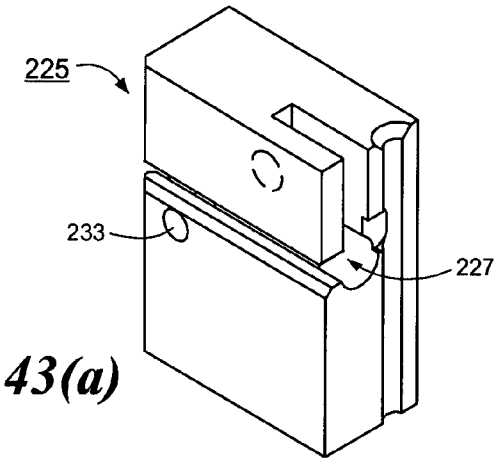
FIGS. 43(*a*)–(*e*) are perspective, top plan, front plan, right end plan and back plan views, respectively, of the nose of the tool shown in FIG. 39.
Figure 43B:
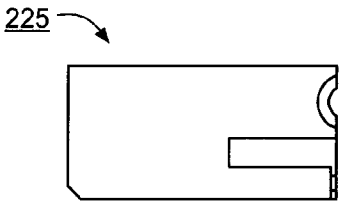
Figure 43C:
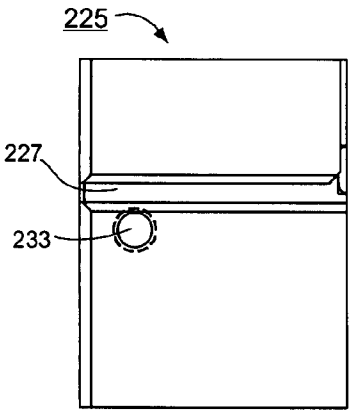
Figure 43D:
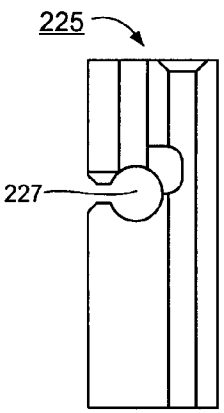
Figure 43E:
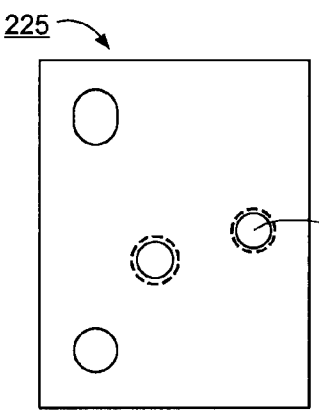

Tool 211 comprises a protective housing 213 which is constructed of a rigid and durable material. As seen most clearly in FIG. 39, housing 213 comprises a right side casing 215 (shown in isolation in FIGS. 40(*a*) and 40(*b*)) and a left side casing 217 (shown in isolation in FIGS. 41(*a*) and 40(*b*)) which are secured together using the combination of a lock washer 219 and a cap screw 221 at one or more locations. As seen most clearly in FIGS. 38(*a*)–(*e*), a four-sided handle 223 (shown in isolation in FIG. 42) constructed of a soft material, such as foam rubber, is wrapped around a portion of right and left side casings 215 and 217 and is held in place by any conventional means (e.g., through the use of hook and pile type fasteners). In this manner, handle 223 facilitates in the gripping of hand-operated tool 211, which is highly desirable.

Figure 39:
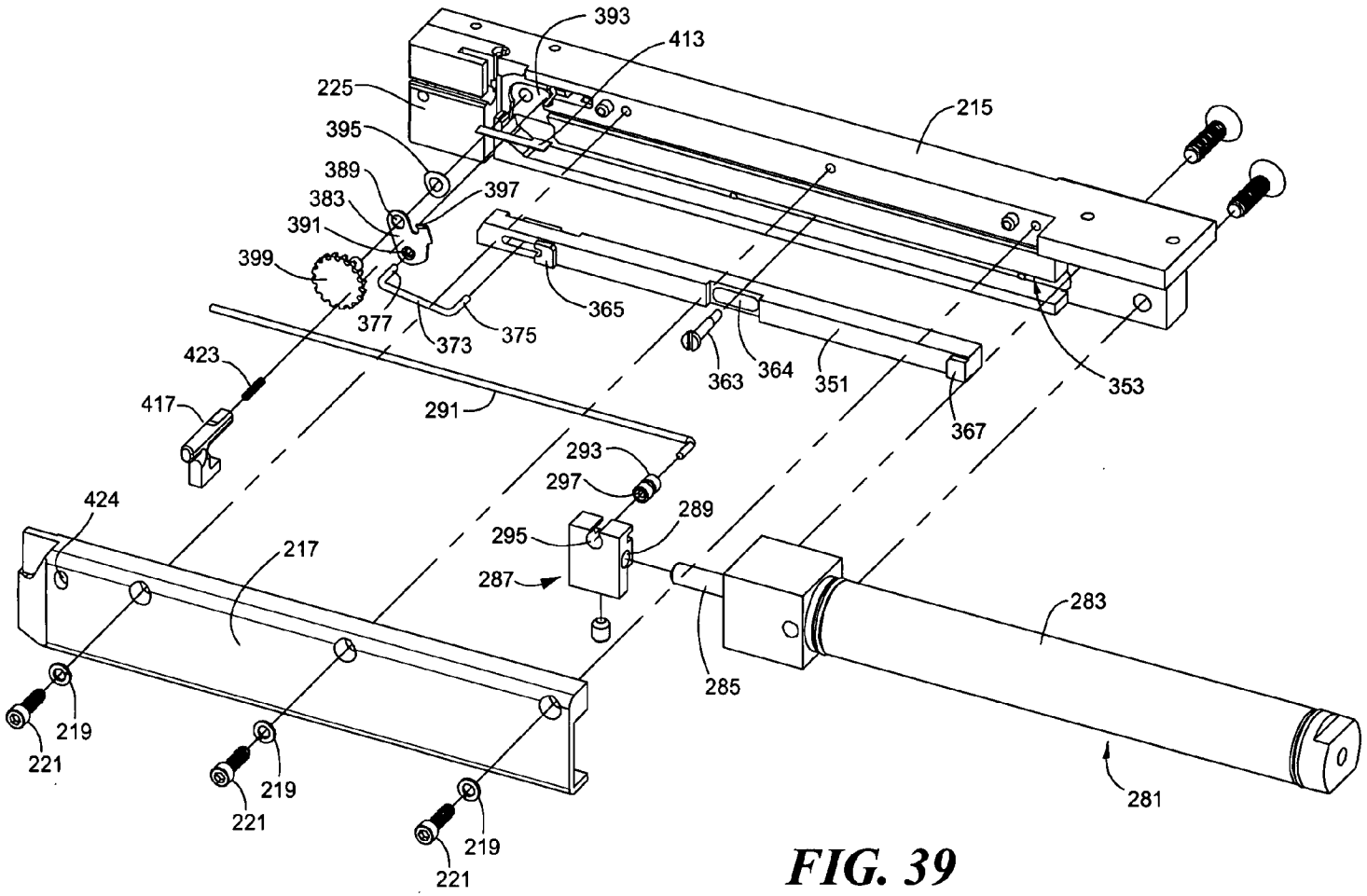
FIG. 39 is an exploded, front, top perspective view of selected components of the tool shown in FIG. 38(*a*)
Figure 44A:
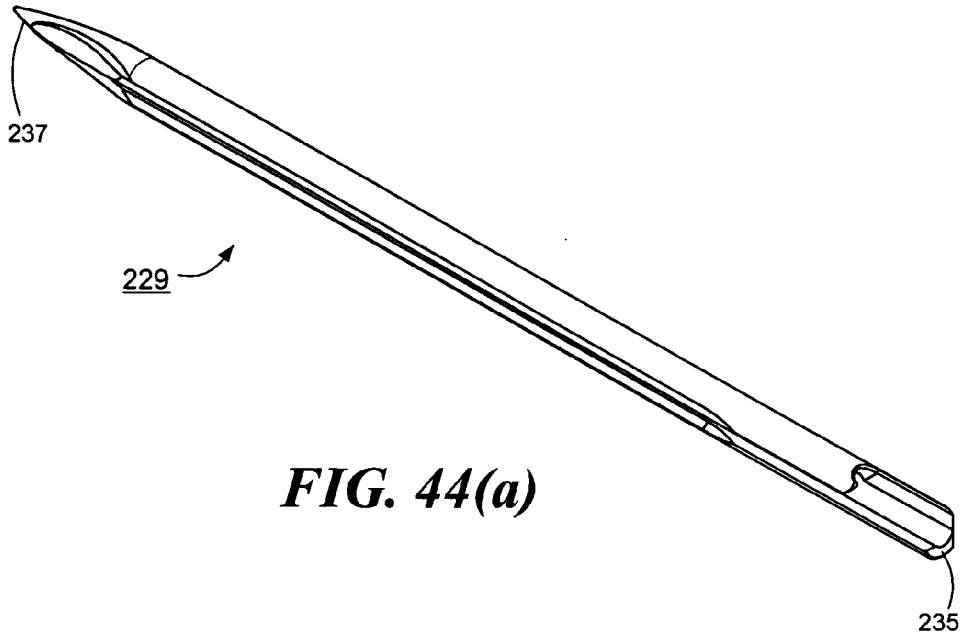
FIGS. 44(*a*)–(*c*) are perspective, top plan and front plan views, respectively, of the needle shown in FIG. 38(*a*)
Figure 44B:
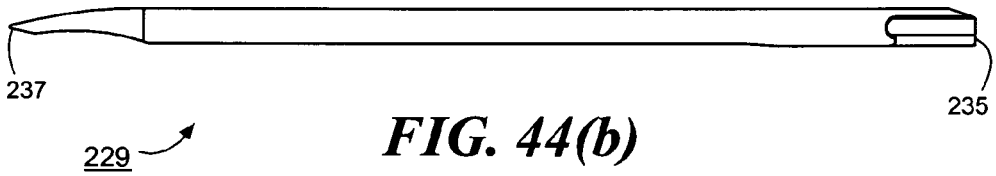
Figure 44C:
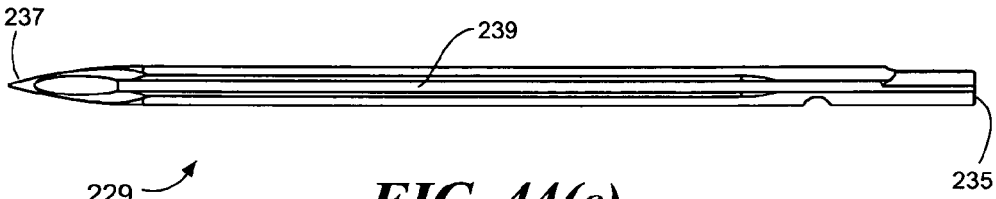

As seen most clearly in FIG. 39, housing 213 additionally includes a nose 225 (shown in isolation in FIGS. 43(*a*)–(*e*)) which is secured onto the leading end of right side casing 215 by a pair of screws. Nose 225 is shaped to define a longitudinal bore 227 which is adapted to receive an elongated, extra heavy-duty T-end, hollow, slotted needle 229 (shown in isolation in FIGS. 44(*a*)–(*c*)). A needle lock 231, which is represented in FIG. 38(*c*) as a fillister head screw, can be inserted into a transversely extending needle lock bore 233 in nose 225 in order to fix (i.e., lock) needle 229 in place within bore 227.

Similar to needle 71 in tool 61, needle 229 is manufactured to have a length which is considerably longer than other types of conventional extra heavy-duty T-end, hollow, slotted needles. Preferably, needle 229 is preferably approximately 3 inches in length, thereby enabling it to penetrate through all of layers 21-1, 23, 25, 27 and 29 of mattress 11. Needle 229 is similar to conventional slotted needles which are found in fastener dispensing tools in that needle 229 includes a trailing end 235, a leading end 237 in the form of a sharpened, spoon-shaped tip and a longitudinal bore 239 which is generally circular in lateral cross-section and extends the length of needle 229 from trailing end 235 to leading end 237. Bore 239 is sized and shaped to axially receive cross-bar 35 of fastener 31, thereby enabling cross-bar 35 to be inserted into bore 239 from trailing end 235, travel axially therethrough along its length and ultimately penetrate out from bore 239 through leading end 237.

It should be noted that tool 211 differs from tool 61 in that tool 211 is designed to receive a single needle 229 (whereas tool 61 is designed to receive a plurality of needles of varying lengths). In order to effectively change the length of needle 229, tool 211 is provided with a needle stop assembly 241 which can be slidably displaced relative to the leading end of housing 213, as will be described in greater detail below.

Figure 45A:
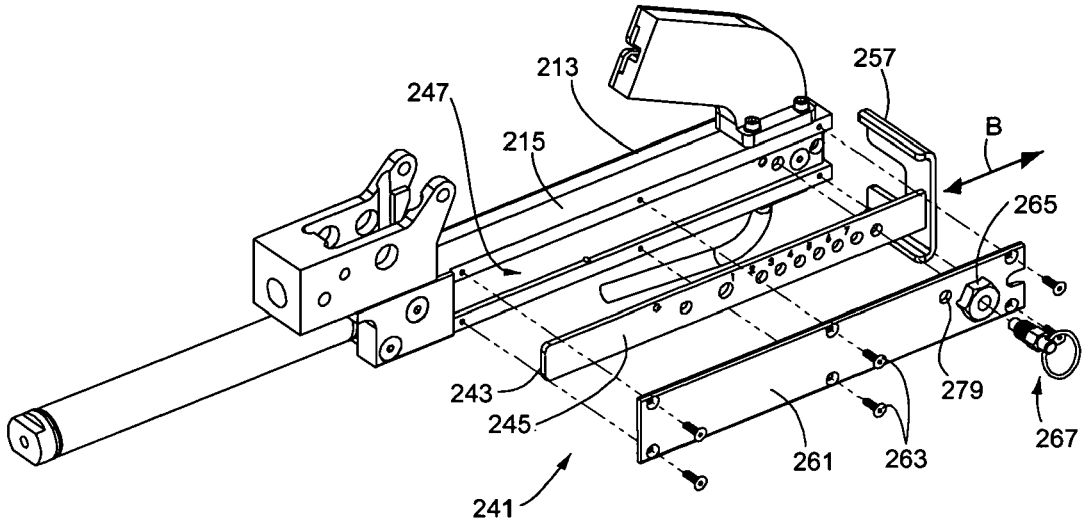
FIG. 45(*a*) is a partially exploded, rear, top perspective view of selected components of the tool shown in FIG. 38(*a*)
Figure 45B:
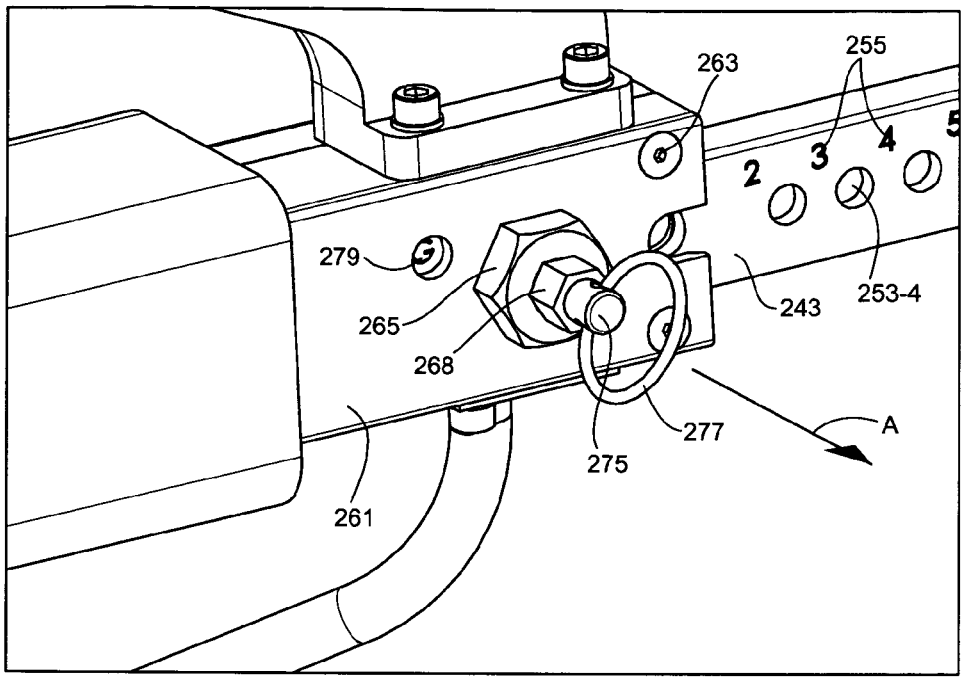
Figure 46:
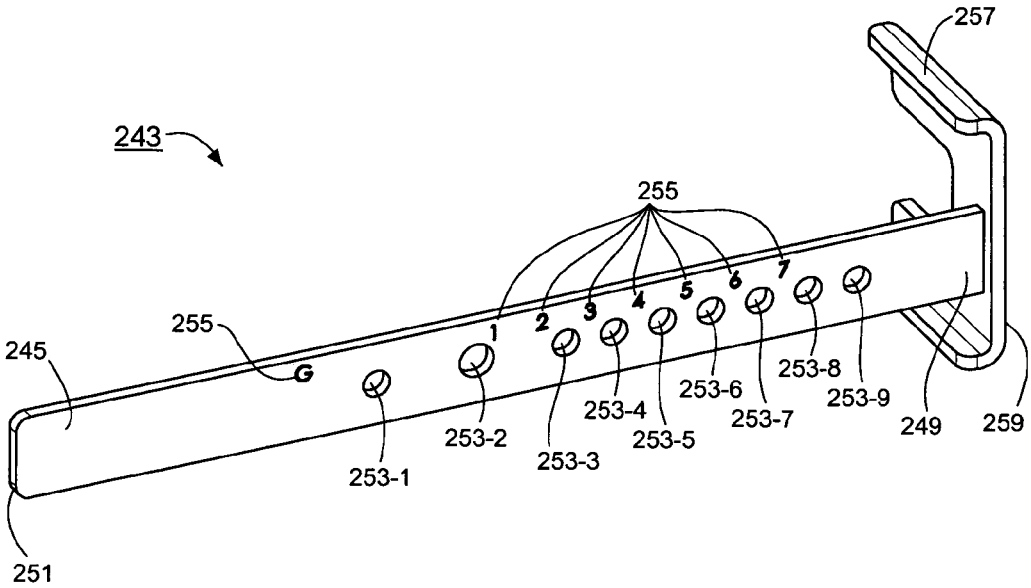
FIG. 46 is a rear, top perspective view of the needle stop shown in FIG. 45(*a*)

Specifically, as seen most clearly in FIGS. 45(*a*) and 45(*b*), needle stop assembly 241 comprises a needle stop 243 (shown in isolation in FIG. 46) which is slidably mounted onto the rear surface of right side casing 215. Needle stop 243 includes an elongated arm 245 which is sized and shaped to linearly slide within a shallow rectangular recess 247 formed in the rear surface of right side casing 215. Arm 245 is in the form of a flat, rectangular bar which includes a first end 249 and a second end 251. A plurality of circular holes 253-1 thru 253-9 are formed into arm 245 along its length. In addition, indicia 255 (represented herein as being in the form of the letter G and the sequence of numbers from 1 to 7) is provided onto the rear surface of arm 245 and provides the user with a visible marker as to the position of needle stop 243 relative to right side casing 215, as will be described further below.

Needle stop 243 additionally includes a U-shaped contact plate 257 which is formed onto first end 249 of arm 245 at a right angle relative thereto. Contact plate 257 includes a substantially flat contact surface 259 which is designed to press against the outer surface of the mattress through which fastener 31 is to be dispensed using tool 211. As can be appreciated, the ability to linearly slide needle stop 243 serves to displace contact plate 257 towards or away from the leading end of housing 213.

Figure 47:
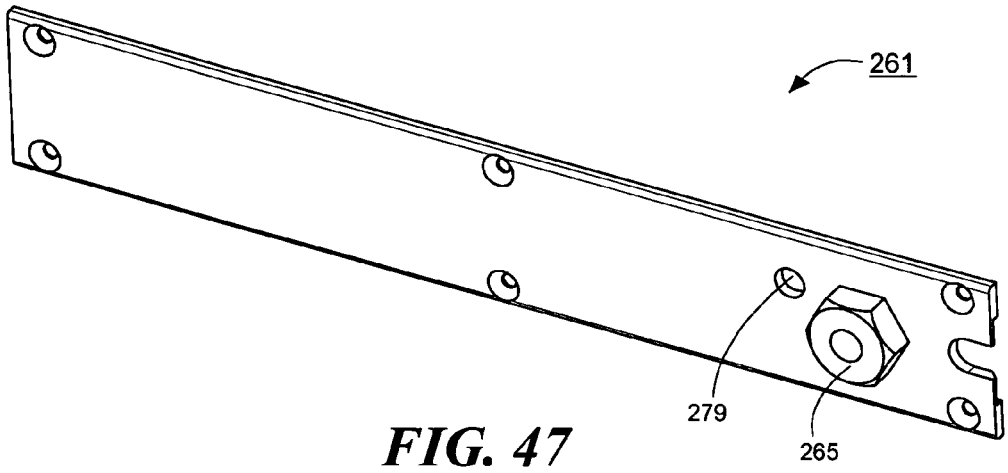
FIG. 47 is a rear, top perspective view of the back plate shown in FIG. 45(*a*)
Figure 48:
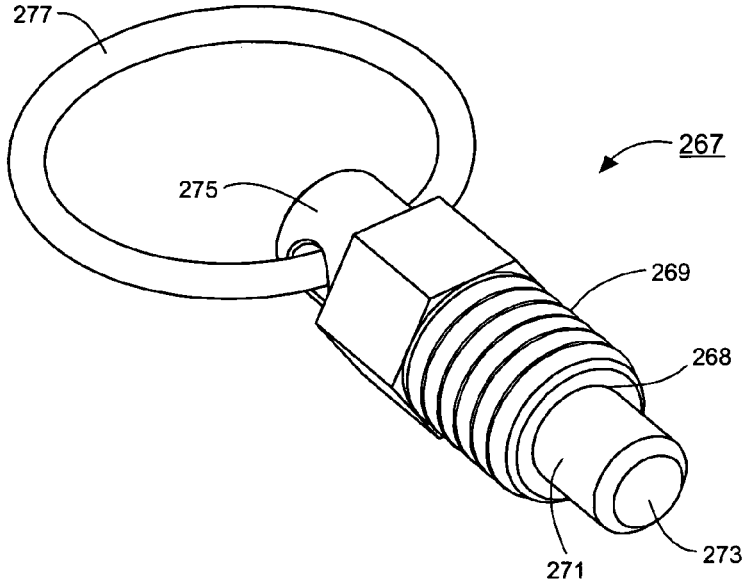
FIG. 48 is a front, top perspective view of the locking member shown in FIG. 45(*a*)

A substantially flat back plate 261 (shown in isolation in FIG. 47) is affixed by screws 263 to the rear surface of right side casing 215 over needle stop 243. In this manner, back plate 261 serves to retain arm 245 of needle stop 243 in place within recess 247. A raised, internally-threaded hex nut 265 is integrally formed onto the outer surface of back plate 261 and is adapted to threadingly receive locking member 267 (shown in isolation in FIG. 48).

Locking member 267 is in the form of a retractable spring plunger and comprises a hollow pin 268. The outer surface of pin 268 is shaped to include an outer threading 269 which is sized and shaped to engage the internal threading within hex nut 265. Accordingly, hollow pin 268 is designed to be securely affixed onto back plate 261 by driving outer threading 269 into engagement with the internal threading within hex nut 265, as seen most clearly in FIG. 45(*b*). A spring biased plunger 271 extends axially within hollow pin 268 and includes a first end 273 and a second end 275. A ring 277 is retained onto second end 275 of plunger 271 and serves as a means for pulling plunger 271 rearward. Specifically, it is to be understood that pulling ring 277 rearward (as represented by arrow A in FIG. 45(*b*) serves, in turn, to rearwardly displace first end 273. Upon the withdrawal of said rearward force, internal springs (not shown) within locking member 267 resiliently displace first end 273 of plunger 271 in the forward direction and back to its original position.

In this manner, needle stop assembly 241 can be used in the following manner to adjust the effective length of needle 229. By applying a rearward force onto ring 277 (as represented by arrow A in FIG. 45(*b*)), first end 273 of plunger 271 is rearwardly displaced in the direction away from needle stop 243. While maintaining said rearward force on ring 277, the user is able to linearly slide needle stop 243 within recess 247 (as represented by arrow B in FIG. 45(*a*)). As needle stop 243 is linearly displaced, each form of indicia 255 (i.e., each marker) on arm 245 sequentially aligns within a circular window 279 formed in back plate 261. In this manner, the sequential alignment of each piece of indicia 255 through window 279 serves as a visible marker to the user in indexing needle stop 243 among its fixed settings.

Once the user locates a particular desired setting (thereby signifying the desired position of needle stop 243 relative to right side casing 215), rearward force A on ring 277 is released which, in turn, causes spring biased plunger 271 to resiliently return to its original position. As plunger 271 returns to its original position, first end 273 fittingly penetrates into a corresponding hole 253 in arm 245 to effectively lock needle stop 243 in place, which is highly desirable.

It should be noted that tool 211 is designed such that the replacement and installation of needle 229 is to be effected with needle stop 243 disposed in its most extended setting (i.e., with the piece of indicia 255 identified by the letter G disposed within window 279 in back plate 261), this setting also serving as the guard (G), or protective, position since the sharpened tip of needle 229 is safely disposed behind contact plate 257, as seen most clearly in FIGS. 38(*a*) and 38(*b*). With needle stop 243 disposed in its most extended setting, opening 253-2 (which is larger in diameter than the remainder of openings 253) is positioned in direct axial alignment with needle lock bore 233 in nose 225. Accordingly, needle lock 231 (which has a head which is smaller in diameter than opening 253-2) can be inserted entirely through needle stop 243 and into needle lock bore 233 in nose 225 in order to fix (i.e., lock) needle 229 in place within bore 227. It should be noted that needle lock 231 fits entirely within needle lock bore 233 to as not to interfere with the ability to slide needle stop 243 within recess 247.

Indexing needle stop 243 (and, in particular contact plate 257) amongst the several fixed positions relative to housing 213 serves to change the effective length of needle 229. Specifically, adjusting needle stop 243 serves, in turn, to limit the portion of needle 229 which is able to penetrate through the one or more layers of material. As seen most clearly in FIG. 49, the effective length L of needle 229 is the distance from leading end 237 of needle 229 to contact surface 259 of contact plate 257. As a result, by displacing contact plate 257 out away from the front end of housing 213 (as represented by arrow C in FIG. 49), the effective length L of needle 229 is reduced, whereas by displacing contact plate 257 in towards the front end of housing 213 (as represented by arrow C' in FIG. 49), the effective length L of needle 229 is increased. As can be appreciated, the fact the effective length of needle 229 can be modified by the user without necessitating the removal and installation of various needles of different lengths (as is the case with tool 61) significantly simplifies the operation and construction of tool 211, which is highly desirable.

Tool 211 additionally comprises a pneumatically-driven ejection mechanism. Specifically, as seen most clearly in FIGS. 39, 50(*a*) and 50(*b*), tool 211 comprises a drive cylinder 281 (shown in isolation in FIG. 51) which is pneumatically driven, drive cylinder 281 comprising an air chamber 283 and a push rod 285 which is telescopingly mounted within air chamber 283 and is adapted for axial displacement relative thereto.

Figure 52B:
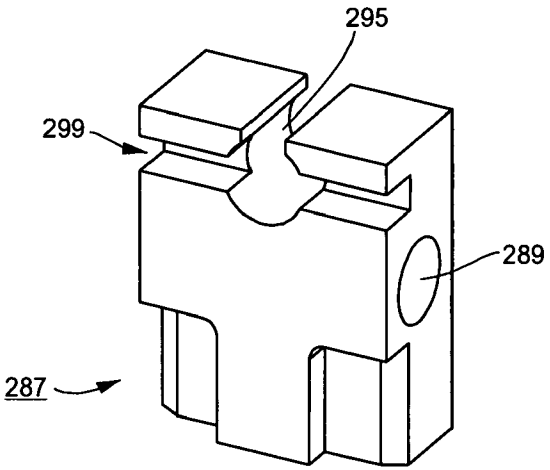
FIGS. 52(*a*)–(*b*) are front, top, right end perspective and rear, top, left end perspective views, respectively, of the slide shown in FIG. 39.
Figure 52A:
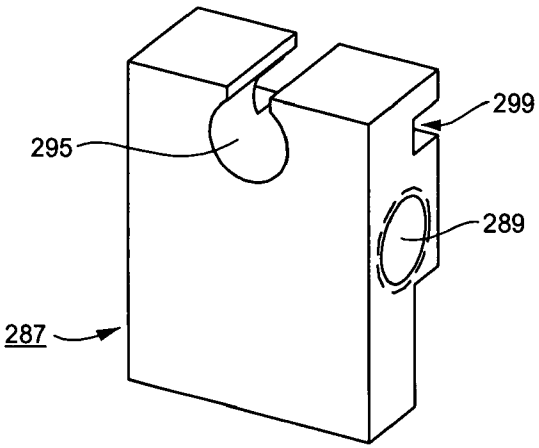

A slide 287 (shown in isolation in FIGS. 52(*a*) and 52(*b*)) is fixedly mounted onto the free end of push rod 285. Specifically, slide 287 is shaped to include a longitudinally extending bore 289 which is sized and shaped to fittingly receive the free end of push rod 285 (with an adhesive preferably deposited within bore 289 to secure slide 287 on push rod 285). In this manner, the activation and deactivation of drive cylinder 281 serves to longitudinally displace push rod 285 and, in turn, slide 287.

An L-shaped ejector rod 291 (which is identical in construction to ejector rod 83) is fixedly mounted onto slide 287 by means of a pin 293 (which is identical in construction to pin 85). Specifically, pin 293 is fittingly disposed into a laterally extending bore 295 formed in slide 287. In turn, ejector rod 291 is fittingly mounted into a longitudinal bore 297 formed in pin 293, a portion of the length of ejector rod 291 extending through a longitudinal, rectangular notch 299 formed in slide 287.

As can be appreciated, the activation and deactivation of drive cylinder 281 serves to longitudinally displace slide 287 which, in turn, linearly advances ejector rod 291 through tool 211. In particular, ejector rod 291 is aligned to selectively protrude axially through longitudinal bore 239 in needle 229 so as to expel the cross-bar 35 of a fastener 31 out through the open tip of needle 229, as will be described further below.

Figure 55:
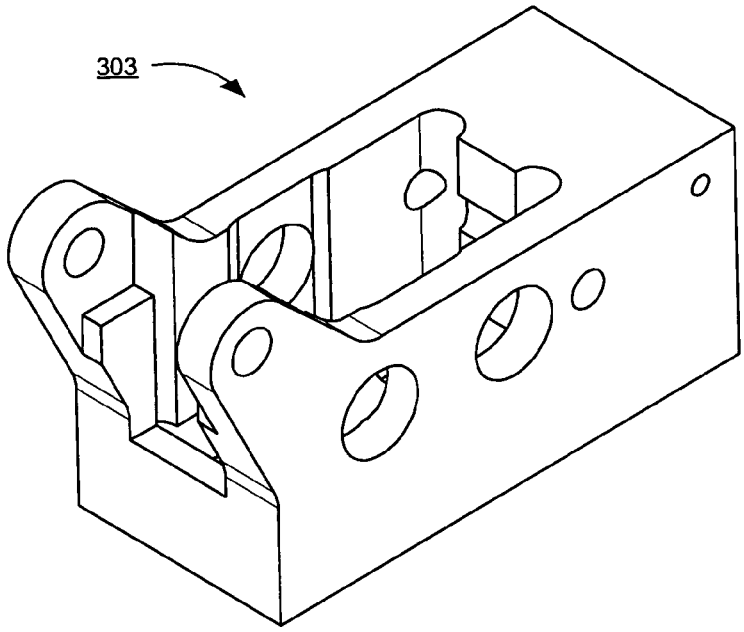
FIG. 55 is an enlarged, front, top, left end perspective view of the valve support block shown in FIG. 53.

It should be noted that the activation and deactivation of drive cylinder 281 is controlled through a finger operable valve assembly 301. As seen most clearly in FIGS. 38(*a*)–(*e*), 53 and 54, valve assembly 301 comprises a valve support block 303 (shown in isolation in FIG. 55) which is secured onto the trailing end of right side casing 215 using the combination of a lock washer 305 and a socket head cap screw 307 at two separate locations.

Figure 56:
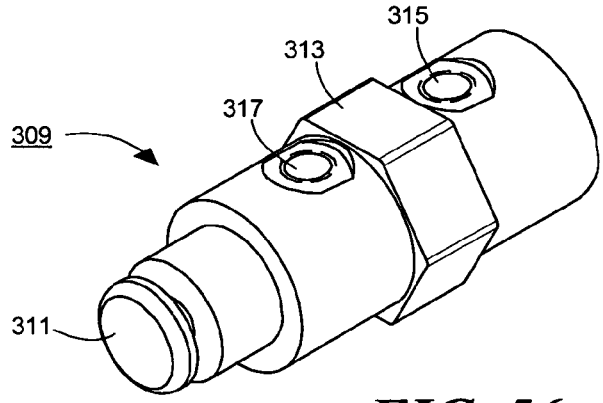
FIG. 56 is an enlarged, front, bottom, left end perspective view of the four-way valve shown in FIG. 53.

Valve assembly 301 additionally includes a four-way valve 309 (shown in isolation in FIG. 56) which is fittingly disposed within valve support block 303. As will be described further below, four-way valve 309 is adapted to receive air pressure from a heavy duty air supply (not shown) and, in turn, selectively route said air pressure to air chamber 283 in order to drive push rod 285 in either of two opposing directions. Four-way valve 309 includes an actuation button, or piston, 311, an input valve 313, a first output valve 315 and a second output valve 317, each of valves 313, 315 and 317 having a size of 10/32 NPT.

Figure 57:
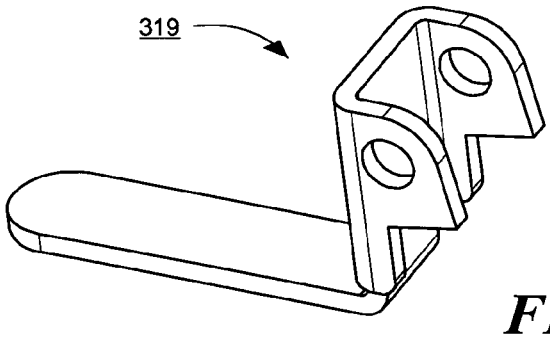
FIG. 57 is an enlarged, front, top, right end perspective view of the trigger shown in FIG. 53.

Actuation button 311 serves as a finger-actuable input means for controlling the operation of four-way valve 309. As seen most clearly in FIG. 38(*c*), an L-shaped trigger 319 (shown in isolation in FIG. 57) is pivotally mounted onto valve support block 303 about a pin 321, wherein a pair of C-shaped clamps 323 are mounted onto opposite ends of pin 321 in order to retain trigger 319 on pin 321. A trigger cover 325 is slidably mounted over a portion of trigger 319 and serves to provide a comfortable surface to manipulate L-shaped trigger 319. As can be appreciated, trigger 319 is pivotally mounted onto support block 303 such that a downward force applied onto trigger cover 325 (e.g., by a finger) in turn draws trigger 319 into contact against and inwardly displaces piston 311 of valve 309.

Figure 54:
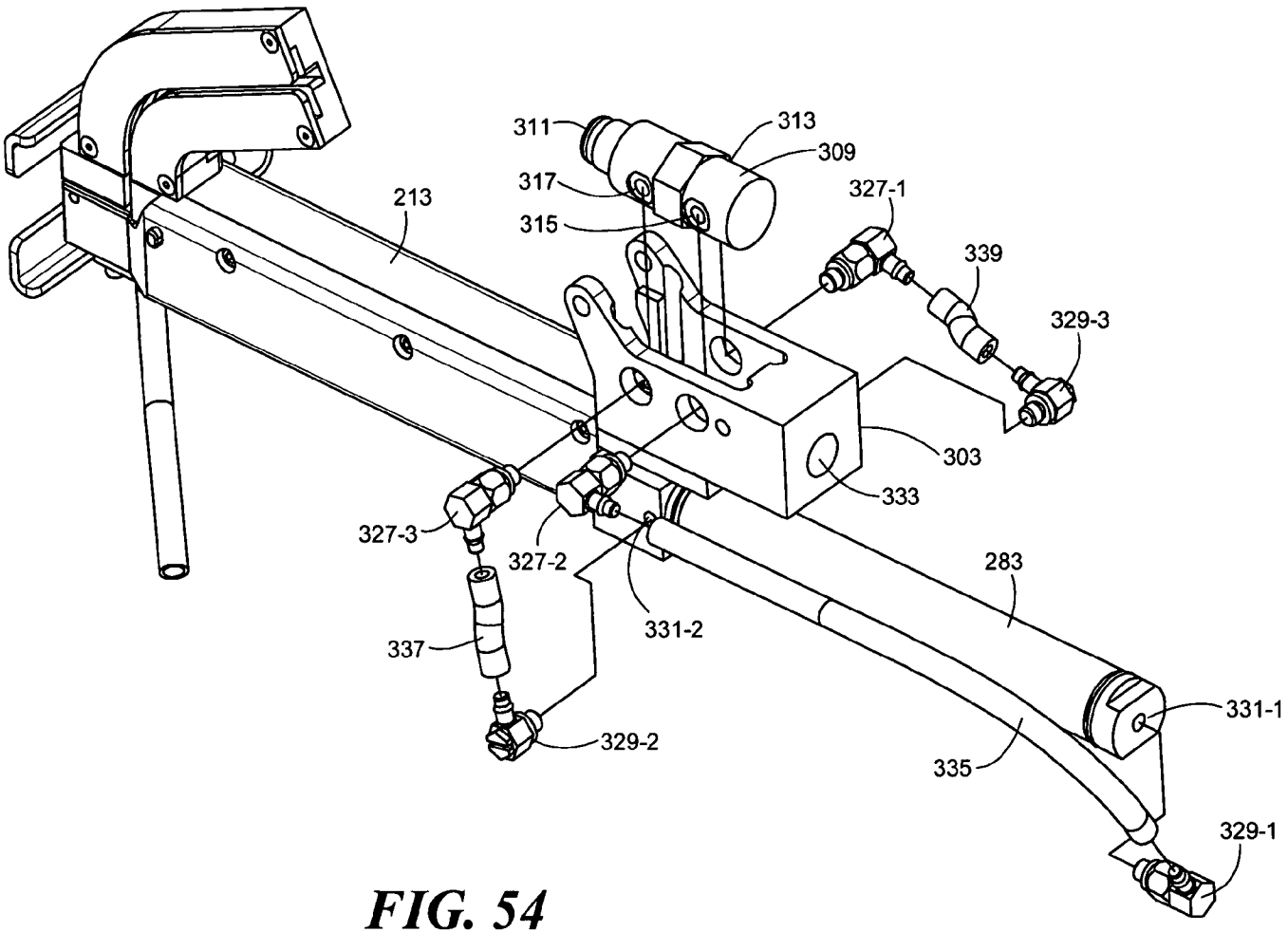
FIG. 54 is a partially exploded, front top perspective view of selected components of the tool shown in FIG. 38(*a*)
Figure 58:
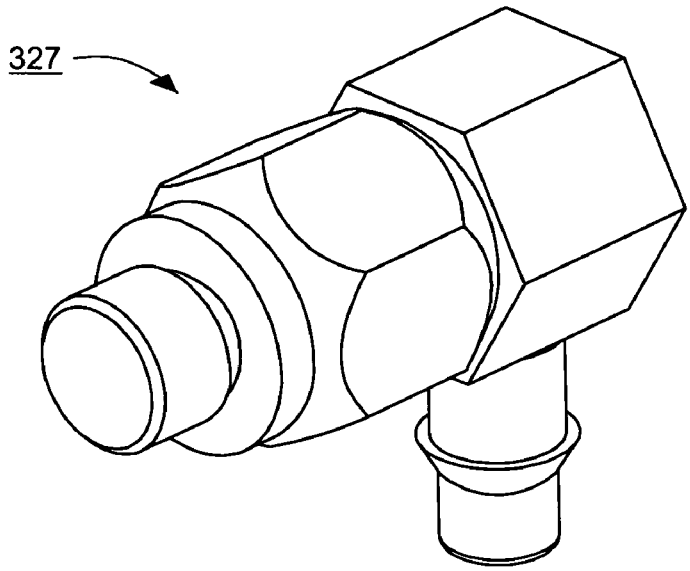
FIG. 58 is an enlarged perspective view of one of the swivel fittings shown in FIG. 53.
Figure 59:
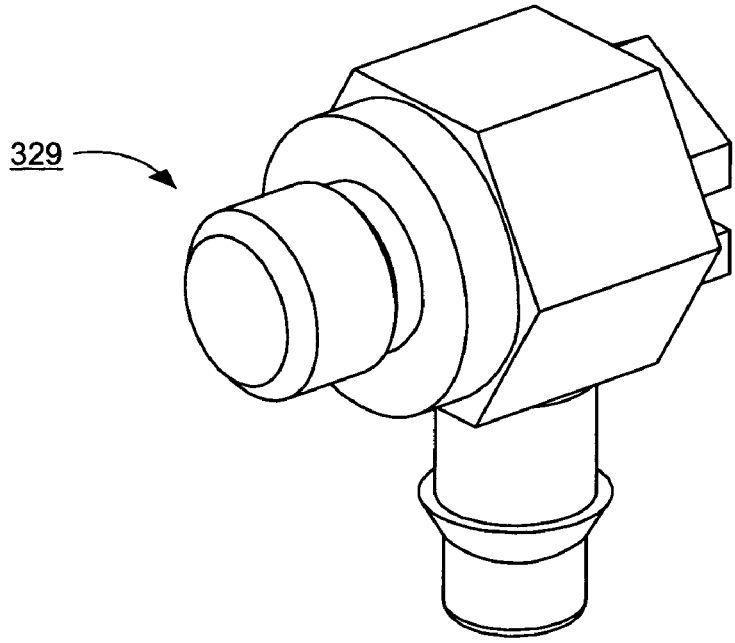
FIG. 59 is an enlarged perspective view of one of the universal fittings shown in FIG. 53.

As seen most clearly in FIG. 54, swivel fittings 327-1, 327-2, and 327-3 (one fitting 327 being shown in isolation in FIG. 58) are disposed through openings in valve support block 303 and into communication with input valve 313, first output valve 315 and second output valve 317, respectively, of four-way valve 309. In addition, universal fittings 329-1 and 329-2 (one fitting 329 being shown in isolation in FIG. 59) are disposed into communication with first and second input valves 331-1 and 331-2, respectively, for air chamber 283. Furthermore, an additional universal fitting 329-3 is mounted in valve support block 303 in fluid communication with a ⅛ NPT-sized, heavy duty hose input valve 333 which is provided in the rear of valve support block 303.

A first length of ⅛ inch inner diameter hose 335 connects universal fitting 329-1 to swivel fitting 327-2. A second length of ⅛ inch inner diameter hose 337 connects swivel fitting 327-3 to universal fitting 329-2. A third length of ⅛ inch inner diameter hose 339 connects universal fitting 329-3 to swivel fitting 327-1.

As can be appreciated, a pneumatic power source can be coupled to valve assembly 301 in the following manner in order to provide power to tool 211. Specifically, a length of tubing from a heavy duty pneumatic power source (not shown) is coupled directly to the large sized input valve 333 in valve support block 303. It should be noted that the relatively large size of input valve 333 allows for a ¼ inch inner diameter high volume hose to be directly connected to tool 211. The ability to directly connect a large, high volume hose to tool 211 serves to significantly improve the overall durability and strength of the connection between the high volume hose and tool 211, which is highly desirable. Together, fittings 327-1 and 329-3, support block 303 and hose 339 serve to convert (i.e., ratchet down) the relatively large inner diameter size of the input tubing down to a diameter which is compatible with input valve 313 of four-way valve 309, which is highly desirable.

With the power source properly coupled to input valve 333, the application of a downward force onto trigger 319 serves to inwardly displace activation button 311 on valve 309. Activation of button 311 causes four-way valve 309 to route air pressure supplied from the power source out through output valve 315, through tubing 335 and into input valve 331-1 of air chamber 283. The input of air pressure into input valve 331-1 advances push rod 285 out from air chamber 283 which, in turn, urges ejector rod 291 through needle 229 (i.e., to eject the cross-bar 35 of a fastener 31 out through needle 229).

Upon the release of the downward force onto trigger 319, four-way valve 309 directs air pressure supplied from the power source out through output valve 317, through tubing 337 and into input valve 331-2 of air chamber 283. The input of air pressure into input valve 331-2 retracts push rod 285 back into air chamber 283 which, in turn, withdraws ejector rod 291 from needle 229.

As described above, valve assembly 301 is used to control the operation of drive cylinder 281 which, in turn, controls the operation of the ejection mechanism for tool 211. It should be noted that tool 211 is provided with a fixed-length ejection stroke. Stated another way, for each ejection stroke, ejector rod 291 travels a constant distance. Because the effective length L of needle 229 can be adjusted by simply sliding needle stop 243 (as described in detail above), the length of the ejection stroke does not need to be adjusted for tool 211. Rather, tool 211 operates with a constant ejection stoke length regardless of the effective length of needle 229. As can be appreciated, the ability of tool 211 to effectively change the length of needle 229 without necessitating a corresponding change in the ejection stroke length serves to significantly simplify the construction and operation of tool 211, which is highly desirable.

Figure 60:
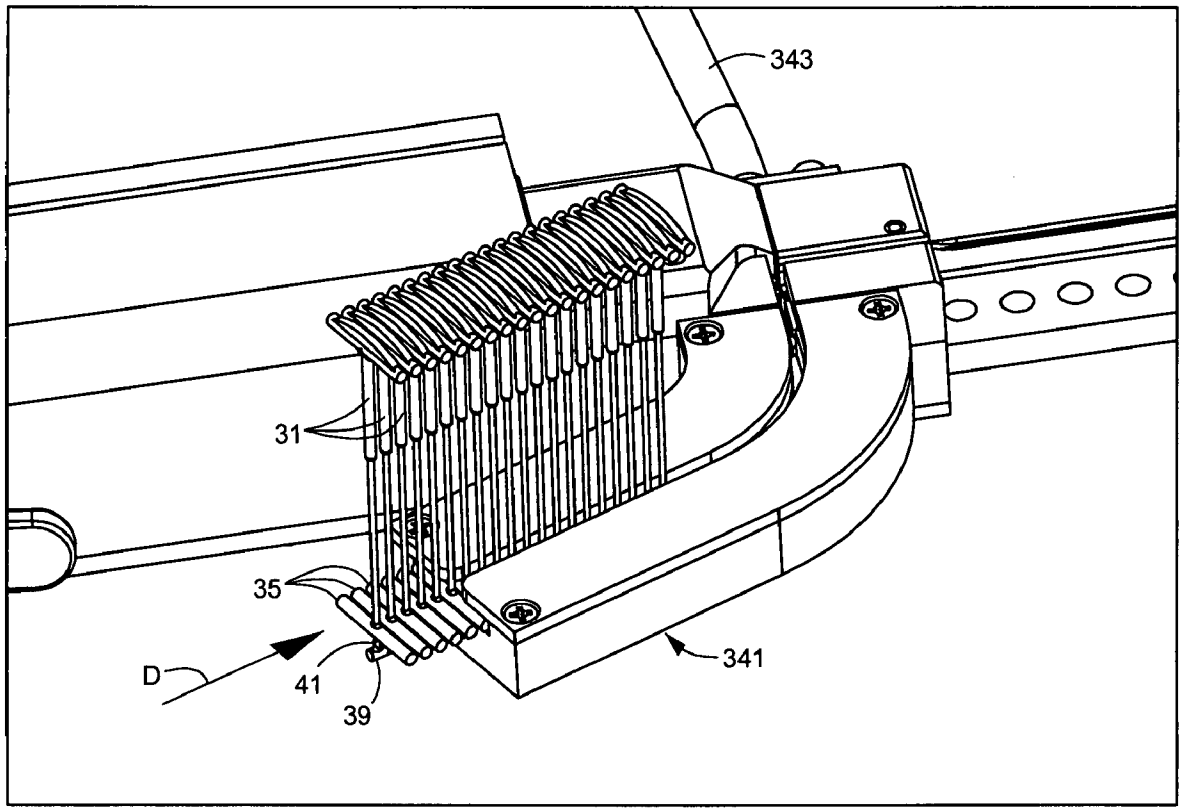
FIG. 60 is an enlarged, fragmentary, top, front perspective view of the tool shown in FIG. 48(*a*), the tool being shown with a clip of fasteners being loaded therein.

Tool 211 additionally includes means for guiding a fastener clip into and through tool 211 in such a manner so that the fastener clip is continuously directed away from the mattress to be fastened, which is highly desirable. Specifically, as seen most clearly in FIGS. 49, 53 and 60, tool 211 is provided with a fastener guide assembly 341 for guiding a clip of fasteners 31 into tool 211 and a runner bar guide 343 for guiding the used runner bar 39 from said clip out from tool 211.

Figure 61:
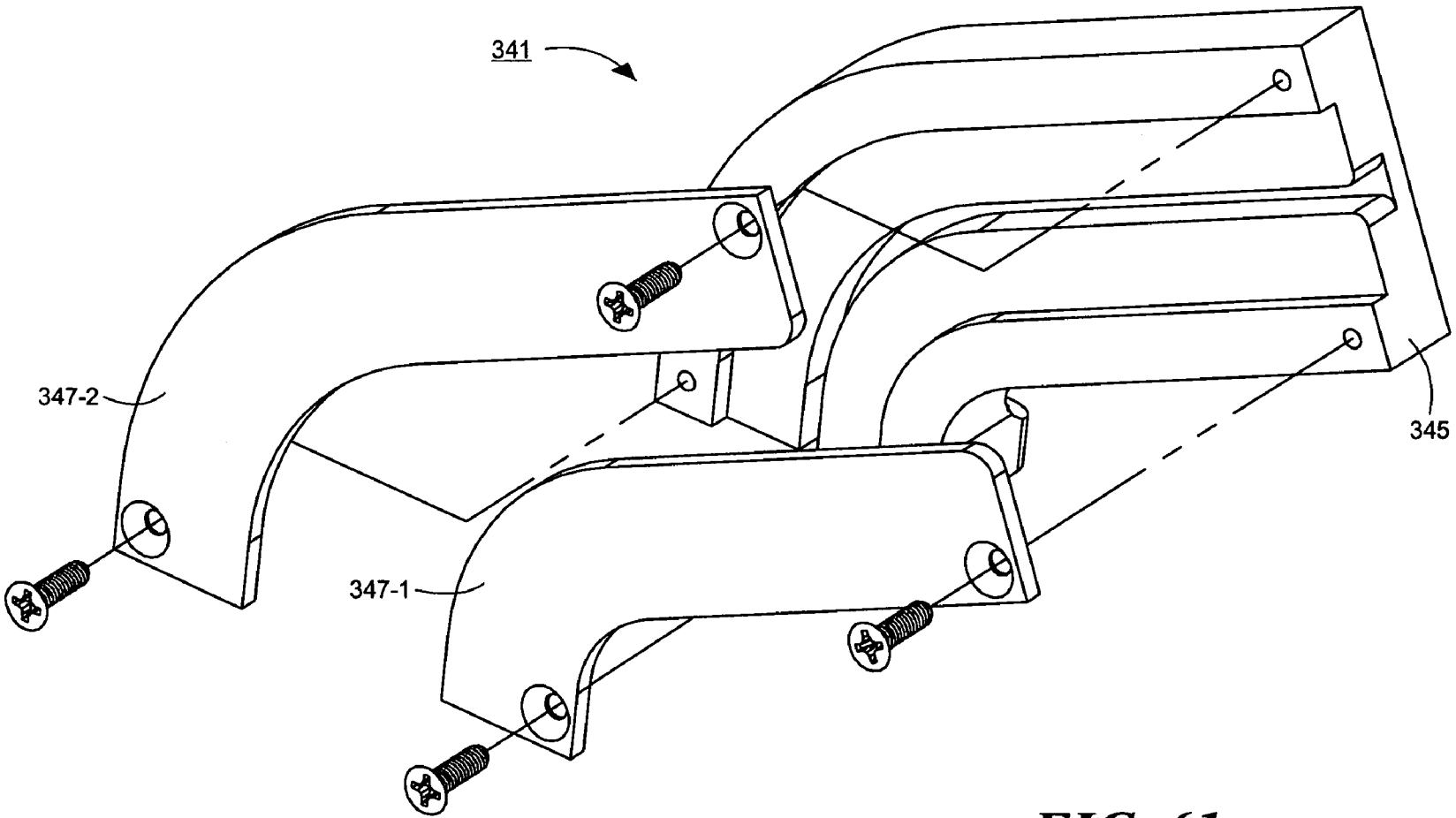
FIG. 61 is an enlarged, front perspective view of the fastener guide assembly shown in FIG. 48(*a*)

Fastener guide assembly 341 (shown in isolation in FIG. 61) comprises a fastener guide 345 which is secured onto the leading end of right side casing 215 using the combination of a lock washer 305 and a socket head cap screw 307 at two separate locations. Fastener guide assembly 341 additionally includes a pair of guide covers 347-1 and 347-2 which together define a partially enclosed channel 349 for receiving runner bar 39, necks 41 and cross-members 35 of the fastener clip, as seen most clearly in FIG. 60. It should be noted that fastener guide assembly 341 is provided with a curved construction in order to maintain the clip of fasteners 31 adequately away from the mattress to be fastened, as seen most clearly in FIG. 49.

Figure 53:
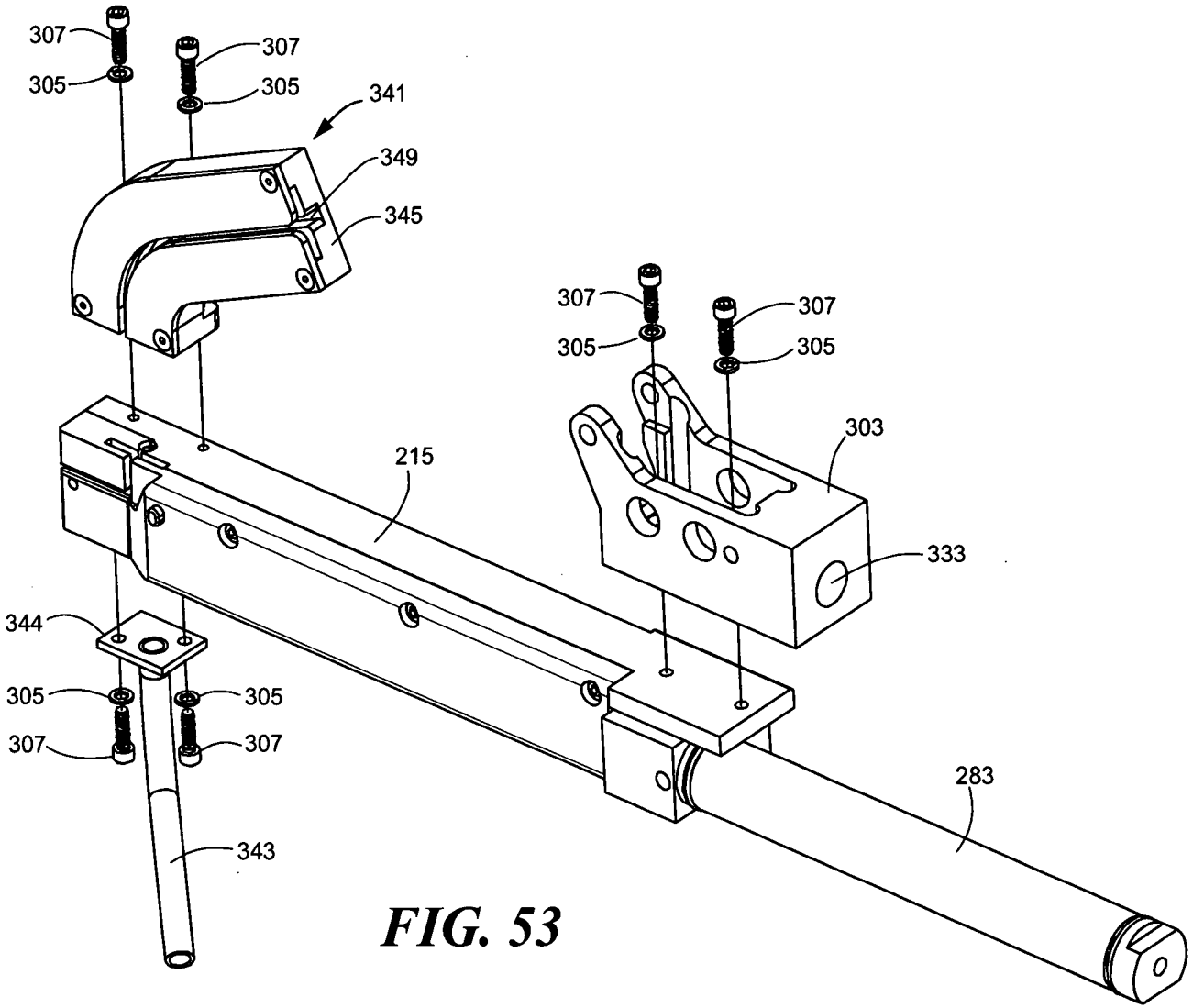
FIG. 53 is a partially exploded, front, top perspective view of selected components of the tool shown in FIG. 38(*a*)

Runner bar guide 343 is in the form of an elongated, curved, tube which is formed onto a flat plate 344 which, in turn, is fixedly secured onto right side casing 215 and nose 225 using the combination of a lock washer 305 and a socket head cap screw 307 at two separate locations, as seen most clearly in FIG. 53. Runner bar guide 343 is sized and shaped to receive runner bar 39 after fastener 31 has been dispensed from the fastener clip. In this manner, the curved construction of guide 343 serves to direct a used runner bar 39 away from the item to be fastened (i.e., the mattress), as seen most clearly in FIG. 49.

Figure 50A:
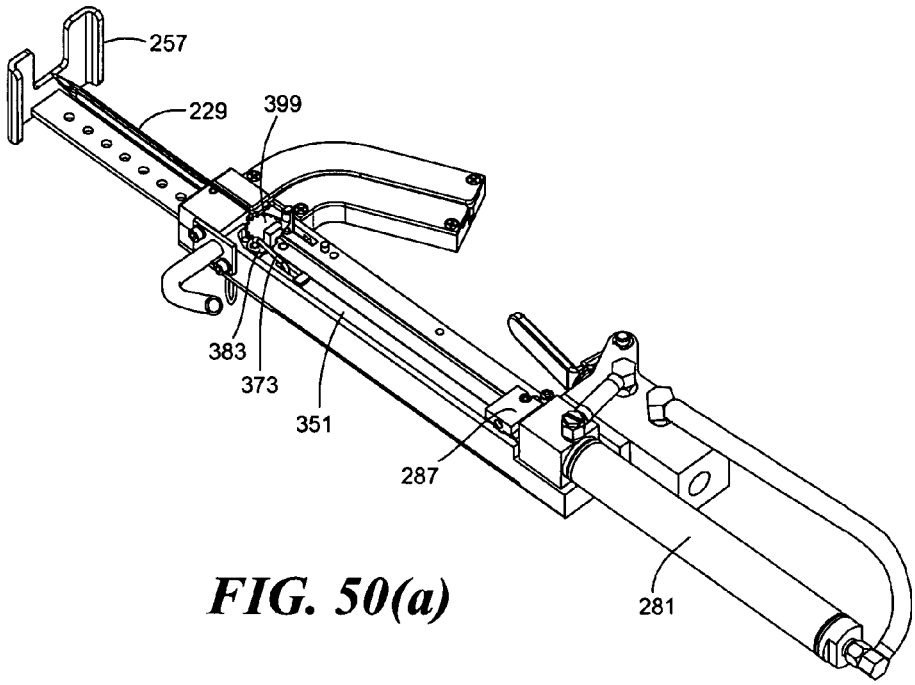
FIGS. 50(*a*)–(*b*) are front, bottom perspective and front, top perspective views, respectively, of the tool shown in FIG. 38(*a*), the tool being shown with the left side casing removed therefrom.
Figure 50B:
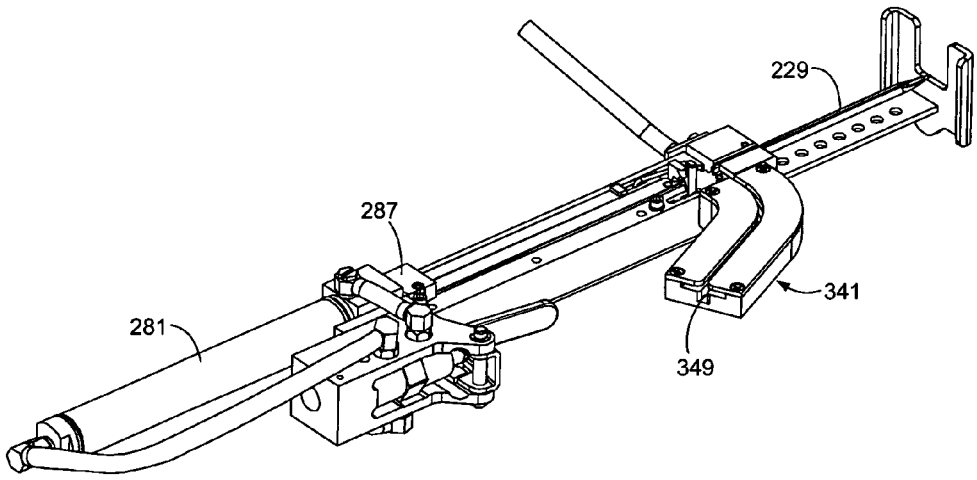
Figure 51:
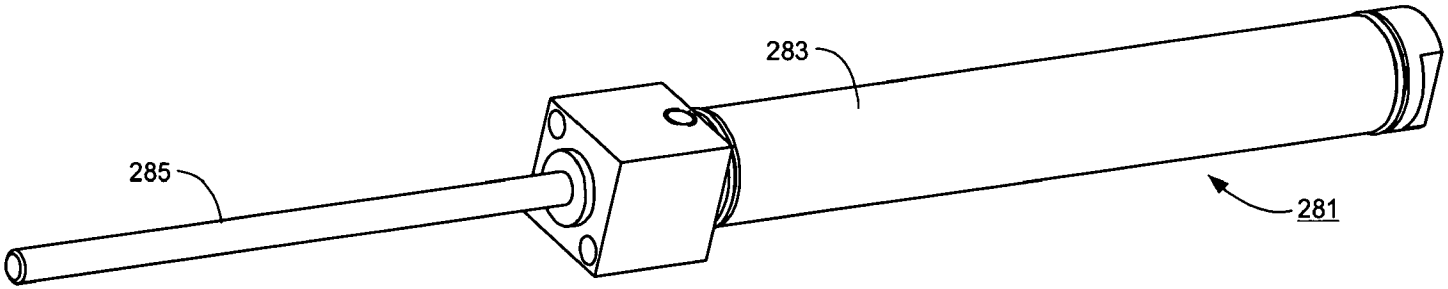
FIG. 51 is a front, top perspective view of the tool shown in FIG. 38(*a*)

As seen most clearly in FIGS. 39, 50(*a*) and 50(*b*), tool 211 is provided with an indexing mechanism for advancing the lowermost fastener 31 in the clip in place behind needle 229 prior to the ejection process. Contrary to tool 61, the indexing mechanism for tool 211 is coupled to its ejection mechanism, thereby simplifying the operation of tool 211, which is highly desirable.

Figure 62:
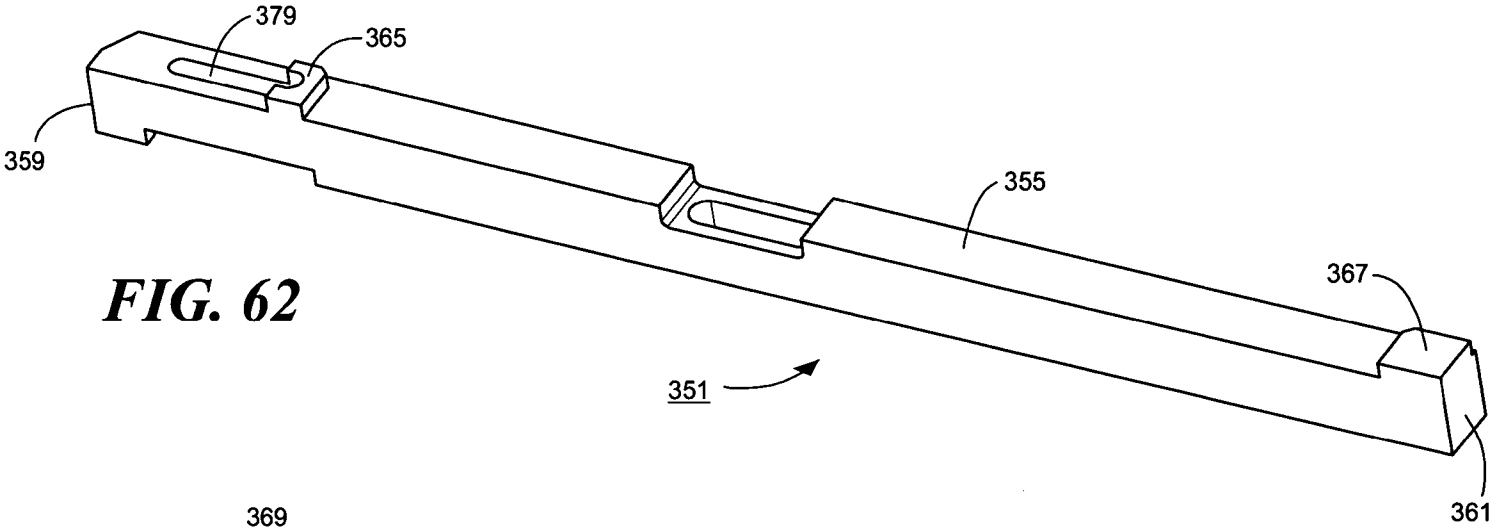
FIG. 62 is an enlarged, front, bottom perspective view of the index slide shown in FIG. 39.

The indexing mechanism comprises an elongated index slide 351 (shown in isolation in FIG. 62) which is disposed within an index slide cavity 353 formed in right side casing 215, index slide 351 including a front surface 355, a rear surface 357, a first end 359 and a second end 361. Index slide 351 is adapted to slide linearly within cavity 353, as will be described further below. A screw 363 extends through a slot 364 formed in slide 351 and into threaded engagement within a bore formed in right side casing 215, screw 363 serving to retain index slide 351 within cavity 353 without limiting its linear displacement. A forward projection 365 and a rearward projection 367 are formed onto front surface 355 at opposite ends of index slide 351.

Figure 63:
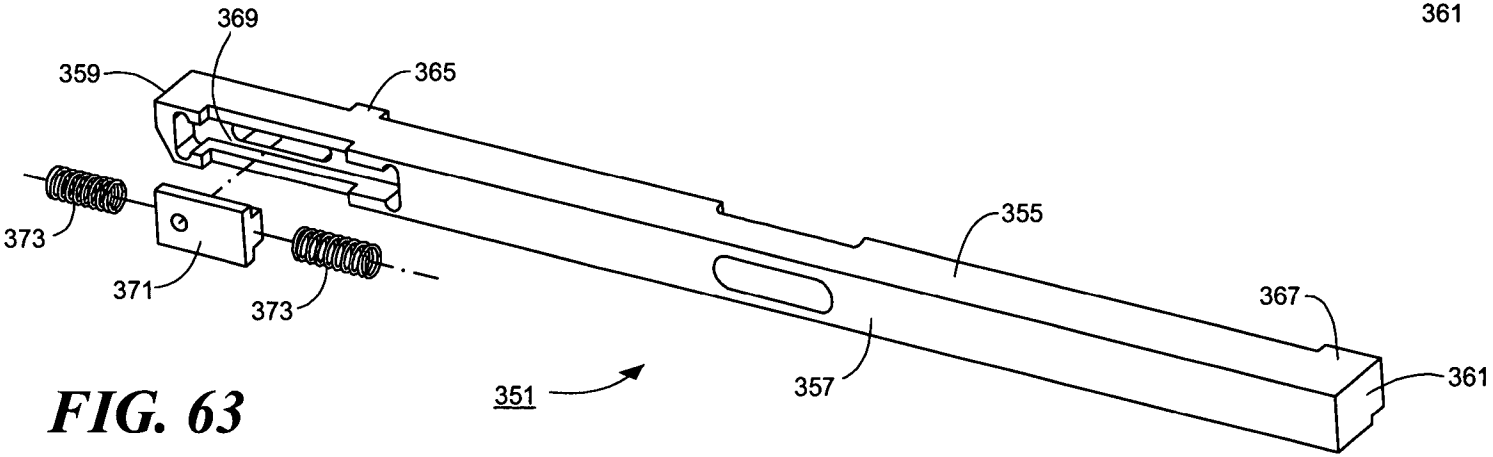
FIG. 63 is an enlarged, rear, top persective view of the index slide, tab and pair of springs shown in FIG. 39.
Figure 64:
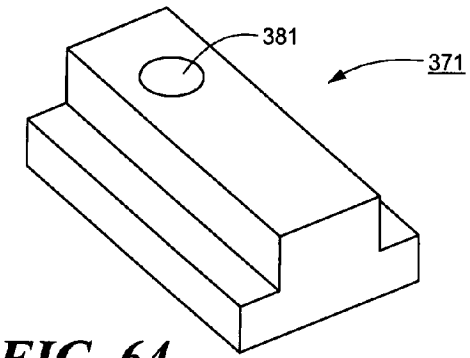
FIG. 64 is an enlarged, front, top, left end perspective view of the tab shown in FIG. 63.
Figure 65:
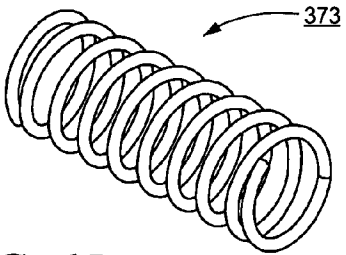
FIG. 65 is an enlarged perspective view of one of the springs shown in FIG. 63.

As seen most clearly in FIG. 63, a groove 369 is formed into rear surface 357 of index slide proximate first end 359. A tab 371 (shown in isolation in FIG. 64) is slidably disposed within groove 369 and is biased by a pair of springs 373 (one spring 373 being shown in isolation in FIG. 65). Specifically, tab 371 and springs 373 are linearly disposed within groove 369 with tab 371 sandwiched between springs 373. In this manner, tab 371, in the absence of any substantial outside force, aligns in the center of groove 369. However, upon the application of a lateral force, one spring 373 will compress which, in turn, allows for tab 371 to displace slightly within groove 369.

Figure 66:
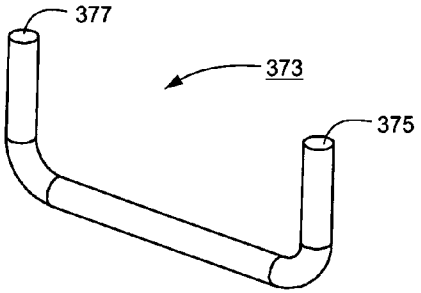
FIG. 66 is an enlarged, front, top, right end perspective view of the index link shown in FIG. 39.

A U-shaped index link 373 (shown in isolation in FIG. 66) includes a first end 375 and second end 377. First end 375 is disposed through a slot 379 formed in index slide 351 and fittingly protrudes into a bore 381 in tab 371. Second end 377 of index link 373 is coupled to an index pawl 383.

Figure 67:
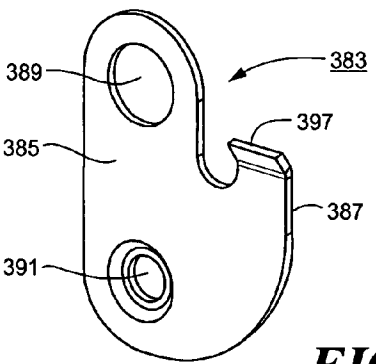
FIG. 67 is an enlarged, front perspective view of the index pawl shown in FIG. 39.
Figure 68:
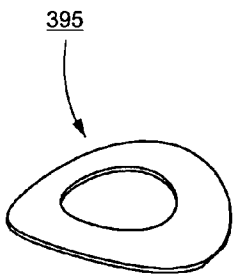
FIG. 68 is an enlarged, front perspective view of the bowed washer shown in FIG. 39.
Figure 69A:
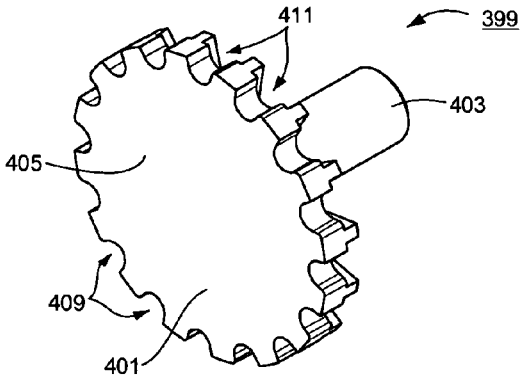
FIGS. 69(*a*)–(*d*) are perspective, front plan, right end plan and rear plan views, respectively, of the sprocket shown in FIG. 39.
Figure 69B:
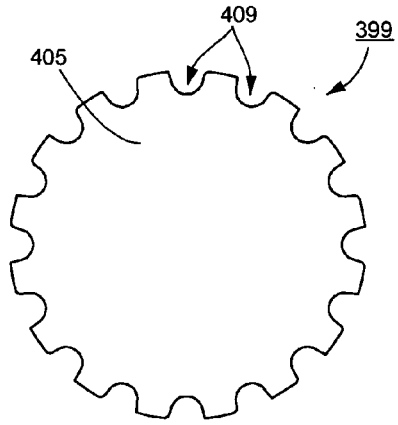
Figure 69C:
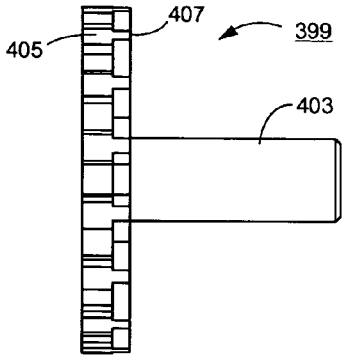
Figure 69D:
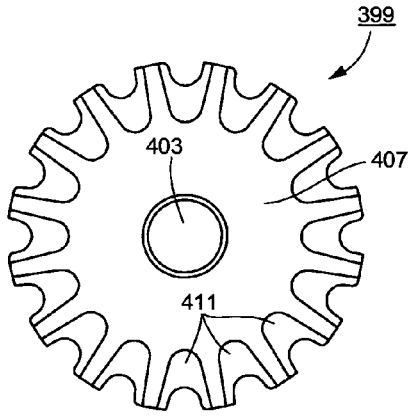

Index pawl 383 (shown in isolation in FIG. 67) is a unitary member which includes a substantially flat front surface 385, a substantially flat rear surface 387, an opening 389 and a bore 391 which is sized and shaped to fittingly receive second end 377 of index link 373. Index pawl 383 is pivotally disposed within a shallow recess 393 formed in right side casing 215. A bowed washer 395 (shown in isolation in FIG. 68) is disposed between right side casing 215 and rear surface 387 and serves to space index pawl 383 slightly away from right side casing 215. A ratchet-shaped tooth 397 is projects up from front surface 385 and serves to sequentially engage notches formed on a sprocket 399.

Sprocket 399 (shown in isolation in FIGS. 69(*a*)–(*d*)) includes a disc-shaped member 401 and a post 403. Post 403 is sized and shaped to penetrate through opening 389 in index pawl 383 and into a bore 405 formed in right side casing 215. In this manner, sprocket 399 can be rotated relative to right side casing 215 about post 403. Disc-shaped member 401 includes a flat front surface 405 and a flat rear surface 407. A first set of notches 409 are formed into front surface 405 along the outer periphery of member 401. In addition, a second set of notches 411 (notches 411 extending deeper than notches 409) are formed into rear surface 407 along the outer periphery of member 401.

Figure 70A:
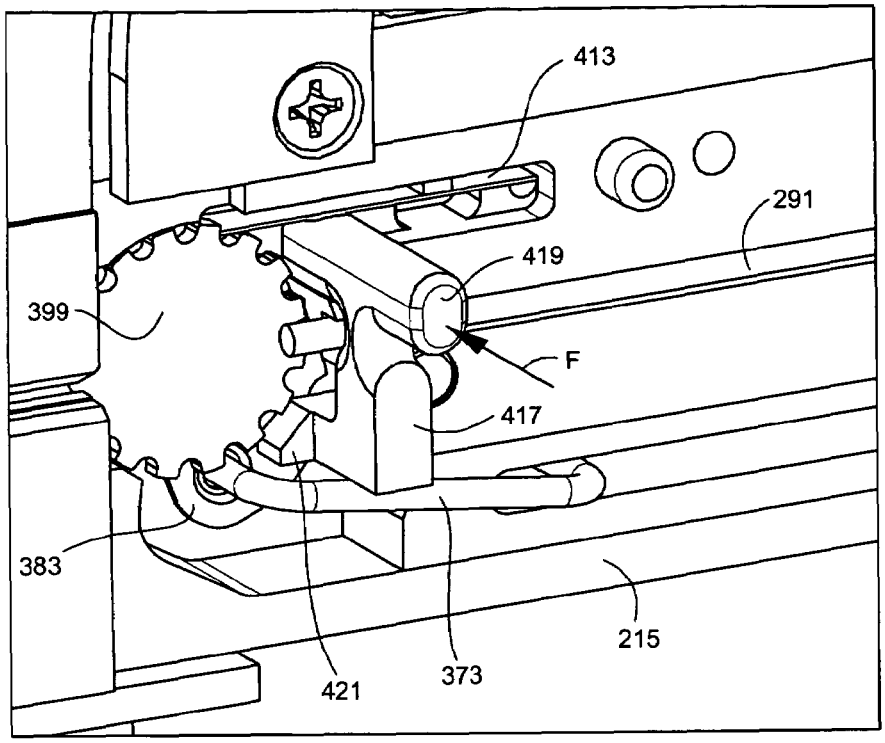
FIG. 70(*a*) is an enlarged, fragmentary, front perspective view of leading end of the tool shown in FIG. 50(*a*).
Figure 70B:
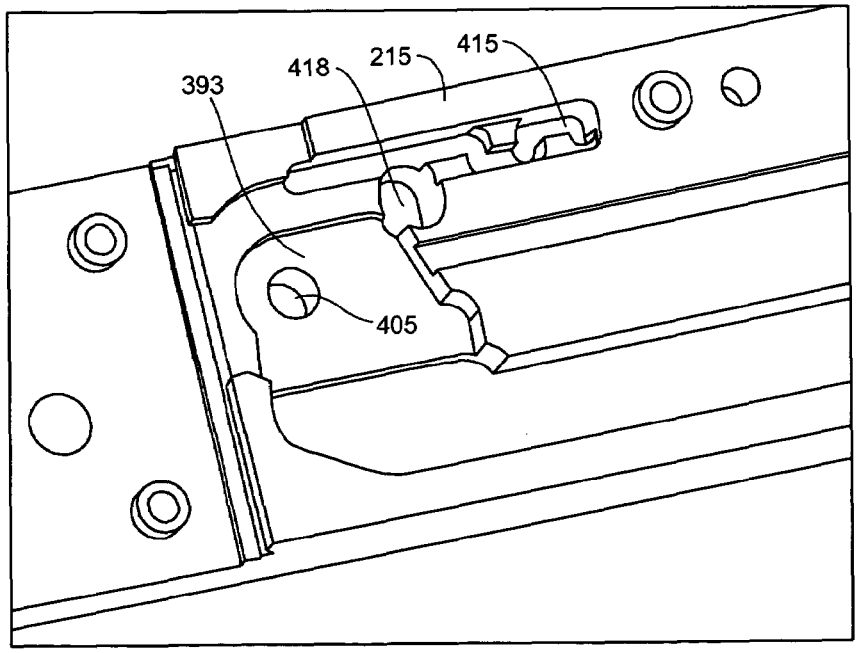
Figure 71:
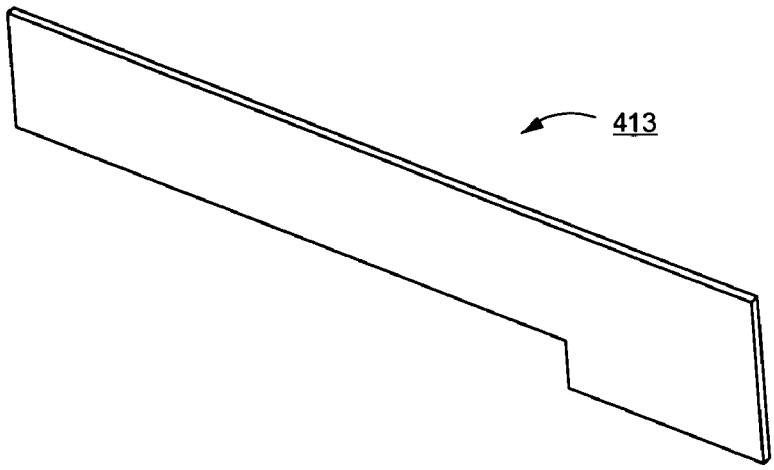
FIG. 71 is a bottom perspective view of the detent shown in FIG. 39.
Figure 72A:
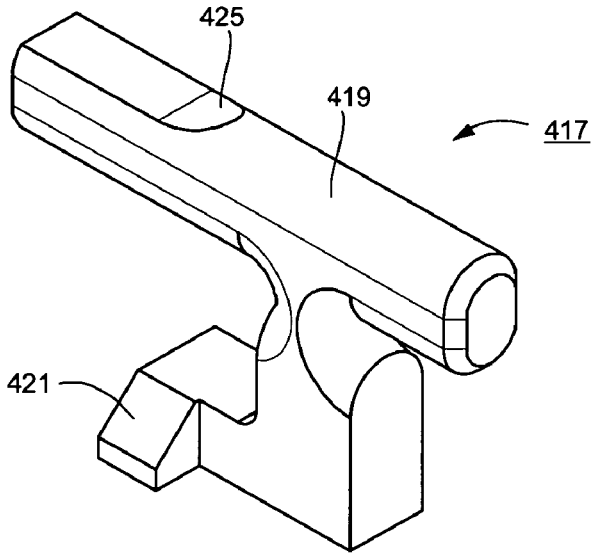
FIGS. 72(*a*)–(*e*) are perspective, left end plan, top plan, rear plan and front plan views, respectively, of the release button shown in FIG. 39.
Figure 72B:
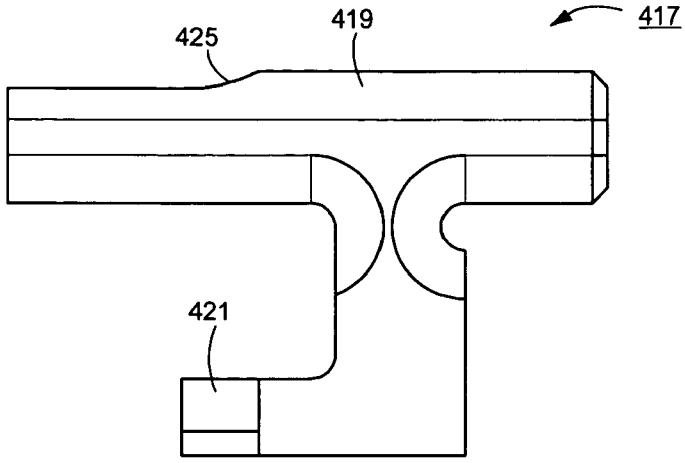
Figure 72C:
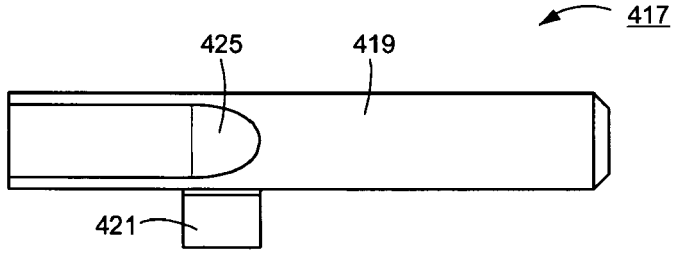
Figure 72D:
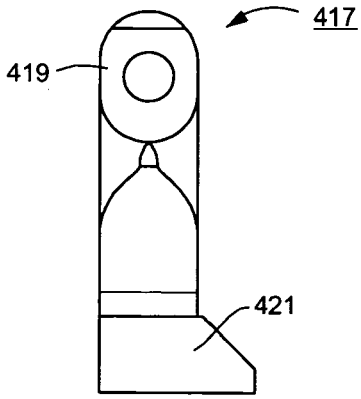
Figure 72E:
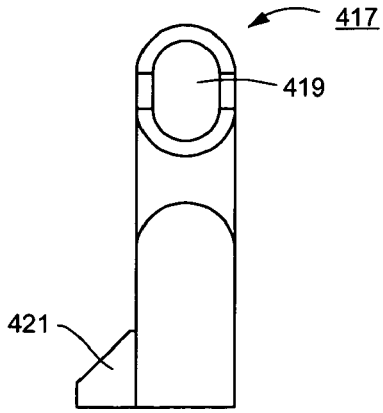
Figure 73A:
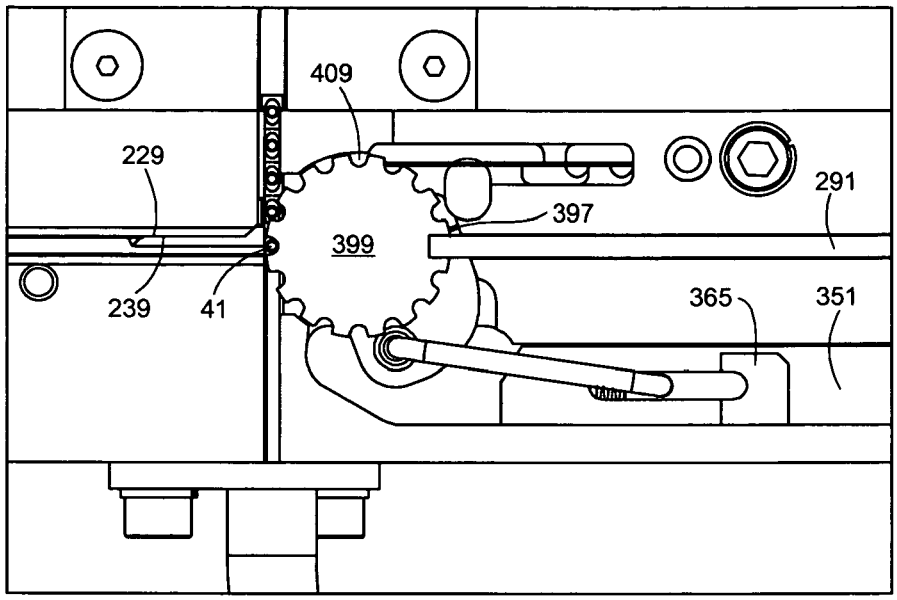
FIGS. 73(*a*)–(*e*) are enlarged, fragmentary, front plan views of the tool shown in FIG. 38(*a*) at various stages during the process of indexing a fastener into position for ejection, said tool being shown with its left side casing removed therefrom.
Figure 73B:
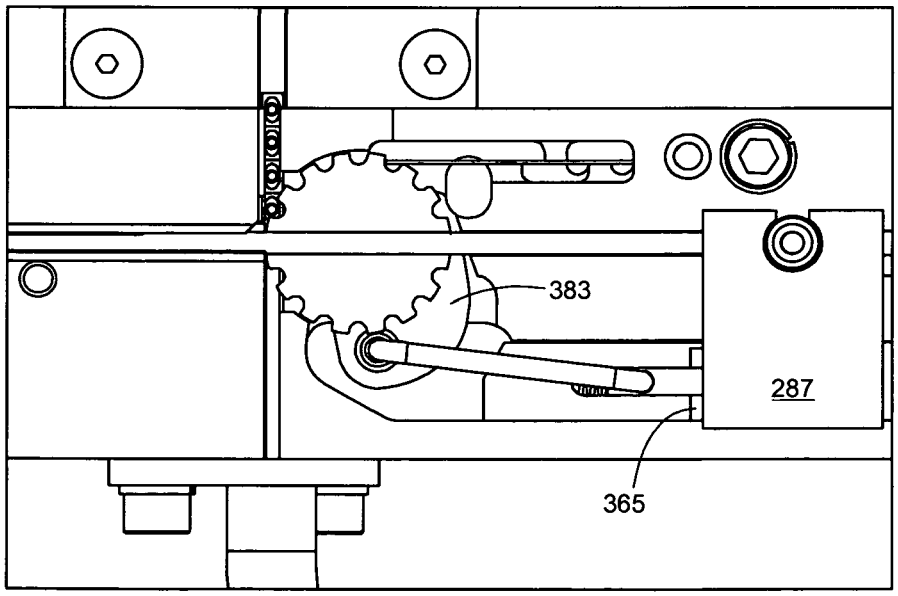
Figure 73C:
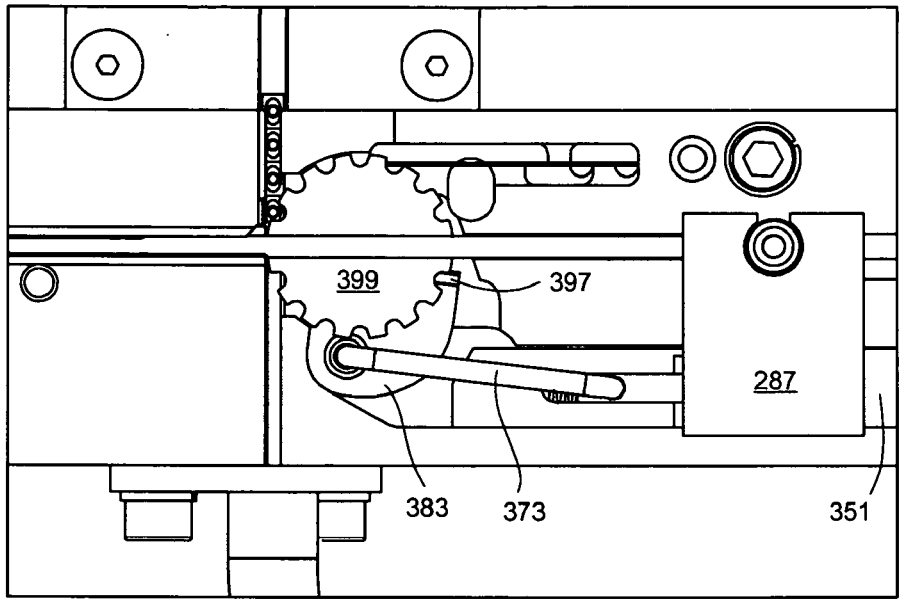
Figure 73D:
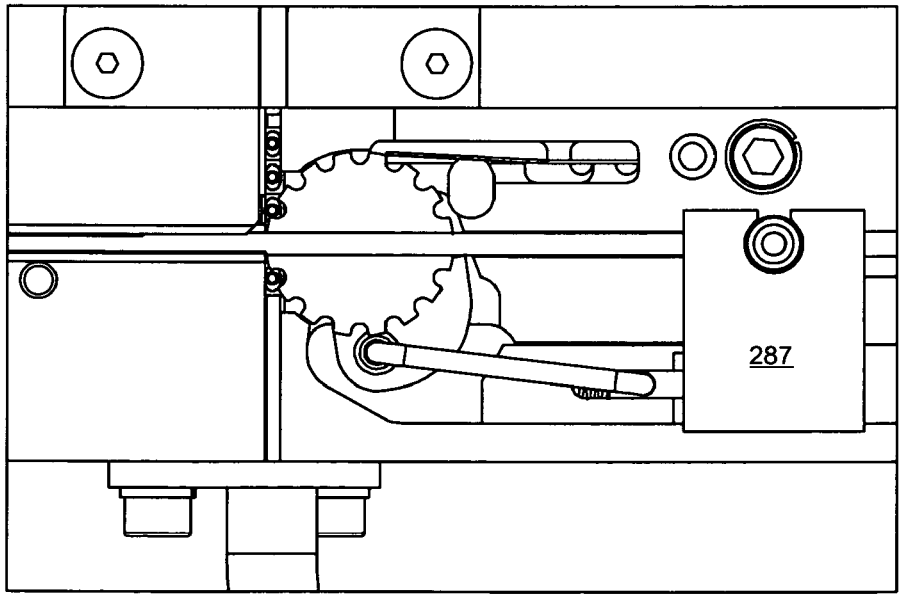
Figure 73E:
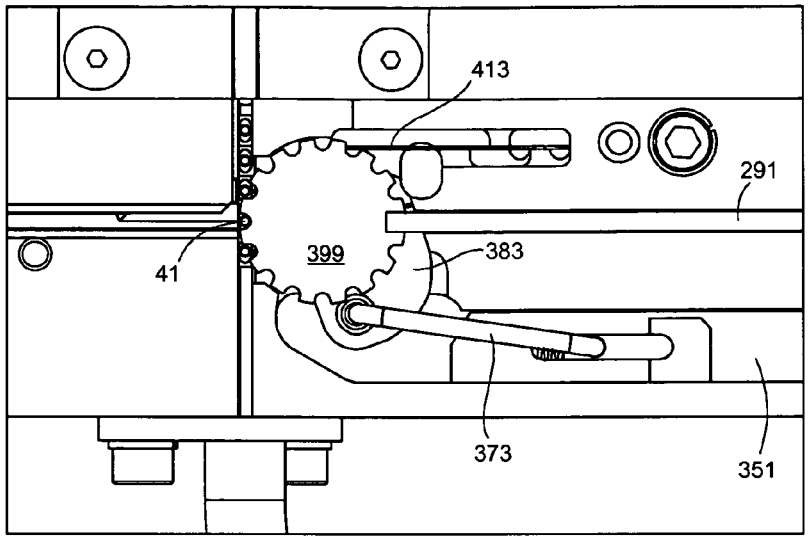

As seen most clearly in FIG. 70(*a*), a flexible detent 413 (shown in isolation in FIG. 71) is fixedly secured at one end within a detent recess 415 formed in right side casing 215. In addition, a release button 417 (shown in isolation in FIGS. 72(*a*)–(*e*)) is mounted over index pawl 383 and at least partially protrudes into a groove 418 formed in right side casing 215. Specifically, release button 417 is an integral member which includes a hammer 419 which is generally oval in lateral cross-section and an arm 421. Release button 417 is mounted such that one end of hammer 419 fittingly protrudes into groove 418 with a release button spring 423 being disposed therebetween to continuously urge hammer 419 away from right side casing 215. The opposite end of hammer 419 is sized and shaped to penetrate through an opening 424 in left side casing 217, thereby rendering a portion of hammer 419 externally accessible, as seen in FIG. 38(*a*). With release button 417 mounted as such, arm 421 lies in contact against top surface of index pawl 383, as seen in FIG. 70(*a*).

The indexing mechanism for tool 211 operates in the following manner to sequentially index the lowermost fastener 31 in the supply of fastener stock into alignment behind the longitudinal bore of needle 229 prior to the ejection process. Specifically, the supply of fastener stock is loaded, by hand, into enclosed channel 349 of fastener guide assembly 341 (as represented by arrow D in FIG. 60). The supply of fastener stock is fed into tool 211 until the severable connector 41 associated with the lowermost fastener 31 in the fastener stock aligns within a corresponding notch 409 in sprocket 399. With the supply of fastener stock fed into tool 211 in this manner, the cross-bar 35 of the lowermost fastener 31 is disposed in direct axial alignment behind longitudinal bore 239 of needle 229.

The activation of drive cylinder 281 by means of valve assembly 301 serves to displace slide 287 linearly forward along front surface 355 of index slide 351. As part of the ejection process (which is described in detail above), forward travel of slide 287, in turn, displaces ejector rod 291 forward. As ejector rod 291 travels forward, ejector rod 291 contacts the cross-bar 35 of the lowermost fastener 31 and advances it out through the sharpened tip of needle 229.

FIG. 73(*a*) represents selected components of the indexing mechanism as slide 287 commences its forward trigger stroke. As slide 287 continues in its forward trigger stroke, eventually slide 287 contacts forward projection 365 on index slide 351, as represented in FIG. 73(*b*). At this point (i.e., approaching the completion of the forward stroke), further forward displacement of slide 287 causes index pawl 383 to rotate in the clockwise direction about opening 389. The clockwise rotation of index pawl 383 causes tooth 397 to similarly rotate in the clockwise direction and ratchet (i.e., jump) from engaging one notch 411 on sprocket 399 to engaging the next successive clockwise notch 411 in sprocket 399, as represented in FIG. 73(*c*).

At the completion of the forward stroke, drive cylinder 281 begins to pull slide 287 in the rearward direction, as represented in FIG. 73(*d*). As slide 287 continues in its rearward trigger stroke, eventually slide 287 contacts rearward projection 367 on index slide 351. At this point (i.e., approaching the completion of the rearward stroke), further rearward displacement of slide 287 causes index pawl 383 to rotate in the counterclockwise direction about opening 389. The counterclockwise rotation of index pawl 383 causes tooth 397 to engage notch 411 and, in turn, rotate sprocket 399 in the counterclockwise direction until the cross-bar 35 of the next successive fastener 31 in the fastener stock is disposed in direct axial alignment behind longitudinal bore 239 of needle 229, as represented in FIG. 73(*e*).

Figure 74:
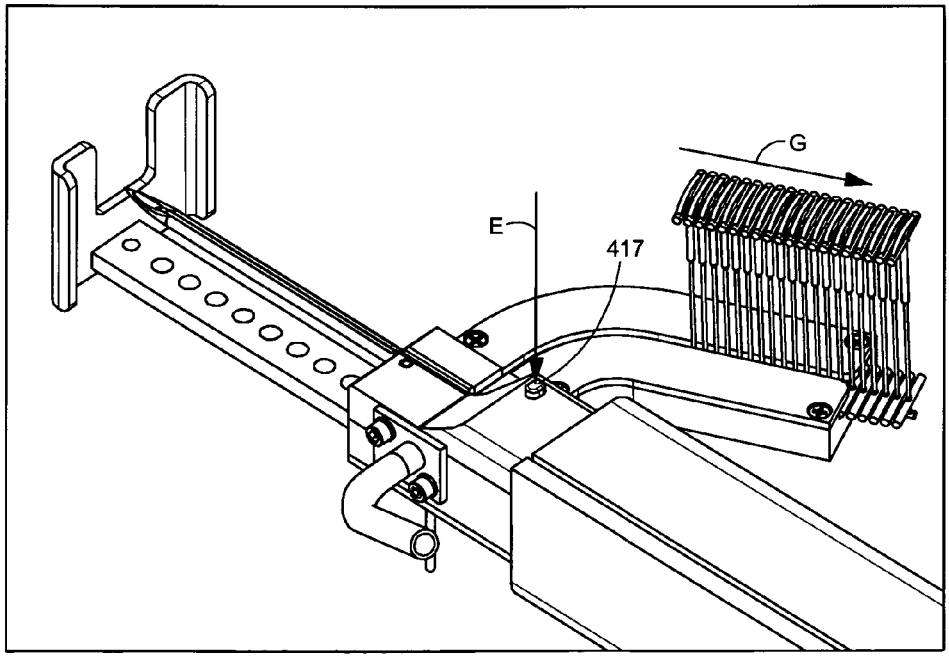
FIG. 74 is an enlarged, fragmentary, front perspective view of the tool shown in FIG. 38(*a*), the tool being shown with a clip of fastener being withdrawn therefrom.

It should be noted that detent 413 is designed to sequentially engage notches 411 to prevent sprocket 399 from rotating in the clockwise condition during the indexing process which, in turn, can cause the fastener stock to become jammed within tool 211. If fastener stock becomes jammed within tool 211, it is to be understood that the ability of springs 373 to absorb some of the jamming forces prevents particular components of tool 211 from becoming permanently damaged. Furthermore, in order to release (i.e., back out) jammed fastener stock from tool 211, the user can apply an inward force (as represented by arrow E in FIG. 74) onto the externally accessible portion of release button 417. The application of an inward force onto release button 417 causes release button spring 423 to compress which, in turn, inwardly displaces release button 417. As seen most clearly in FIG. 70(*a*), as release button 417 displaces inward (in the direction of arrow F), detent 413 rides upward along a curved surface 425 in hammer 419 and eventually becomes disengaged from notch 411 in sprocket 399. Simultaneously, as release button 417 displaces inward (in the direction of arrow F), arm 421 abuts against front surface 385 of index pawl 383. The application of said force on index pawl 383 causes bowed washer 395 to flatten which, in turn, causes tooth 397 on index pawl 383 to disengage from notch 411 in sprocket 399. While maintaining the inward force onto release button 417 (which, in turn, disengages detent 413 and index pawl 383 from sprocket 399), sprocket 399 can be rotated in the counterclockwise direction in order to withdraw (i.e., back out) the fastener stock from tool 211 (as represented by arrow G in FIG. 74) to eliminate the jamming condition.

In use, tool 211 may be used in the following manner to couple together multiple layers of a mattress with a fastener 31. Specifically, a length of tubing from a heavy duty pneumatic power source (not shown) is coupled directly to the large sized input valve 333 in valve support block 303. A supply of fastener stock is advanced into channel 349 of fastener guide assembly 341 until the severable connector 41 associated with the lowermost fastener 31 in the fastener stock aligns within a corresponding notch 409 in sprocket 399. With the supply of fastener stock fed into tool 211 in this manner, the cross-bar 35 of the lowermost fastener 31 is disposed in direct axial alignment behind longitudinal bore 239 of needle 229. At this point, tool 211 is ready for use in securing together multiple layers of a mattress with one or more fasteners 31.

Prior to dispensing fasteners 31 from tool 211, it is recommended that the user adjust the effective length of needle 229 by fixing the position of needle stop 243. Accordingly, while pulling on ring 277, needle stop 243 is linearly displaced until the desired indicia 255 aligns within circular window 279 in right side casing 215 (thereby denoting the proper setting for needle stop 243). At this time, the force applied onto ring 277 is released which causes locking member 267 to fix needle stop 243 in place.

Figure 49:
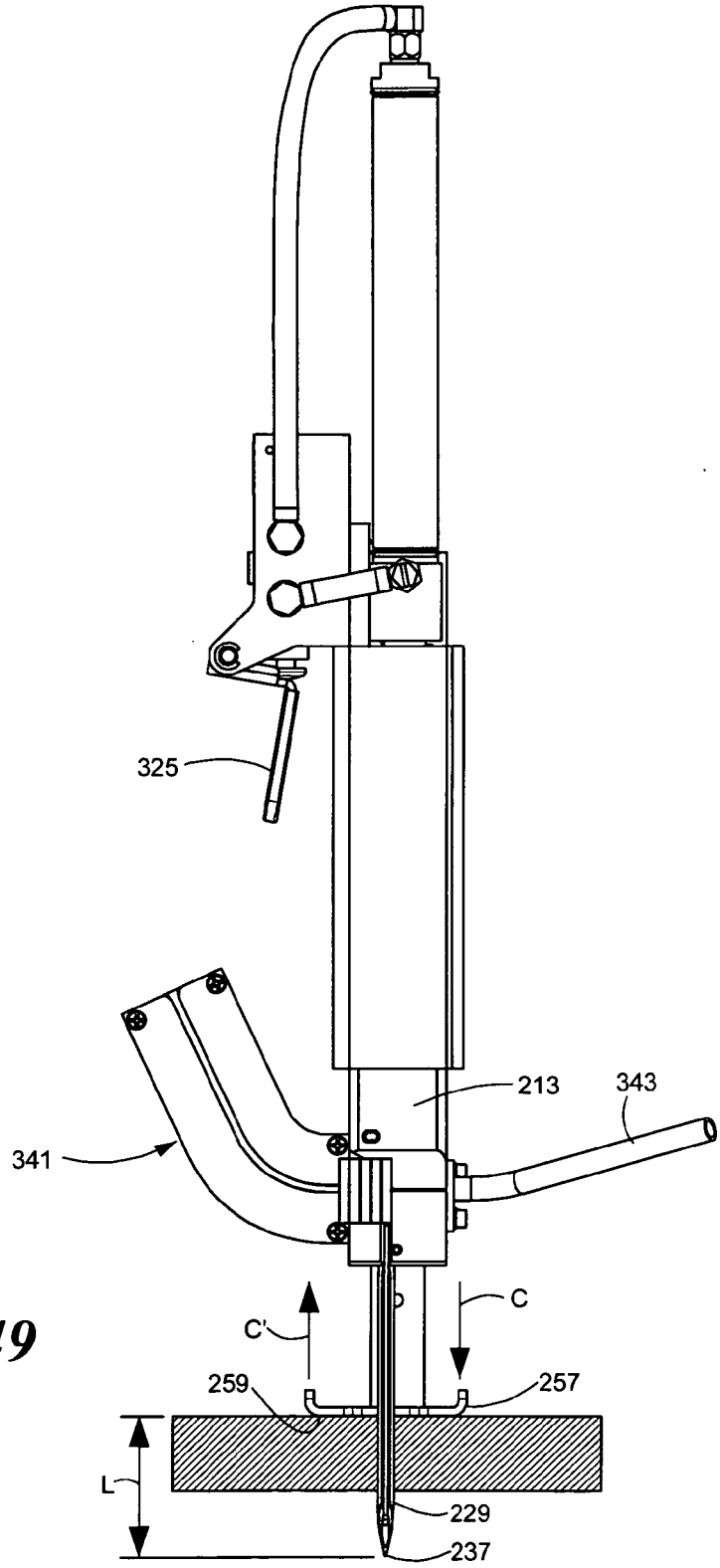
FIG. 49 is a front plan view of the tool shown in FIG. 38(*a*), the tool being shown with a clip of five fasteners loaded therein, the tool being shown driven through a mattress, the mattress being shown in section for purposes of clarity.

With needle stop 243 locked in a particular setting, the user grasps tool 211 using handle 223 and penetrates the sharpened tip of needle 229 through the layers of the mattress, as shown in FIG. 49. It should be noted that, as needle 229 is penetrated through the desired layers, eventually surface 259 of contact plate 257 abuts against the outer surface of the mattress to preclude further penetration of needle 229.

While maintaining needle 229 disposed through the desired layers, the user depresses trigger cover 325 which, in turn, activates the pneumatically-driven forward trigger stroke. The forward trigger stroke causes ejector rod 291 to advance the cross-bar 35 of the lowermost fastener 31 through bore 239 of needle 229 until it exits through the opened tip of needle 229. As such, cross-bar 35 of fastener is secured to the underside of the mattress layers and cross-bar 33 is secured to the topside of the mattress layers, as shown in FIG. 1. The release of trigger cover 325 commences the rearward trigger stroke which, in turn, indexes the next successive fastener 31 in place behind needle 229 for future dispensing operations.

The embodiments shown of the present invention are intended to be merely exemplary and those skilled in the art shall be able to make numerous variations and modifications to them without departing from the spirit of the present invention. All such variations and modifications are intended to be within the scope of the present invention as defined in the appended claims.

What is claimed is:

1. A mattress comprising:

(a) a first layer, (b) a second layer, at least one of said first and second layers being constructed of foam, and (c) a one-piece plastic fastener for coupling together said first and second layers, the one-piece plastic fastener comprising, (i) a first cross-bar, (ii) a second cross-bar, and (iii) a thin filament interconnecting the first and second cross-bars.

2. The mattress as claimed in claim 1 wherein at least one of said first and second layers is in the form of foam rubber.

3. The mattress as claimed in claim 1 further comprising a layer of cushioning material, said layer of cushioning material being coupled to said first and second layers by said plastic fastener.

4. The mattress as claimed in claim 1 wherein said plastic fastener has an H-shaped configuration.

5. A method for coupling together first and second layers of a mattress, at least one of said first and second layers being constructed of foam, said method comprising the steps of:

(a) positioning said first layer relative to said second layer; and (b) dispensing a one-piece plastic fastener through said first and second layers, the plastic fastener comprising, (i) a first cross-bar, (ii) a second cross-bar, and (iii) a thin filament interconnecting the first and second cross-bars.

6. The method as claimed in claim 5 wherein said plastic fastener has an H-shaped configuration.

* * * * *